US006082350A

United States Patent [19]

Crews et al.

[11] Patent Number: 6,082,350

[45] Date of Patent: Jul. 4, 2000

[54] ACCURATE, MULTI-AXIS, COMPUTER-CONTROLLED OBJECT PROJECTION MACHINE

[75] Inventors: Doug A. Crews; Richard J. Richings, both of Seattle, Wash.

[73] Assignee: Chin Music LLC, Seattle, Wash.

[21] Appl. No.: 09/244,608

[22] Filed: Feb. 4, 1999

[51] Int. Cl.[7] ..... F41B 4/00

[52] U.S. Cl. ..... 124/78

[58] Field of Search ..... 124/6, 78, 81

[56] References Cited

U.S. PATENT DOCUMENTS

| | | | |
|---|---|---|---|
| 4,125,256 | 11/1978 | Weir | 482/31 |
| 4,173,337 | 11/1979 | Okonowski | 473/456 |
| 4,203,454 | 5/1980 | Wutscher | 131/170 R |
| 4,442,823 | 4/1984 | Floyd et al. | 124/78 |
| 4,632,088 | 12/1986 | Bruce | 124/78 |
| 4,712,534 | 12/1987 | Nozato | 124/78 |
| 4,760,835 | 8/1988 | Paulson et al. | 124/78 |
| 4,841,945 | 6/1989 | Braden | 124/78 |
| 4,915,384 | 4/1990 | Bear | 473/451 |
| 5,050,574 | 9/1991 | Ramirez | 124/3 |
| 5,064,194 | 11/1991 | Bixler et al. | 4743/436 |
| 5,066,010 | 11/1991 | Pingston | 473/451 |
| 5,083,775 | 1/1992 | Heard | 473/427 |
| 5,097,985 | 3/1992 | Jones | 221/86 |
| 5,121,735 | 6/1992 | Hancock | 124/7 |
| 5,125,653 | 6/1992 | Kovacs et al. | 124/78 |
| 5,195,744 | 3/1993 | Kapp et al. | 473/457 |
| 5,232,218 | 8/1993 | Leps | 124/50 |
| 5,340,101 | 8/1994 | Lawson et al. | 473/426 |
| 5,344,137 | 9/1994 | Komori | 124/36 |
| 5,359,986 | 11/1994 | Magrath et al. | 124/78 |
| 5,385,343 | 1/1995 | Davis, Sr. | 473/452 |
| 5,390,915 | 2/1995 | Levatino | 473/453 |
| 5,415,150 | 5/1995 | Dallas | 124/50 |
| 5,417,196 | 5/1995 | Morrison et al. | 124/6 |
| 5,437,261 | 8/1995 | Paulson et al. | 124/78 |
| 5,439,212 | 8/1995 | Hart | 124/7 |
| 5,464,208 | 11/1995 | Pierce | 473/451 |
| 5,467,979 | 11/1995 | Zarate | 473/429 |
| 5,472,187 | 12/1995 | Kempf | 473/451 |
| 5,494,022 | 2/1996 | Sung | 124/16 |
| 5,496,025 | 3/1996 | Phillips et al. | 124/56 |
| 5,562,282 | 10/1996 | Stevenson | 124/7 |
| 5,865,161 | 2/1999 | Bruce | 124/78 |

OTHER PUBLICATIONS

Sports Simulation, Inc. "MultiSport Stadium" brochure.
The Jugs Company, "Spring & Summer, 1998 Product Guide," 1998.
The Jugs Company, "The Jugs Company 1998 Catalog," 1998.
The Jugs Company, "The Jugs Newsletter, #31," 1998.
ATEC, "Baseball Product Catalog," 1997, pp. 2–3.
ATEC, "Hitting Streak" brochure.
ATEC, "Baseball and Softball Equipment Catalog," 1994, pp. 6–7, and 2–sided enclosure.
What a Game, "Designated Hitter Game".
Video Baseball, correspondence regarding the Power Alley and Power Pitcher video baseball systems, Oct. 19, 1997.
Video Baseball, "Power Alley Video Batting System," 1994.

*Primary Examiner*—John A. Ricci
*Attorney, Agent, or Firm*—Weiss Jensen Ellis & Howard

[57] ABSTRACT

An accurate-automated-multi-axis machine for projecting objects. Multiple axes are employed to impart predetermined velocities and rotational components to the projected object. Projection of the object may be synchronized with a displayed video image to simulate the throwing of an object.

21 Claims, 39 Drawing Sheets

ACCURATE, MULTI-AXIS, COMPUTER-CONTROLLED OBJECT PROJECTION MACHINE

TECHNICAL FIELD

The present invention relates to throwing machines and, in particular, to an accurate object throwing machine having multiple axes that are controlled by a computer system to throw an object from a predefined release point with a predefined initial velocity, a predefined initial trajectory, and two predefined components of rotational motion.

BACKGROUND OF THE INVENTION

Professional baseball, through attendance fees, broadcast rights, and various marketing activities, generates enormous annual revenues. However, because of the high salaries paid to professional baseball players and the high cost of stadiums and training facilities, baseball is a business of relatively close margins. In order to maintain and increase revenues from game attendance and from televised broadcasts, it is vital to maintain high levels of interest and excitement of baseball fans. Although low-scoring pitching duels may be the delight of baseball connoisseurs, fans are generally most interested and excited in games that feature relatively large numbers of base hits and home runs.

Successfully hitting a baseball pitched by a professional baseball pitcher is considered by many to be the single most difficult task undertaken by an athlete in professional sports. The speed of a pitched baseball, as it crosses home plate, may vary from between 60 and 70 mph to over 90 mph. The baseball may be released from any point within a relatively large area, depending on the height and stance of a pitcher and the type of pitch that is being thrown. A thrown baseball may exhibit any one of a large number of different, aerodynamically induced trajectories that depend on the orientation of the seams of the baseball with respect to the translational and rotational motions of the baseball, the initial velocity of the baseball, and the orientation of the rotational motion of the baseball with respect to the translational motion of the baseball. Because of the short travel time of a thrown baseball between the release point and home plate, on the order of between 4 and 5 tenths of a second, because of the relatively slow response times of a batter following the visual perception of the release and initial trajectory of a pitched baseball, and because of the large number of different, aerodynamically induced trajectories that a thrown baseball may follow, a batter has only milliseconds in which to either estimate the height and orientation with which a thrown baseball traverses a volume of space above home plate known as the strike zone and begin to swing the bat to meet the baseball or to conclude that the trajectory of the baseball will not intersect the strike zone and decline to swing the bat. Advances or delays of as little as 5 milliseconds in the timing of the initiation of the swing that would, if correctly timed, result in a home run, may result in a foul ball to the left-hand side of the field or a foul ball to the right-hand side of the field. Slight dislocations of the point of contact between the bat and the pitched baseball from the optimal point of contact can result in erratic pop-ups or foul balls.

Because fan enthusiasm depends, to a large extent, on the ability of batters to hit pitched baseballs, and because hitting pitched baseballs requires hand-eye coordination skills close to the limit of human ability, training of professional baseball players to consistently hit baseballs pitched by professional baseball pitchers is a vital and difficult component of a professional baseball training program. One effective approach to train batters to hit professional pitched baseballs would be to expose the batter to professional pitchers for many hours each day. However, the ability to pitch baseballs accurately, at high speeds, and with varying trajectories, is also a rare skill. In addition, pitching baseballs at the highest skill levels is an extremely physically demanding undertaking. Because of the high salaries paid to professional baseball pitchers, because of the relatively short duration in which a baseball pitcher can pitch baseballs at high skill levels without incurring an injury, and because of the relatively large number of pitches that need to be thrown to each batter in order to train that batter, it is impractical to use professional baseball pitchers to train batters.

As an alternative to using professional baseball pitchers, baseball teams may employ semi-professional or amateur pitchers for practice sessions. However, using semi-professional or amateur pitchers may also be expensive, and, most importantly, semi-professional and amateur pitchers cannot throw the baseball with the speeds, accuracies, and varying trajectories with which professional pitchers pitch the baseballs during games. For these reasons, baseball teams have employed a number of different pitching machines for repetitive batting practice.

Various types of pitching machines have been designed, manufactured and proposed. In one type of pitching machine, shown in FIG. 1, a baseball 102 is tethered by a line or cable 104 to a vertical rotating shaft 106 spun by an electric motor 108. The ball travels in a circular path within a horizontal plane, each revolution representing a pitch. In general, such devices poorly simulate a thrown baseball because the circular trajectory of the ball does not resemble the trajectory of a pitched baseball.

A large variety of different devices for projecting a baseball have been employed. Such devices may be placed at roughly the same distance from a practicing batter as the distance between a batter and the normal release point of a baseball pitcher. A number of different propulsion mechanisms have been used in these projecting devices, including pneumatic propulsion, electromagnetic acceleration, and spring driven lever arms. Although far better than the pitching machine displayed in FIG. 1, these various types of projecting pitching machines have also proved inadequate. In general, they are not able to faithfully replicate the motion of a baseball as thrown by a baseball pitcher. Furthermore, these devices are generally quite inaccurate, as well as unsafe due to the risk of injury to the batter. While a professional baseball pitcher can routinely pitch a baseball through the front face of the strike zone, a cube less than two feet on a side, the pitching machines pitch with much greater variation. As a result, a batter practicing against such machines naturally tends to adopt a more careful and hesitant attitude than the batter would adopt against a human pitcher. More problematic, these pitching machines generally pitch baseballs at slower speeds than a professional baseball pitcher, and generally do not pitch real baseballs. Pitching of real baseballs is problematic because the currently-available machines have no way of orienting the seams of the baseball and, without such orientation, the trajectory of the baseball becomes quite erratic because of aerodynamic affects,.

A far more successful type of pitching machine, produced by a number of pitching machine manufacturers, including The Jugs™ Company, employs two counter-rotating rubber-tired wheels to propel a baseball towards a batter as well as to impart a rotational spin on the baseball. FIG. 2 illustrates a Jugs-type pitching machine. A human operator 202 places a baseball 204 into a mechanical feeder (not shown) through which the baseball rolls into a narrow space between the two counter-rotating rubber pneumatic tire and wheel assemblies that include wheels 206 and 208. The counter-rotating wheels 206 and 208 are independently driven by electric motors 210 and 212. The counter-rotating wheels rotate at speeds up to 3,000 rpm. The ball is briefly pinched between the wheels and then expelled at speeds that can approach 90 mph. By adjusting the rate of spin of one wheel with respect to the other, so that the two counter-rotating wheels rotate at slightly different speeds, a ball can be expelled from the device with a rotation, either forward or backward, in the plane in which the two counter-rotating wheels lie. Moreover, as shown in FIG. 3, the plane of the counter-rotating wheels can be tilted in order to alter the trajectory of the ball. In FIG. 3, for example, the ball follows a curved path between the Jugs machine and the batter because of a tilted spin imparted to the ball by the tilted counter-rotating wheels. The Jugs machine can be adjusted along a number of different axes. For example, the mechanism may be rotated with respect to a vertical axis in order to adjust the initial horizontal trajectory of the pitched ball. The assembly can be vertically adjusted about a horizontal axis to vary the angle at which a ball is pitched with relation to the ground. These vertical and horizontal adjustments together describe the initial translational trajectory of the baseball. Because the counter-rotating wheels are driven by separate electrical motors, their relative rotational speeds can be adjusted to impart different degrees of spin in both the forward and backward directions to the ball.

While a vast improvement over the previously described devices, the Jugs machine nonetheless falls far short of the capabilities of a human baseball pitcher. First, the Jugs machine does not accurately pitch real baseballs because the Jugs machine cannot orient the seams of a real baseball reliably, and thus cannot control the aerodynamically induced motion of the baseball. Instead, a dimpled plastic ball is normally used. Second, there are additional rotational motions that can be imparted to the baseball by a human pitcher that the Jugs machine cannot reproduce. The Jugs machine does not have enough controllable axes in order to reproduce a human thrown baseball. Finally, the Jugs machine does not reproduce the visual appearance of a human baseball pitcher, including varying release points for varying pitches. The release point can be adjusted on a Jugs machine by raising and lowering the counter-rotating wheel assembly, but this operation requires a rather lengthy period of time and a rather lengthy period of recalibration.

In order to simulate a live human pitcher, manufacturers have attempted to combine projection of a video image of a baseball pitcher with baseball pitching machines of various types, most commonly, a Jugs-type baseball pitching machine. FIG. 4 illustrates a live-motion, video-image pitching machine system. A live-motion image of a baseball pitcher 402 is projected onto a screen 404. At the point in time at which the image of the baseball pitcher releases the baseball, a baseball is ejected from a small stationary port 406 in the plane of the projection screen 404. In general, these systems have been rather crudely implemented and do not reproduce the timing and appearance of a human pitcher. First, as with the other above mentioned pitching machines, these systems generally do not pitch real baseballs, but instead pitch dimpled plastic baseballs, with the same lack of ability to reproduce the actual motion of pitched baseballs as inherent in all the above described pitching machines. Moreover, the release point 406 is fixed on the screen, whereas a human pitcher releases the balls at varying locations on a release-point plane at various distances from the batter, depending on the different types of pitches that are being thrown and on the physical characteristics of the pitcher. Finally, all of these systems place the projection screen closer to the batter than the 60-foot distance that normally separates a batter from a human pitcher, generally from as little as 20 feet up to a maximum of 50 feet. To make up for the shortened distance, the ball is thrown at slower speeds. However, the visual effect produced by these systems is much different that the visual effect produced by a human pitcher throwing at normal speeds and by the aerodynamic motion of a pitched baseball.

Because of the increasingly thin profit margins in the baseball business, the need for improving professional baseball batting is becomingly increasingly important. Currently available baseball pitching machines cannot closely reproduce the motions of baseballs pitched by human pitchers. Currently available baseball pitching systems cannot reproduce the visual appearance of a human pitcher, nor can they reproduce the varying release points and the motions of human pitched baseballs. For these reasons, a need has been recognized for a baseball pitching machine that can faithfully reproduce the motions and trajectories of pitched baseballs and that can faithfully reproduce the appearance of a human pitcher. In addition, for many of the above-described reasons, object projecting machines configured to repeatedly and faithfully reproduce thrown and batted objects are equally desirable for simulating other aspects of baseball and other types of sports, including tennis, hockey, martial arts, football, ping-pong, and badminton, and may have additional industrial applications.

SUMMARY OF THE INVENTION

One embodiment of the present invention is a multi-axis, servo-controlled baseball pitching machine ("BPM"). A full-motion image of a baseball pitcher is displayed on a vertical projection screen at the front of the BPM. The moving image of the baseball pitcher simulates the positions and movements of a baseball pitcher. Various moving images can simulate a variety of different types of pitches pitched by any number of different baseball pitchers. At the point in time that the baseball is released from the simulated pitcher's hand, a physical baseball is projected through the projection screen, from the position of the release point of the baseball portrayed in the projected image, towards a defined position relative to a human batter. Thus, the BPM of one embodiment of the present invention visually simulates the position and motions of various baseball pitchers throwing different types of pitches and projects a baseball towards the batter with a predetermined initial speed and with a predefined trajectory that faithfully reproduces the type of pitch being thrown by the simulated baseball pitcher.

The BPM features a dynamic release point, or port, that can be positioned anywhere within a large portion of the projection screen in order to coincide in time and position with the release of the baseball by the simulated pitcher. The dynamic port operates as a shutter that is opened for a very short period of time to allow a baseball to pass through the projection screen. The action of the shutter is not visible to the batter, since it is actuated in less than 1/25th of a second, below the visual acuity threshold for humans.

The baseball is gripped by a gripper component and horizontally translated between two cylindrically shaped counter-rotating flywheels. The cylindrical surface of the two flywheels is coated with a compressible material that grips the baseball through frictional forces. The rotational momentum of the counter-rotating flywheels is then instantaneously imparted to the baseball when the gripper component forces the baseball between the two counter-rotating flywheels and projects it at a high speed towards home plate in the direction of a horizontal axis between the two counter rotating flywheels. The speed of the ball is controlled by the rotational speed of the counter-rotating flywheels, each driven by an electrical servo motor. A rotational spin either in a clockwise or a counterclockwise direction in a plane passing through and bisecting both counter-rotating flywheels can be imparted to the baseball by rotating the two counter-rotating flywheels at different speeds. The angle of the spin with respect to the vertical can be adjusted by rotating both flywheels about a projection axis passing between the two flywheels, orthogonal to a line segment between the centers of the two flywheels and coplanar with the plane passing through and bisecting both counter-rotating flywheels, along which the baseball is initially projected. When rotation of the flywheels about the projection axis occurs at the time that the baseball is projected from between the flywheels, an additional spin can be imparted to the baseball in a plane orthogonal to the projection axis passing between the two flywheels.

The flywheels and the servo motors driving the flywheels are mounted in an assembly that can be horizontally and vertically translated with respect to the projection screen, thus placing the release point of the baseball at any point within in a planar area coincident with, and bounded by, the plane of the projection screen. In addition, the assembly can be driven by additional servo motors to rotate about a pivot in the horizontal direction and to rotate about a pivot in the vertical direction in order to orient the projection axis within an imaginary cone perpendicular to the projection screen and opening out and away from the projection screen from the release point of the baseball in the direction of projection of the baseball.

The reflective surface of the projection screen comprises five flexible sheets. A first flexible sheet is attached to the left side of the assembly in which the counter-rotating flywheels are mounted and is taken up by a vertically-mounted, spring-loaded take-up reel on the left side of the baseball machine. Similarly, a second flexible reflective sheet is attached to the right side of the assembly in which the flywheels are mounted and is taken up by a vertically mounted, spring-loaded take-up reel on the right side of the baseball machine. A third reflective, flexible sheet with a slot, or aperture, is held between lower and upper horizontally-mounted, electrical servo operated reels that are positioned below and above the assembly in which the flywheels are mounted and that are translated horizontally with respect to the projection screen along with the assembly in which the flywheels are mounted. By moving the aperture in the third flexible sheet to a location coincident with the projection axis at the time that the baseball is projected between the two flywheels, a small, shutter-like opening briefly appears in the surface of the projection screen in order to allow the baseball to pass through the projection screen. A fourth flexible sheet is attached to the top of the assembly in which the counter-rotating flywheels are mounted and is taken up by a horizontally-mounted, spring-loaded take-up reel on the top of the baseball machine. Similarly, a fifth flexible reflective sheet is attached to the bottom of the assembly in which the flywheels are mounted and is taken up by a horizontally mounted, spring-loaded take-up reel on the bottom of the baseball machine. The fourth and fifth flexible sheets lie behind the third flexible sheet so that the aperture in the third sheet cannot be moved in front of exposed, open spaces above and below the assembly in which the flywheels are mounted.

The speeds of the two counter-rotating flywheels, the release point of the baseball, the initial direction at which the baseball is projected away from the projection screen, and the angle of the plane bisecting the two counter-rotating flywheels with respect to the projection axis can all be controlled and adjusted by computer control of electrical servo motors to faithfully reproduce the trajectories of various types of baseball pitches, including the fastball, the curveball, the knuckleball, and the slider. Moreover, the various types of pitches can be coordinated with the projected images of a baseball pitcher to simulate pitching of the baseball by any number of different baseball pitchers. Finally, the trajectory with which the baseball passes through the strike zone can be accurately predetermined by computer control of the electrical servo motors to within a radius of two inches from a desired trajectory when the baseball is projected from a distance of 60 feet.

Modification of certain components of the object projection machine of the present invention can be made to produce a tennis ball serving machine, a martial arts weapons throwing machine, a football passing machine, and other types of sports simulators. The object projection machine may also find use in industrial simulators, test equipment, and mass conveyance devices.

DETAILED DESCRIPTION OF THE INVENTION

Figure 1:
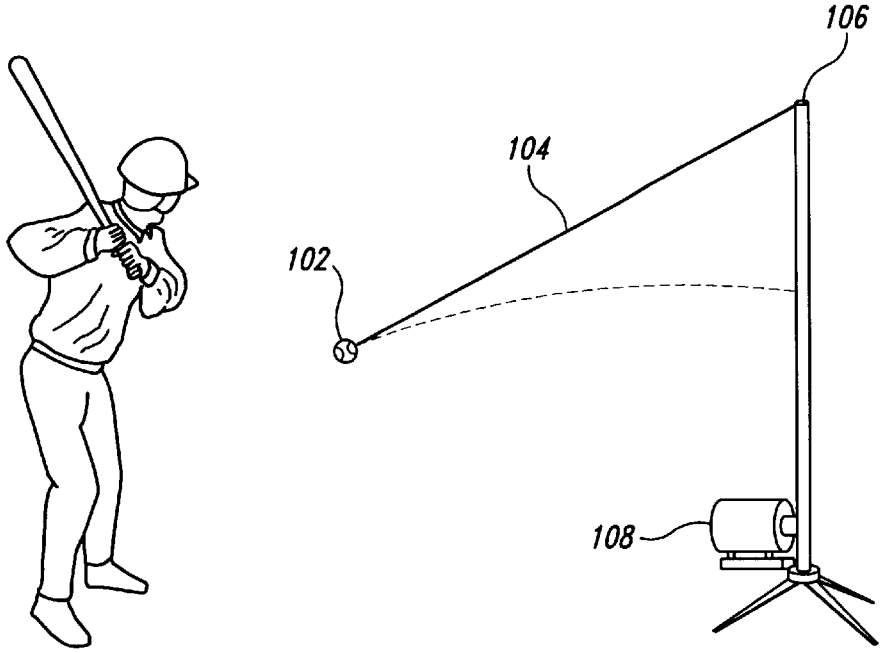
Fig. 1 (Prior Art)
FIG. 1 illustrates one type of currently-available pitching machine.
Figure 2:
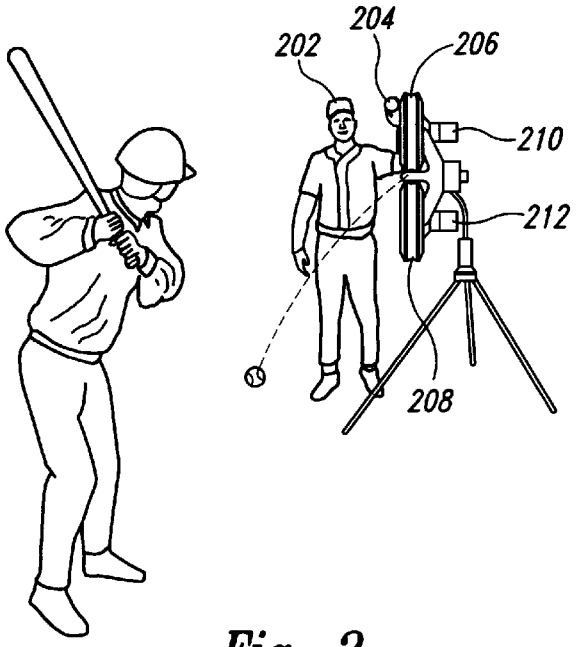
Fig. 2 (Prior Art)
FIG. 2 illustrates a variety of different devices for projecting a baseball.
Figure 3:
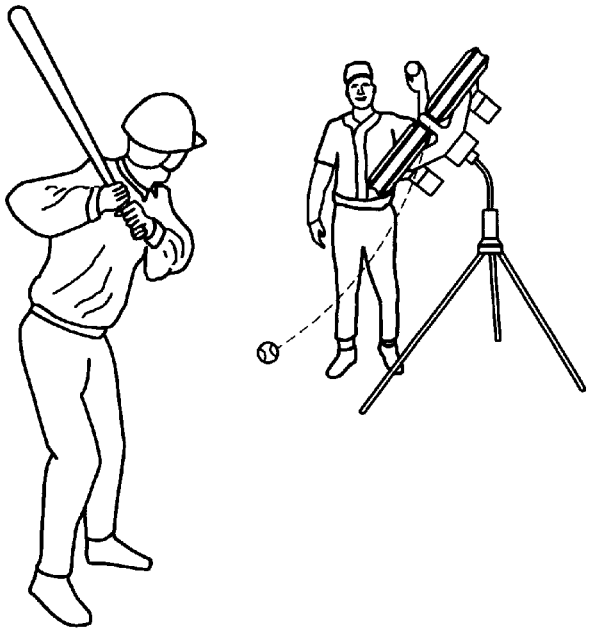
Fig. 3 (Prior Art)
FIG. 3 illustrates a Jugs™ pitching machine.
Figure 4:
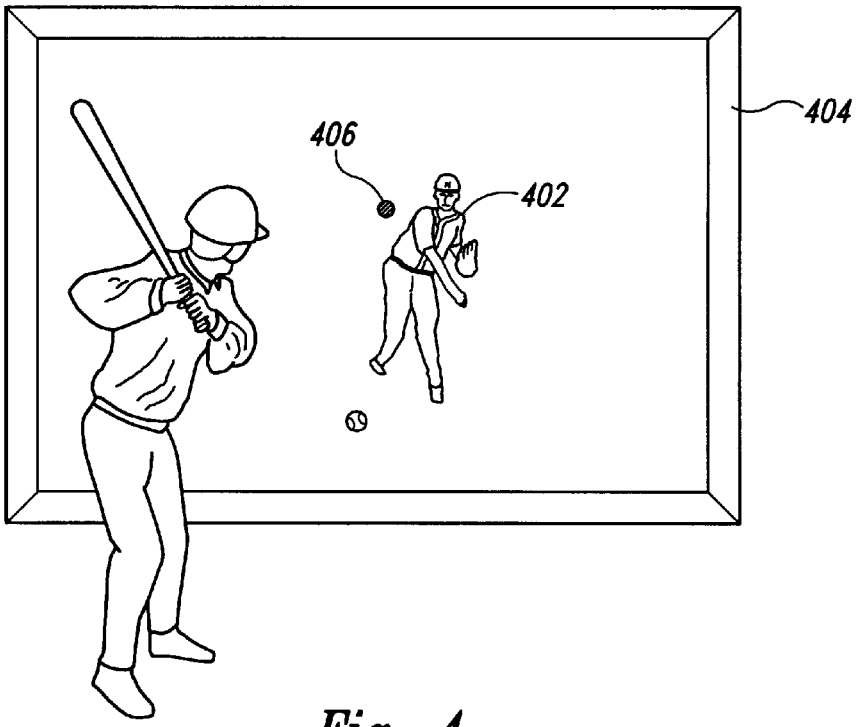
Fig. 4 (Prior Art)
FIG. 4 illustrates a live-motion video-image pitching machine system.
Figure 5:
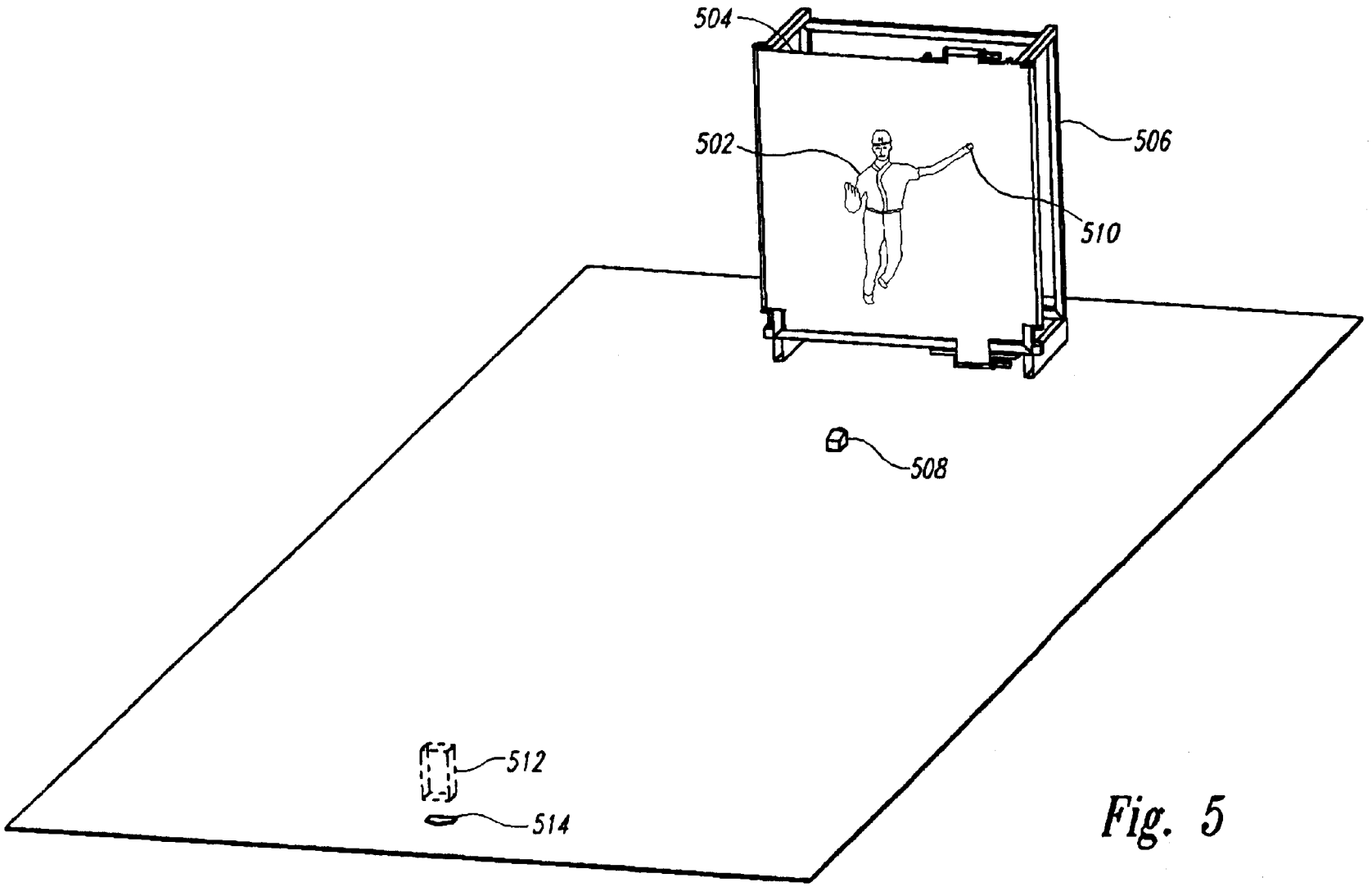
FIG. 5 illustrates the appearance of the BPM as viewed from an observation point somewhat behind home plate.

One embodiment of the present invention is a baseball pitching machine ("BPM") for use in baseball batting practice. FIG. 5 illustrates the appearance of the baseball pitching machine as viewed from an observation point somewhat behind home plate. A full-motion video image of a baseball pitcher 502 is projected onto a vertical projection screen 504 that comprises the forward-facing surface of the BPM 506. The image of the baseball pitcher 502 is projected onto the projection screen 504 from a video image projector 508. As an image of a baseball is released from the hand of the projected image of the baseball pitcher 502, a dynamically relocatable shutter 510 opens for an instant to allow a real baseball to be projected from the BPM 506 toward a point in space 512 above home plate 514. The BPM 506 features computer-controlled, multi-axis electrical servo motor control of a number of mechanical components within the BPM that provide the BPM with the ability to impart a precisely-defined initial velocity and initial trajectory to the baseball as well as to impart several rotational spin components to the baseball in order to simulate the type of pitch thrown by the baseball pitcher whose image is displayed on the projection screen 504. For example, the BPM can accurately simulate a fastball pitch, a slider pitch, a curveball pitch, a knuckleball pitch, and various more complex hybrid pitches. Furthermore, the BPM can be calibrated in order to precisely target the baseball to a selected point within a space 512 located above home plate 514.

Figure 6:
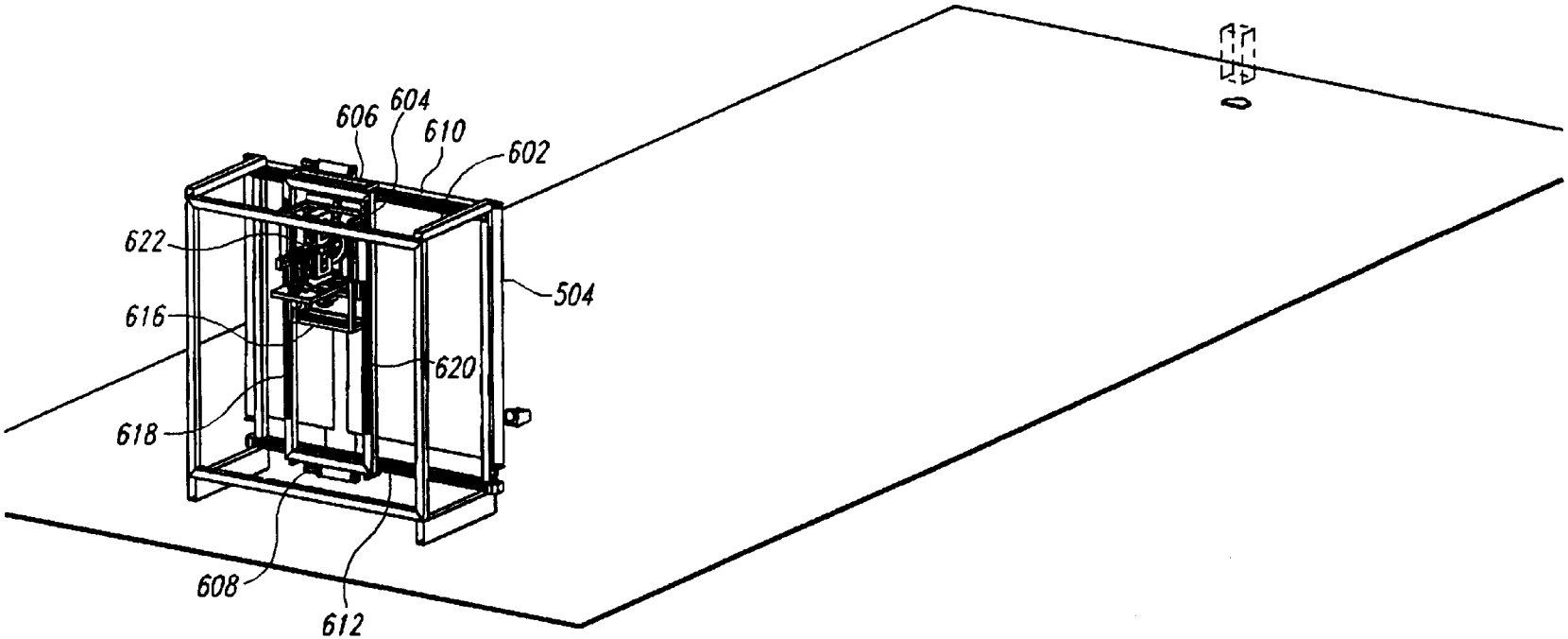
FIG. 6 shows the BPM as seen from an observation point behind the side of the BPM opposite from the vertical projection screen.

FIG. 6 shows the BPM as seen from an observation point behind the BPM. Major components of the baseball pitching machine visible in FIG. 6 include: (1) a main frame 602 comprising twelve members positioned along the edges of a rectangular solid and joined at 90° angles; (2) a rectangular X-axis frame 604, having a top horizontal support 606 and lower horizontal support 608 affixed to an upper horizontal member 610 and a lower horizontal member 612 of the main frame 602 via a system of rollers (not shown) to allow the X-axis frame to move horizontally across the plane of the vertical projection screen 614 (504 in FIG. 5); (3) a Z-axis carriage 616 affixed to horizontal members 618 and 620 of the X-axis frame via a system of rollers (not shown) to allow the Z-axis carriage to move in a vertical direction within the X-axis frame; and (4) a number of baseball-projecting and initial-trajectory-determining components 622 mounted within the Z-axis carriage 616. The horizontal position of the X-axis frame 604 and the vertical position of the Z-axis carriage 616 together determine an x, z Cartesian position of the release point of a baseball with respect to the surface of the vertical projection screen 614.

Figure 7:
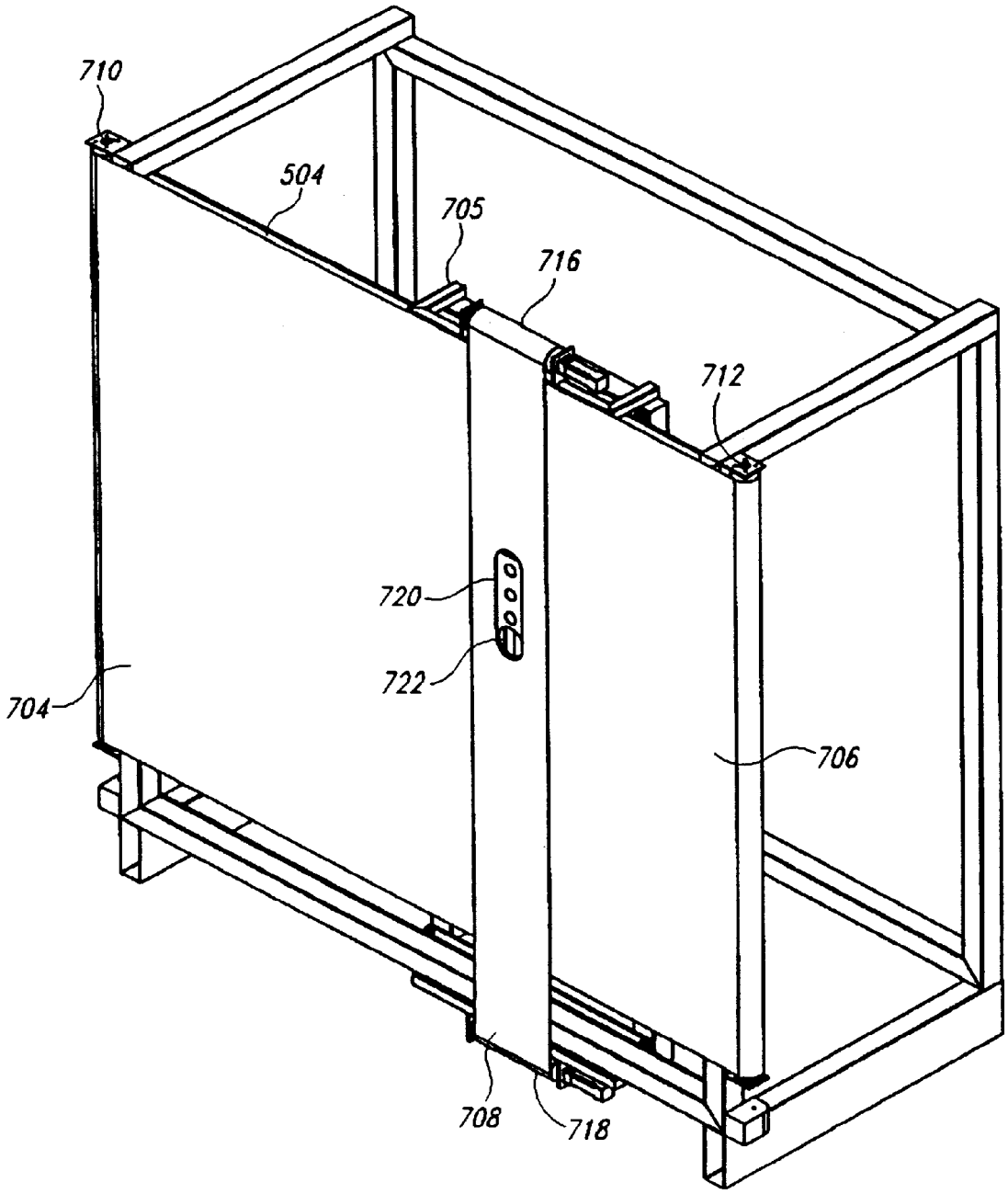
FIG. 7 illustrates additional details of the vertical projection screen of the BPM.

FIG. 7 illustrates additional details of the vertical projection screen of the BPM. The vertical projection screen 702 comprises five separate flexible reflective sheets, including flexible reflective sheets 704, 706, and 708 (two of the five flexible, reflective sheets are not shown in FIG. 7, but are shown below, in FIG. 12). The left-hand sheet 704 is vertically attached to the X-axis frame 705 (vertical attachment not shown) and extends across the face of the BPM to a vertically mounted, spring-loaded take-up/supply reel 710. The right-hand sheet 706 is vertically attached to the X-axis frame 705 (vertical attachment not shown) and extends across the face of the BPM to a vertically-mounted, spring-loaded take-up/supply reel 712. A top sheet (not shown) is horizontally attached to the X-axis frame and extends vertically between the top of the face of the BPM to a spring-loaded take-up/supply reel horizontally mounted to the top of the Z-axis carriage. A bottom sheet (not shown) is horizontally attached to the X-axis frame and extends vertically between the bottom of the face of the BPM to a spring-loaded take-up/supply reel horizontally mounted to the bottom of the Z-axis carriage. All four of the above-mentioned spring-loaded, take-up/supple reels are supplied by Milwaukee Protective Covers, Inc., of Milwaukee, Wis., the vertical spring-loaded take-up/supply reels supplied as part number 70-3-PN-11. The same type of reels are available from other manufacturers of roll-up covers. The multiple internal springs in the reels generate a band tension of 38.4 pounds-force on the sheet to maintain a smooth and flat appearance to the user.

As the X-axis frame 705 moves horizontally across the face of the BPM in a leftward direction, the left-hand take-up/supply reel 710 reels in the left-hand flexible sheet 704 while, at the same time, the right-hand take-up/supply reel 712 feeds out the right-hand flexible sheet 706. Conversely, when X-axis frame 705 moves across the face of the BPM in a rightward direction, the left-hand take-up/supply reel 710 feeds out flexible sheet 704 while the right-hand take-up/supply reel 712 reels in flexible sheet 706. As the Z-axis carriage moves vertically upward along the X-axis frame, the top take-up/supply reel reels in the top flexible sheet while, at the same time, the bottom take-up/supply reel feeds out the bottom flexible sheet. Conversely, when Z-axis carriage moves vertically downward along the X-axis frame, the top take-up/supply reel feeds out flexible sheet while the bottom take-up/supply reel reels in flexible sheet. The third flexible reflective sheet 708 is mounted between two horizontally-mounted, servo motor-controlled take-up/supply reels 716 and 718 that provide for vertical motion of the third flexible sheet 708. The third flexible reflective sheet lies above the top and bottom flexible sheets and obscures the top and bottom flexible sheets in FIG. 7. All five reflective, flexible sheets are constructed of one or more of the following materials, available from manufacturers of elastomers and textiles worldwide, in a thickness of 16 thousandths of an inch up to 32 thousandths of an inch:

Neoprene®, cloth-inserted

EPDM (ethylene propylene diene monomer)

Hypalon®

SBR (styrene butadiene rubber)

White Nitrile® FDA sheet (food grade Neoprene® plus Nitrile® rubber coated polyamid)

Viton® (fluoro elastomer)

fluorosilicone

Cloth, coated or impregnated with rubber or Teflon®.

The two horizontally-mounted servo motor-controlled take-up/supply reels 716 and 718 and the third flexible sheet 708 together compose the I-axis. The third flexible sheet 708 includes a rounded slot-like aperture 720 that can be quickly passed over the release point 722 through which a baseball is projected. Thus, motion of the aperture 720 across the release point 722, controlled by the servo motor-controlled take-up/supple reels 716, 718, provides a shutter that exposes the release point 722 for a short time interval during which the baseball is projected through the release point. Otherwise, the aperture 720 is positioned either above or below the release point over an opaque, reflective surface affixed to the Z-axis carriage 705, or over one of the top and bottom flexible sheets, so that, from a distance, the entire vertical projection screen 702 appears to be uniformly colored and uniformly reflective. In a preferred embodiment, the two I-axis electrical servo motors are electronically coupled in a master/slave relationship.

The BPM is intended to simulate to a batter, as accurately as possible, the environment of a baseball game in which the batter is practicing to perform. To this end, the BPM can be augmented with audio speakers to reproduce the audio environment which a batter will likely encounter, including crowd noises and other sounds particular to various ballparks at various times of day. The loudspeaker announcement of the batter's name, for example, may be reproduced to add realism and immediacy to the simulation. In addition, the colors of the image of the baseball pitcher projected on the vertical projection screen can be tuned to simulate, as closely as possible, the colors of the background behind the BPM, so that the BPM blends with the setting in which it is located, or, conversely, so that the pitcher appears to the batter as closely as possible to the anticipated appearance of the pitcher in an upcoming venue.

Figure 8:
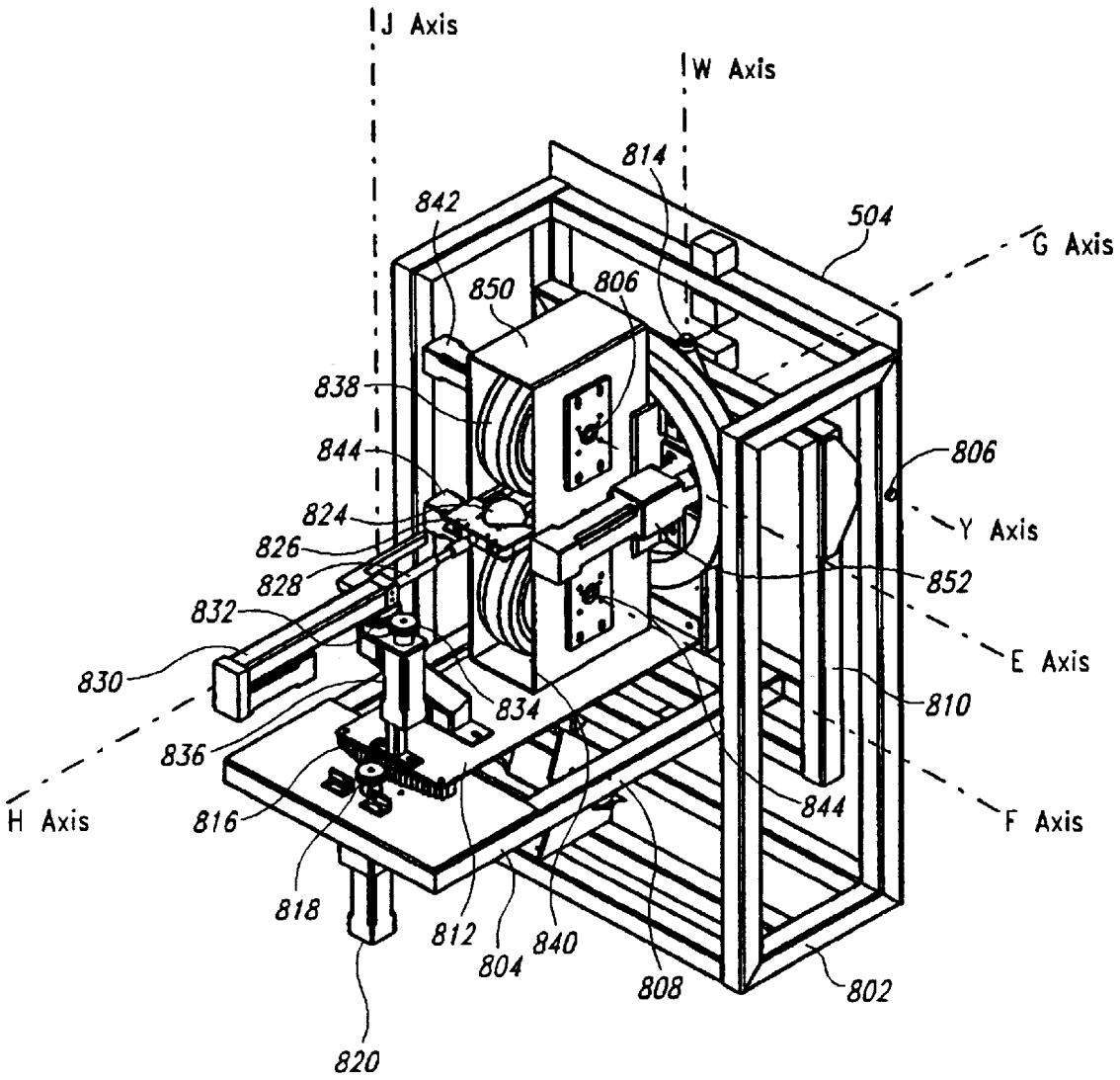
FIG. 8 illustrates seven additional mechanical axes of the BPM.

FIG. 8 illustrates seven additional mechanical axes of the BPM. In FIG. 8, the Z-axis carriage 802 (616 in FIG. 6), along with additional projection and trajectory determining components attached to the Z-axis carriage 802, is shown from an observation point behind the vertical projection screen (not shown). A Y-axis carriage 804 is mounted to the Z-axis carriage 802 via two pins 806 (second pin not shown) and a gear and electrical servo motor interface below the Y-axis carriage (not shown). The Y-axis carriage 804, comprising a rectangular base member 808 affixed to a rectangular front member 810, thus pivots, under electrical servo motor control, about an imaginary Y-axis that runs in a horizontal direction through the centers of the two pins 806 (second pin not shown). Rotation of the Y-axis carriage about the imaginary Y-axis determines the elevation component of the initial trajectory of the baseball projected by the BPM. In other words, the rotational position of the Y-axis carriage selects the angle of the initial trajectory of the baseball with respect to the horizontal plane of the ground. A W-axis carriage 812 is mounted within the Y-axis carriage 804 via two vertical pins 814 (lower pin not shown) coincident with an imaginary vertical W-axis and via a fixed sector gear 816 enmeshed with a gear 818 directly attached to the power shaft of an electrical servo motor 820. The electrical servo motor 820 controls rotation, within a limited angular range, of the W-axis carriage about the imaginary W-axis. The rotational position of the W-axis carriage determines the windage component of the initial trajectory of the baseball. In other words, the position of the W-axis carriage with respect to the W-axis defines a windage angle in a horizontal plane orthogonal to the vertical plane of the projection screen 822 with respect to the projection axis, an imaginary line describing the initial trajectory of a baseball from the BPM. Thus, the rotational position of the Y-axis carriage with respect to the imaginary Y-axis and the rotational position of the W-axis carriage with respect to the imaginary W-axis together determine the initial trajectory of the baseball as it is projected through the vertical projection screen, or, in other words, the orientation of the flywheel housing assembly with respect to the vertical projection screen.

The baseball 824 is held by a gripper component 826 mounted on the arm 828 of an electrical cylinder 830. The arm of the electrical cylinder 828 can be linearly extended and retracted along an imaginary H-axis coincident with the longitudinal axis of symmetry of the electric cylinder arm 828. The electrical cylinder 830 is mounted to a horizontal gear 832 enmeshed with a gear 834 attached to the shaft of an electrical servo motor 836. The electrical cylinder can thus be rotated in a horizontal plane about an imaginary J-axis that passes through the center of the gear 832. Thus, the electrical cylinder can be rotated in either direction away from the position of electrical cylinder 830 shown in FIG. 8 for easy loading of the baseball 824 into the gripper component 826, and then rotated back into the position of the electrical cylinder 830 shown in FIG. 8 in preparation for projection of the baseball towards a target.

Baseball projection is accomplished by feeding the baseball, via extension of the electrical cylinder 830, in between the two counter-rotating flywheels 838 and 840. The baseball is frictionally gripped by compressible circumferential belts bonded to the cylindrical sides of the flywheels and expelled at high speed along the projection axis, also called the "G-axis." The flywheels are directly attached to axles coupled to the power shafts of two horizontally mounted electrical servo motors 842 and 844. Each axle is mounted by two bearing mounts 846 and 848 (two bearing mounts not shown) affixed to the two sides of a flywheel housing 850. An imaginary E-axis is defined as being coincident with the line of symmetry passing through the upper electrical servo motor shaft and an imaginary F-axis is defined as coincident with the line of symmetry passing through the lower electrical servo motor shaft. The flywheel housing 850, along with the flywheels 838 and 840 and the gripper component 826, can be rotated about the G-axis by an electrical servo motor 852.

Table 1, below, summarizes the various axes illustrated in, and described with respect to, FIGS. 6–8.

TABLE 1

| AXIS LETTER | FUNCTION | TYPE OF MOTION | OPERATION DURING RELEASE | ADDS ENERGY TO THROWN BALL |
|---|---|---|---|---|
| E | UPPER FLYWHEEL | ROTARY | YES | YES |
| F | LOWER FLYWHEEL | ROTARY | YES | YES |
| G | ROTATION OF PITCHING DATUM | ROTARY | NO/YES | NO/YES |
| H | FIRING | LINEAR | YES | YES |
| I | SHUTTER DRIVE | ROTARY | YES | NO |
| J | RELOADING | ROTARY | NO | NO |
| W | WINDAGE | ROTARY | NO | NO |
| X | HORIZONTAL RELEASE POINT | LINEAR | NO | NO |
| Y | ELEVATION | ROTARY | NO | NO |
| Z | VERTICAL RELEASE POINT | LINEAR | NO | NO |

The first column of Table 1 includes the names of the various BPM axes, the second column includes concise descriptions of each axis, the third column includes descriptions of the natures of motion of machine components with respect to an axis, the fourth column indicates whether motion with respect to the axis occurs during the release of the baseball from the BPM, and the fifth column indicates whether or not motion with respect to the axis imparts energy to the projected baseball. The X and Z-axes determine the position of the release point with respect to the vertical plane of the projection screen. The Y and W axes determine the initial trajectory of the projected baseball. All four axes X, Z, Y, and W are static at the point in time that the baseball is released by the BPM and therefore impart no energy to the baseball. The reloading axis J is also static at the point in time that the baseball is projected from the BPM and therefore imparts no energy to the baseball. Motion about the J axis allows for loading of the gripper component with the baseball and repositioning of the electrical cylinder that feeds the baseball into the counter-rotating flywheels. The I-axis corresponds to motion of a narrow, vertical portion of the projection screen that contains an aperture through which the baseball is projected. This aperture is rapidly moved across point of projection as the baseball is released, thus creating an instantaneous shutter within the projection screen. Motion of the projection screen component along the I-axis thus does not impart energy to the thrown baseball. The H-axis corresponds to the longitudinal axis of the electric cylinder along which the baseball is fed into the counter-rotating flywheels. A portion of the energy of the linear motion of the baseball along the H-axis is imparted to the projected baseball. The flywheel housing rotates about the G-axis, thus rotating the plane that bisects the centers of the two flywheels. In one embodiment of the BPM, rotation of the flywheel housing about the G-axis occurs only prior to the release of the baseball, and thus imparts no energy to the thrown baseball. In an alternate embodiment of the BPM, the flywheel housing may be rotated with respect to the G-axis as the baseball is fed into the counter-rotating flywheels, imparting a rotational spin to the baseball perpendicular to the G-axis and thus imparting energy to the projected baseball. This rotational component may be used to simulate the flicking of a baseball pitcher's wrist when throwing certain types of baseball pitches. The E and F axes correspond to the rotational axes of the upper and lower flywheels, respectively. Momentum of the flywheels imparted to the baseball is the main source of energy for projecting the baseball from the BPM. The velocity at which the baseball leaves the BPM is directly controlled by the rotational speed of the two flywheels. Thus, motion of the flywheels about the E and F axes imparts energy to the thrown baseball. In addition, a clockwise or counterclockwise spin in the plane that passes through the centers of the two flywheels and bisects the two flywheels can be imparted to the baseball by rotating the two flywheels at different speeds. Table 1 thus summarizes the motions of major components of the BPM with respect to the multiple BPM axes as well as their energy contributions to the projection of the baseball from the BPM.

Motion with respect to each axis of the BPM is provided by an electrical servo motor, and, in the case of the I-axis, by two electrical servo motors. In one embodiment of the BPM, Parker-Hannifin Corp. electrical servo motors are employed. For the E and F axes, SM-233BR-N motors are used. For the W-axis, SM-231BBE-NTQN motors are used. For the Y, J, I, and G-axes, SM-NO923KR-NMSB motors are used. Alternate sources for the electrical servo motors are: Ormec Systems Corp. of Rochester, N.Y.; Hitachi America, Ltd. of Tarrytown, N.Y.; and Baldor Electric Corp. of Fort Smith, Ark.

Figure 9:
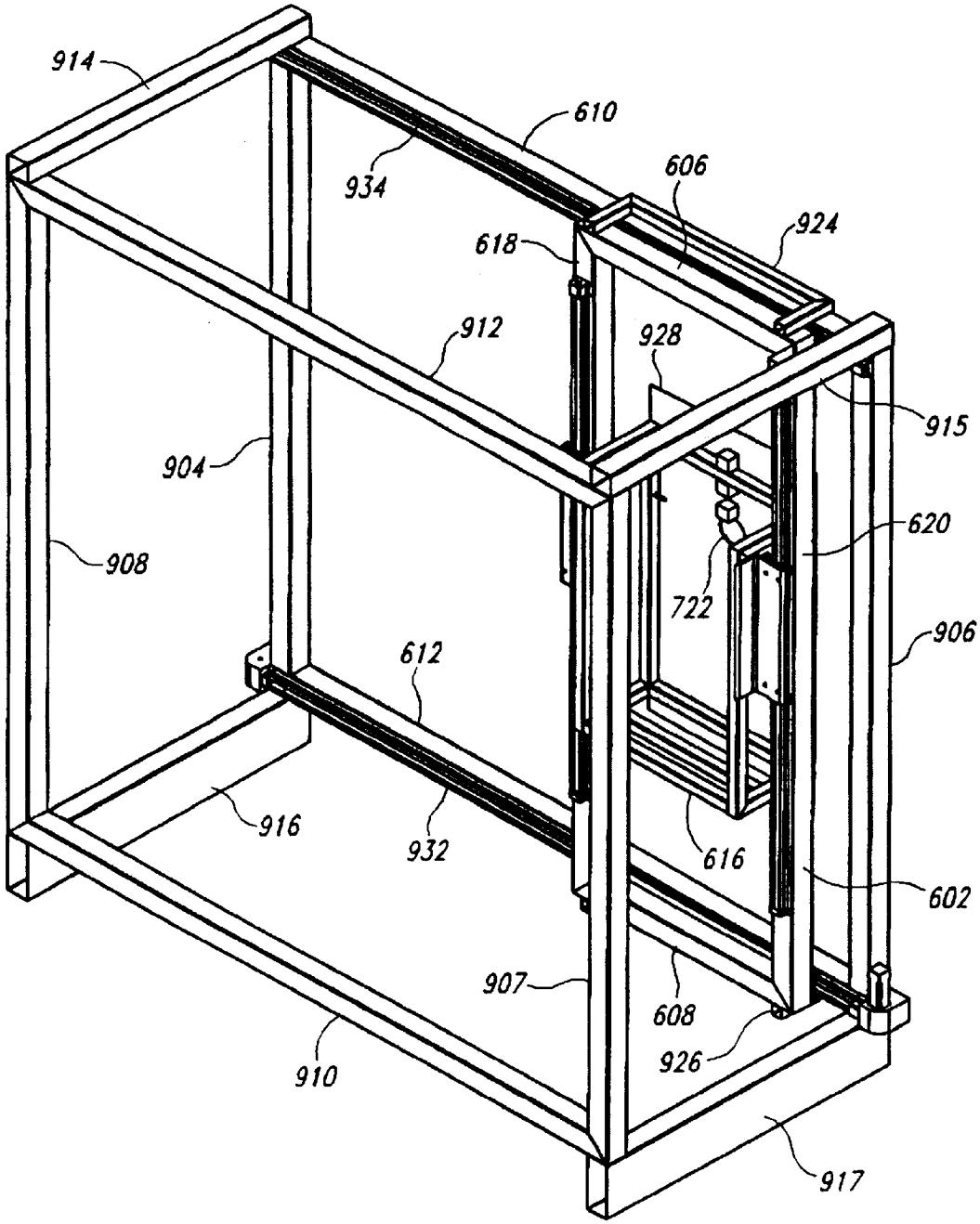
FIGS. 9 and 10 illustrate the main frame, X-axis frame, and Z-axis carriage of the BPM.
Figure 10:
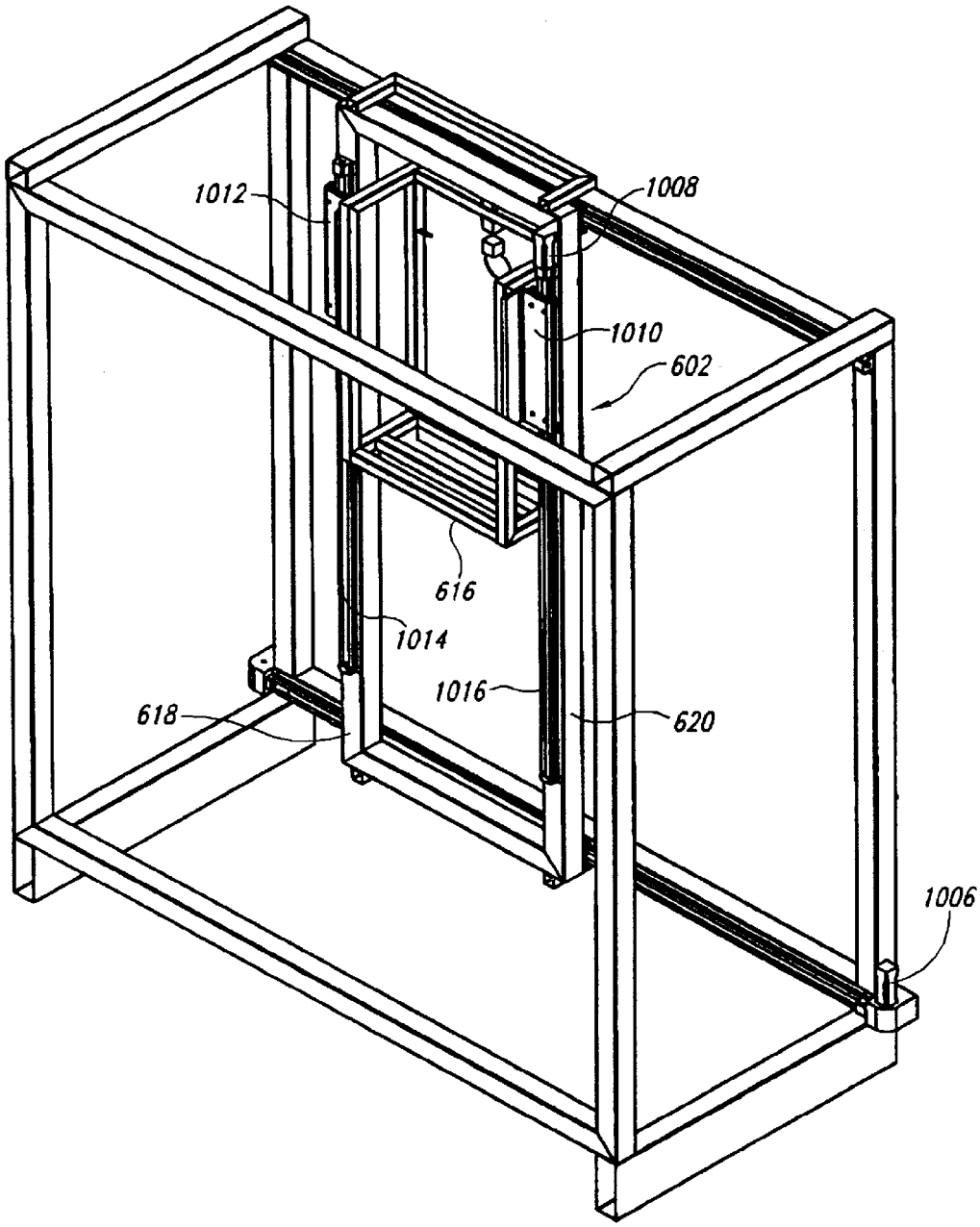

FIGS. 9 and 10 illustrate the main frame, X-axis frame, and Z-axis carriage of the BPM. In FIG. 9, the X-axis frame 902 is positioned towards the left-hand side of the plane of the projection screen (left and right-handedness is with respect to a vantage point in front of the BPM, as illustrated in FIGS. 5 and 7), and, in FIG. 10, the X-axis frame 1002 is positioned at the right-hand side of the projection screen. Similarly, in FIG. 9, the Z-axis carriage 904 is positioned towards the center of the X-axis frame 902, while in FIG. 10, the z-axis carriage 1004 is positioned towards the top of the X-axis frame 1002. Thus, FIGS. 9 and 10 show horizontal movement of the X-axis frame across the plane of the projection screen, and also show vertical movement of the Z-axis carriage along the X-axis frame. The main frame comprises four vertical members 906–909, four long horizontal members 910–913, two short upper horizontal members 914–915, and two short base members 916 and 917. The vertical, long horizontal, and upper short horizontal members 906–915 are machined lengths of four-inch square tubular steel welded together as indicated in FIGS. 9 and 10. In a preferred embodiment, X-axis motion and Z-axis motion are controlled by belt-driven and lead screw-driven linear motion systems mounted to the inner sides of the horizontal member 911 and vertical member 918 of the main frame and X-axis frame, respectively. Dual Vee Lo Pro Linear Motion Systems from Bishop-Wisecarver Corp. of Pittsburg, Calif. are employed in both cases. The X-axis belt driven linear motion system, Lo Pro part number 3SCSBG3DH100S, is powered by a vertically mounted electrical servo motor 1006 and the Z-axis lead-screw-driven linear motion system, Lo Pro part number #SCSLSD, is also powered by a vertically mounted electrical servo motor 1008. Linear motion systems from Thomson Saginaw Corp. of Port Washington, N.Y. can also be used to drive the X and Z-axes. The X-axis frame 902 comprises two vertical members 918–919 and two horizontal members 920 and 922 welded together as indicated in FIG. 9 to form a rectangular frame. The vertical and horizontal members 918–922 are machined lengths of four-inch square steel tubing. The X-axis frame also includes an upper semi-rectangular support 924 and a lower semi-rectangular support 926. Both semi-rectangular supports comprise three machined sections of two inch square steel tubing welded together as indicated in FIG. 9. The upper semi-rectangular support 924 is welded to the top surface of the X-axis horizontal member 922, and the lower semi-rectangular support 926 is welded to the bottom surface of the lower X-axis horizontal member 920. A faceplate 928 is attached to the projection screen side of the Z-axis carriage 904. The faceplate contains an aperture 930 through which a baseball is projected. The X-axis frame is mounted to the main frame horizontal members 911 and 913 by pairs of rollers (not shown) fixed to the projection screen side of the horizontal members of the X-axis frame 920 and 922 that grip and roll along linear roller tracks 932 and 934 affixed to the inner surfaces of the main-frame horizontal members 911 and 913. Similarly, the Z-axis carriage 904 is mounted to the X-axis frame by pairs of rollers attached to the projection screen side of two angle bracket members 1010 and 1012 affixed to vertical members on either side of the Z-axis carriage 1004 which grip and roll along vertically-mounted roller tracks 1014 and 1016 affixed to the inner surface of X-axis frame vertical members 1018 and 1020, respectively. A more detailed description of the roller and roller tracks follows.

In order to prevent overloading of the Z-axis lead-screw-driven linear motion system, a counter-balance mechanism may be added to the X-axis frame to offset the overhanging mass of the Z-axis carriage. The counter-balance mechanism may include a passive linear roller track on the interior side of the rear, top, horizontal member of the main frame along which an extension of the X-axis frame tracks. The X-axis frame extension is mounted orthogonally to the interior side of the top horizontal member of the X-axis frame. A counter weight hanging down from the X-axis frame extension adjacent to the rear, top, horizontal member of the main frame is attached, via a wire and pulley mounted on the X-axis frame extension, to the Z-axis carriage.

Figure 11A:
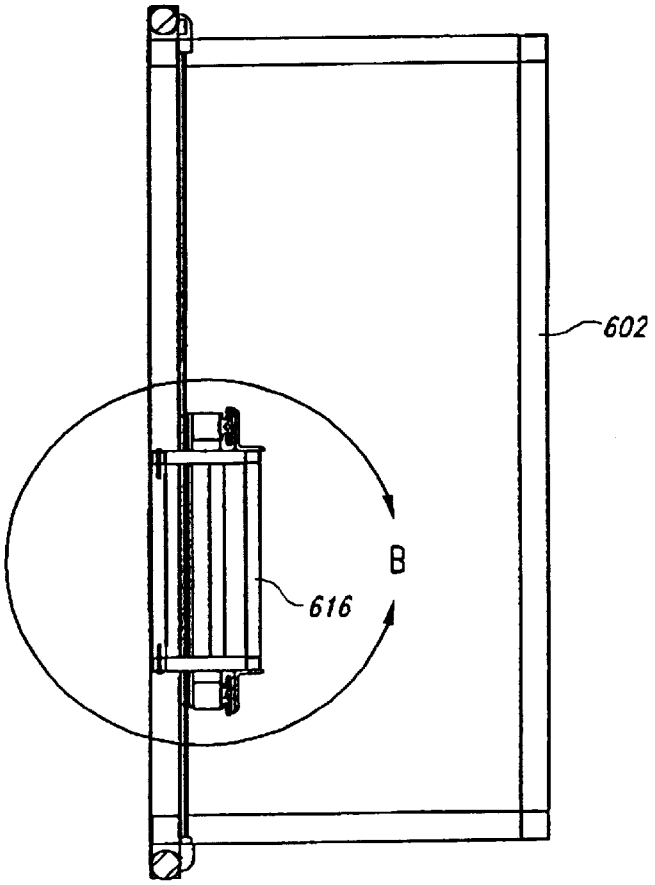
FIGS. 11A–C illustrate the roller and roller track mechanism of the Z-axis carriage.
Figure 11B:
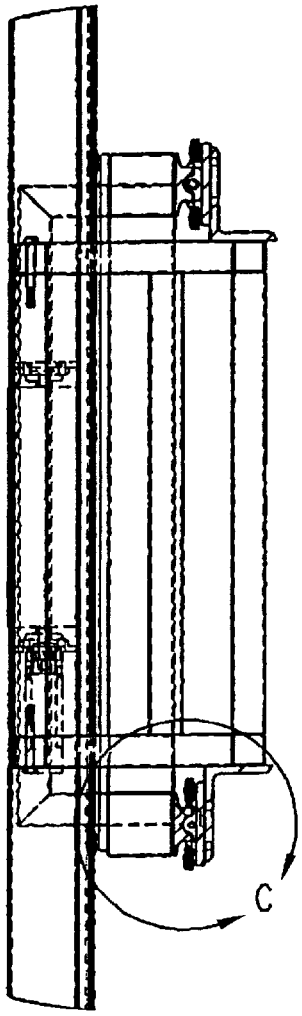
Figure 11C:
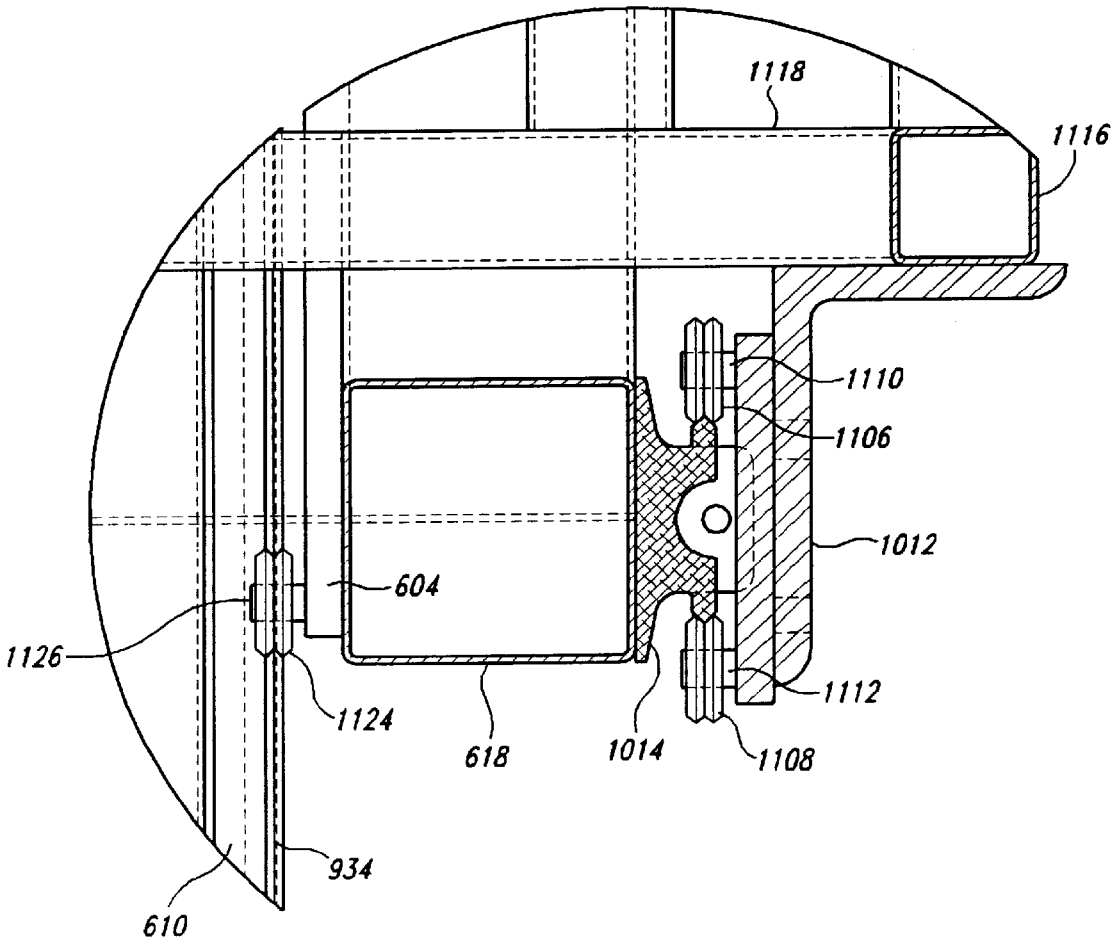

FIGS. 11A–C illustrate the roller and roller track mechanism of the Z-axis carriage. FIG. 11A shows a section view of the main frame 1102 and Z-axis carriage 1104 looking down, in a vertical direction, from the top of the BPM. FIG. 11B shows, in more detail, the circled portion of FIG. 11A, and FIG. 11C shows, in greater detail, the circled portion of FIG. 11B. In FIG. 11C, two Z-axis rollers 1106 and 1108, are mounted on shafts 1110 and 1112, respectively, that are affixed to an angle member 1114 of the Z-axis carriage. The angle member 1114 is affixed to vertical member 1116 and horizontal member 1118 of the Z-axis carriage. The rollers ride along a linear track 1120 affixed to a vertical member 1122 of the X-axis frame. An X-axis frame roller 1124 is attached via a shaft 1126 to the X-axis frame 1128 and tracks along the upper edge of a roller track 1130 affixed to the inside edge of an upper mainframe horizontal member 1132.

Figure 12:
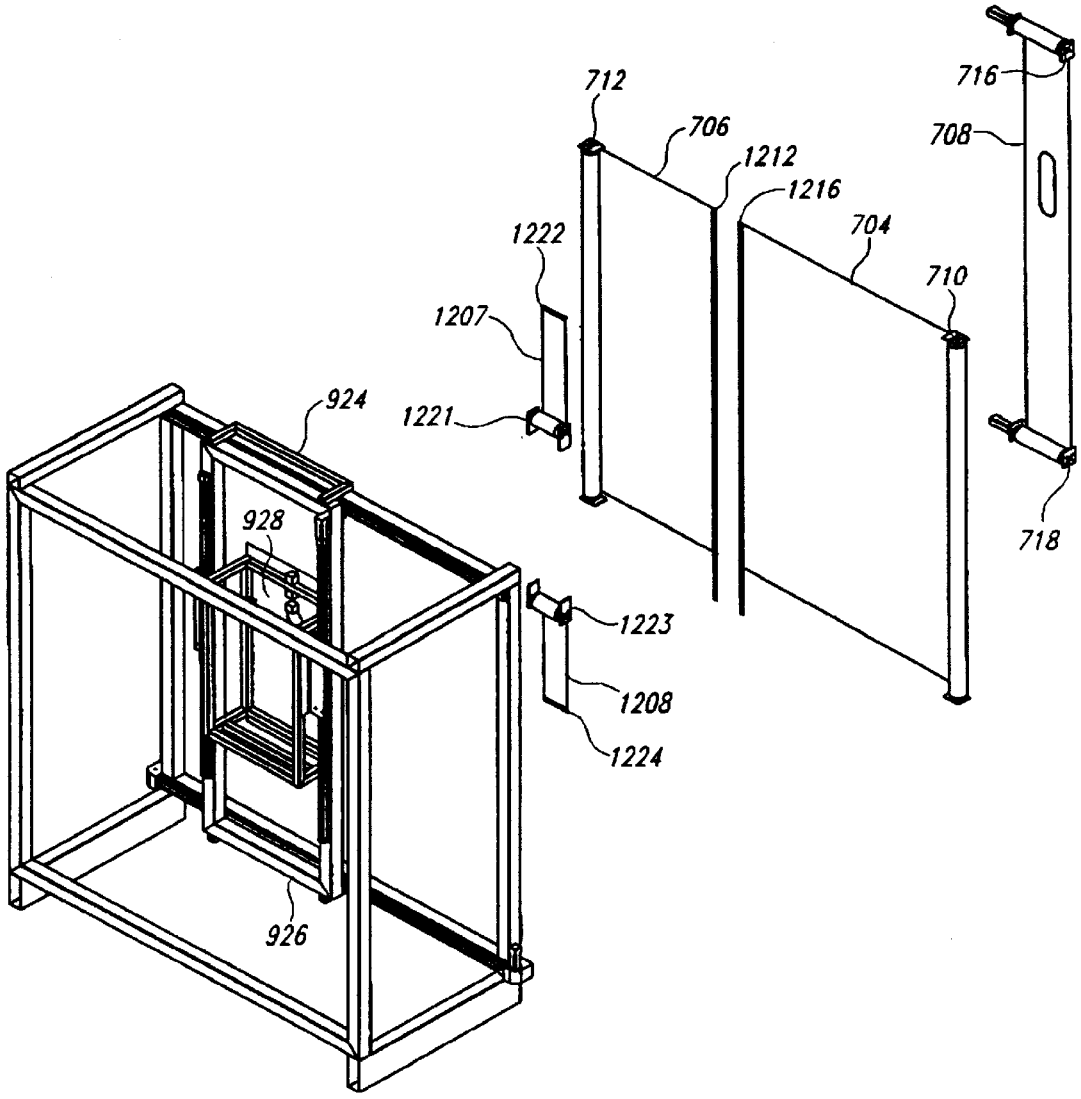
FIG. 12 is an exploded view of the vertical projection screen.

FIG. 12 is an exploded view of the vertical projection screen of the BPM. The vertical projection screen comprises the Z-axis carriage faceplate 1202, the right-hand flexible reflective screen 1204, the left-hand flexible reflective screen 1205, the I-axis vertical flexible screen 1206, the top flexible reflective sheet 1207, and the bottom flexible reflective sheet 1208. The faceplate 1202 is mounted directly to the front face of the Z-axis carriage. The right-hand flexible reflective screen 1204 extends and retracts from a vertical take-up/supply reel 1210 and is affixed to a solid steel rod 1212. Similarly, the left-hand flexible reflective screen 1205 is extended from a vertical take-up/supply reel 1214 and is attached to a vertical steel rod 1216. The top end of the right-hand vertical steel rod 1212 is welded to the projection screen side of the upper semi-rectangular support member 1218 of the X-axis frame and the lower end of the vertical steel rod 1212 is welded to the projection screen side of the lower semi-rectangular support member 1220 of the X-axis frame. Similarly, the top and bottom ends of the left-hand vertical steel rod 1216 are welded to the projection screen sides of the upper semi-rectangular support member 1218 and the lower semi-rectangular support member 1220, respectively. The top flexible reflective screen 1207 extends and retracts from a horizontal take-up/supply reel 1221 and is affixed to a solid steel rod 1222. Similarly, the bottom flexible reflective screen 1208 is extended from a horizontal take-up/supply reel 1223 and is attached to a vertical steel rod 1224. The vertical steel rod 1222 is welded to the projection screen side of the upper semi-rectangular support member 1218 of the X-axis frame and the vertical steel rod 1224 is welded to the projection screen side of the lower semi-rectangular support member 1220 of the X-axis frame. The horizontal take-up/supply reels 1221 and 1223 are mounted to the top and bottom of the Z-axis carriage, respectively. The I-axis flexible screen extends between two servo motor-driven take-up/supply reels 1226 and 1228. The upper servo motor-driven take-up/supply reel 1226 is mounted on the upper X-axis frame semi-rectangular support member 1218 and the lower servo motor driven take-up/supply reel 1228 is mounted to the lower X-axis semi-rectangular support member 1220.

Figure 13:
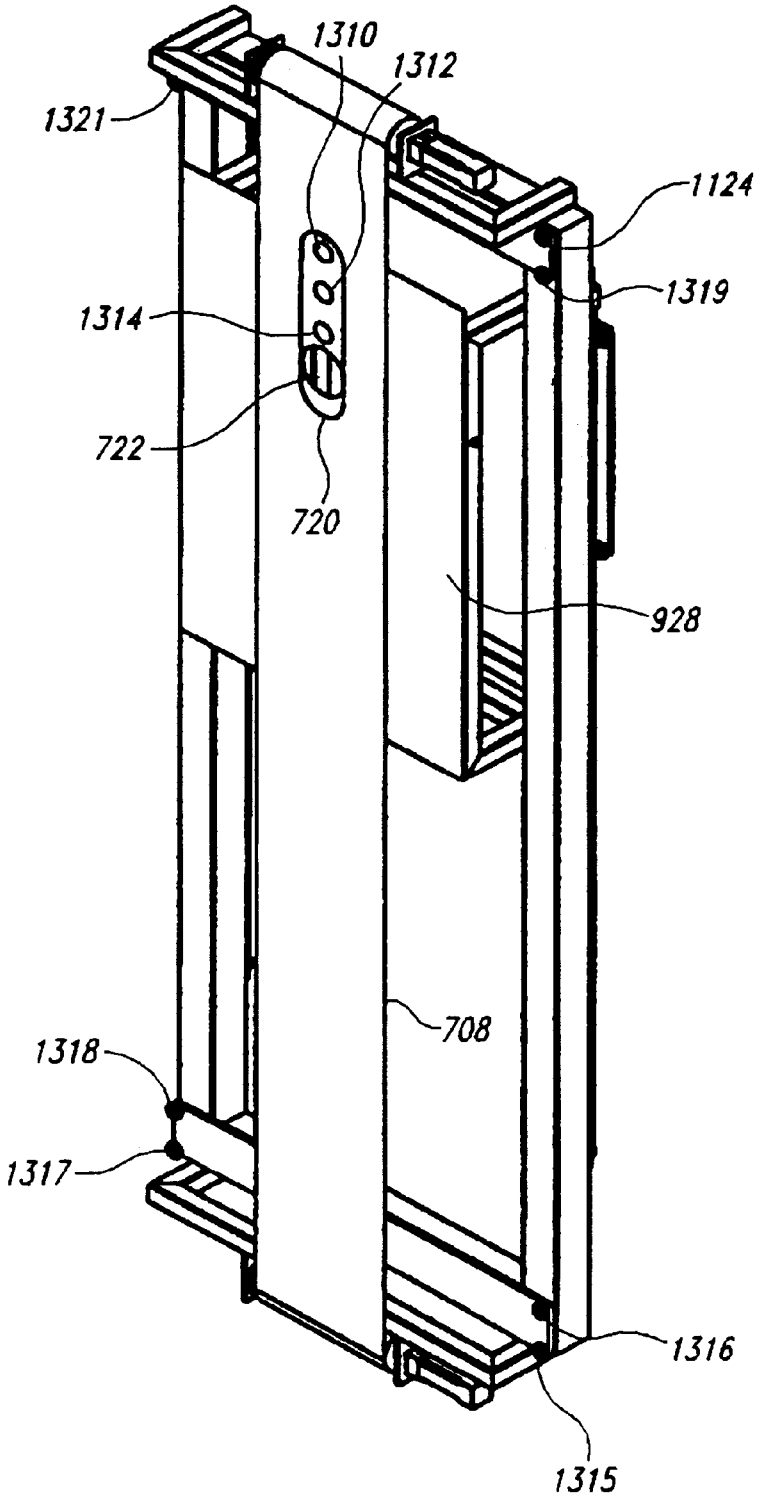
FIG. 13 is a front view of the I-axis projection screen mounted to the X-axis frame.

FIG. 13 is a front view of the I-axis projection screen mounted to the X-axis frame. The rounded slot 1302 of the I-axis projection screen 1304 is quickly moved over the aperture 1306 in the Z-axis carriage faceplate 1308 in order to provide an instantaneous shutter, or opening, in the projection screen. In certain embodiments of the BPM, red, yellow, and green lights 1310, 1312, and 1314 respectively, may be positioned above or below the aperture 1306 in order to warn a baseball batter of the impending release of the baseball by the BPM. Seven of the eight rollers 1315–1321 by which the X-axis frame is mounted to the horizontal roller tracks of the main frame are shown in FIG. 13.

Figure 14B:
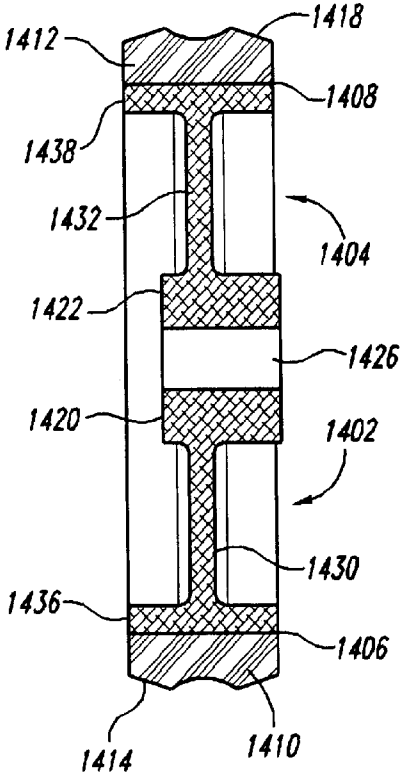
FIGS. 14A–B show a sectional view and an edge-on cross section of a flywheel.
Figure 14A:
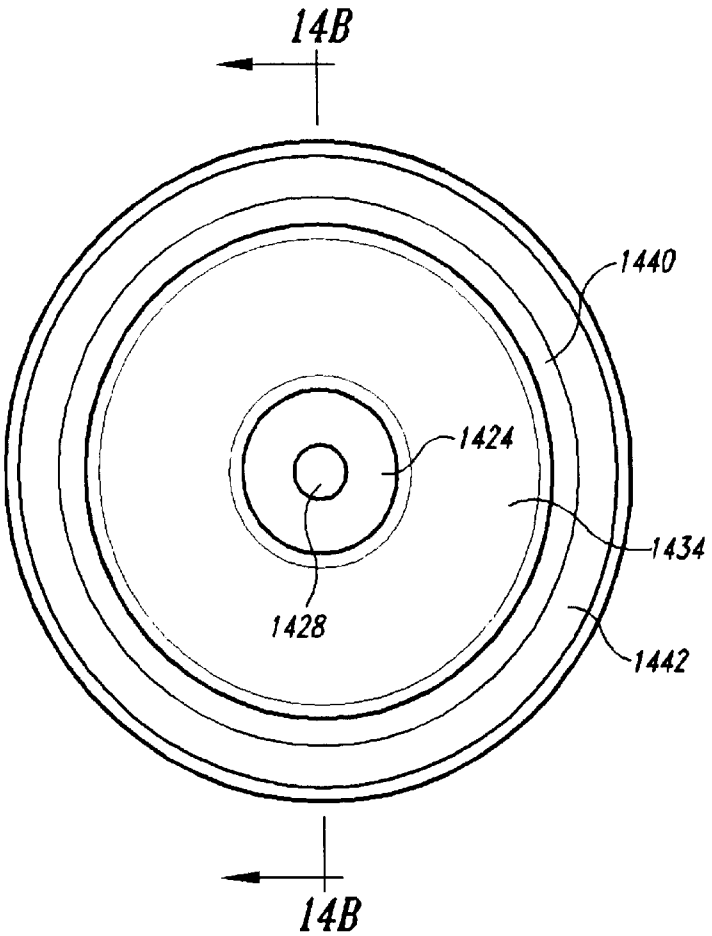

FIGS. 14A–B show a sectional view and an edge-on cross section of a flywheel used to transfer energy to the baseball in the BPM. The flywheel is cast from 356-T6 aluminum alloy for reliable and safe operation up to rotational speeds of 6,000 rpm. The flywheel is manufactured by Industrial Caster & Wheel Company, Inc. of San Leandro, Calif. and is commercially available from Industrial Caster as Part No. 12X3. An alternate source is Caster Technology Corp. of Kent, Wash., for part number 022-743. The dimensions of the flywheel are shown in FIG. 14B. The aluminum casting portion of the flywheel 1402 and 1404 has a radius of 5 inches from center. The outer, cylindrical surface of aluminum casting 1406 and 1408 is bonded to a continuous circumferential belt of polyurethane 1410 and 1412 having a compressibility expressed as a Durometer measurement of 40 A to 45 A. The outer surface of the continuous circumferential polyurethane belt 1414 and 1418 slopes upward from both sides towards the center, with a continuous, semicircular groove formed into the central, outer circumference of the continuous circumferential polyurethane belt. The aluminum casting portion of the flywheel comprises a raised central hub 1420 and 1422 (1424 in plane view of FIG. 14A) surrounding a central opening 1426 (1428 in the plane of FIG. 14A) through which the flywheel is mounted to a drive shaft. A thinner, interior disk 1430 and 1432 (1434 in plane view of FIG. 14A) extends from the central hub 1420 and 1422 to the outer cylindrical rim 1436 an 1438 (1440 in plane view of FIG. 14A) of the aluminum casting portion of the flywheel. The continuous circumferential polyurethane belt 1410 and 1412 (1442 in plane view of FIG. 14A) is bonded to the outer cylindrical surface of the aluminum casting portion of the flywheel.

Figure 15:
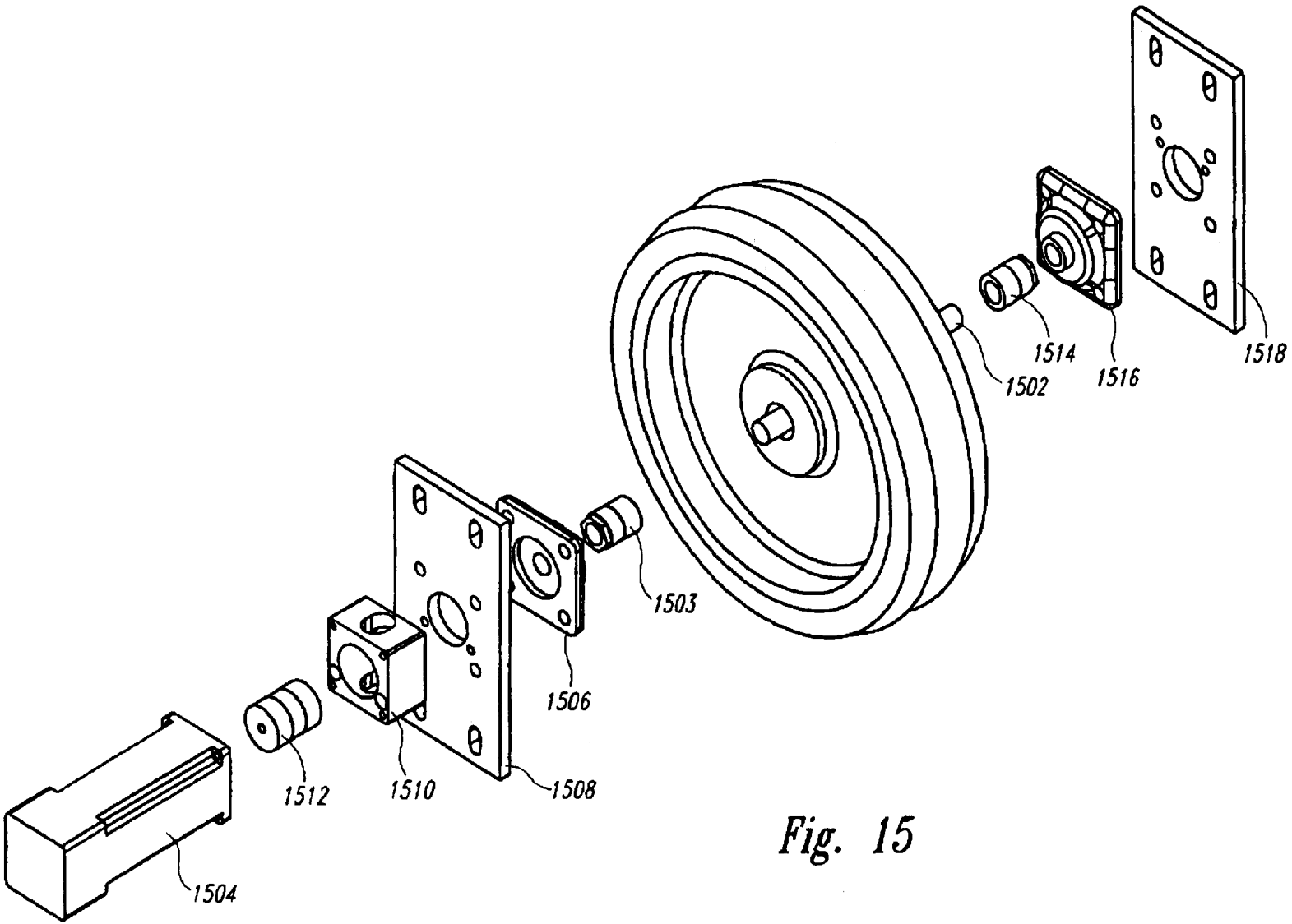
FIG. 15 is an exploded view of the flywheel drive assembly.

FIG. 15 is an exploded view of the flywheel drive assembly. The flywheel is mounted on an axle 1502. Rotation of the flywheel is driven by an electrical servo motor 1504. On the servo motor side of the flywheel, the axle 1502 passes through a keyless tapered collet coupling 1503, a flange bearing 1506, a mounting plate 1508, and a motor mount 1510 to a flexible bellows coupling 1512 that couples the axle to the power shaft of the electrical servo motor. On the side of the flywheel opposite from the servo motor, the axle passes through a keyless tapered collet coupling 1514 and a flange bearing 1516 that is, in turn, mounted to a mounting plate 1518. Note that the walls of flywheel housing (850 in FIG. 8) pass between the flange bearings 1506 and 1516 and mounting plates 1508 and 1518 in the flywheel housing assembly. The two keyless tapered collet couplings 1503 and 1514 are supplied by the Manheim Division of Fenner Drives Corp. of Manheim, Pa. as Trantorque part number 6202115. The flexible bellows coupling 1512 is available from Rimtec Corp. of Westmont, Ill. as Gerwah Zero Backlash Coupling part number DKN45/41.

Figure 16:
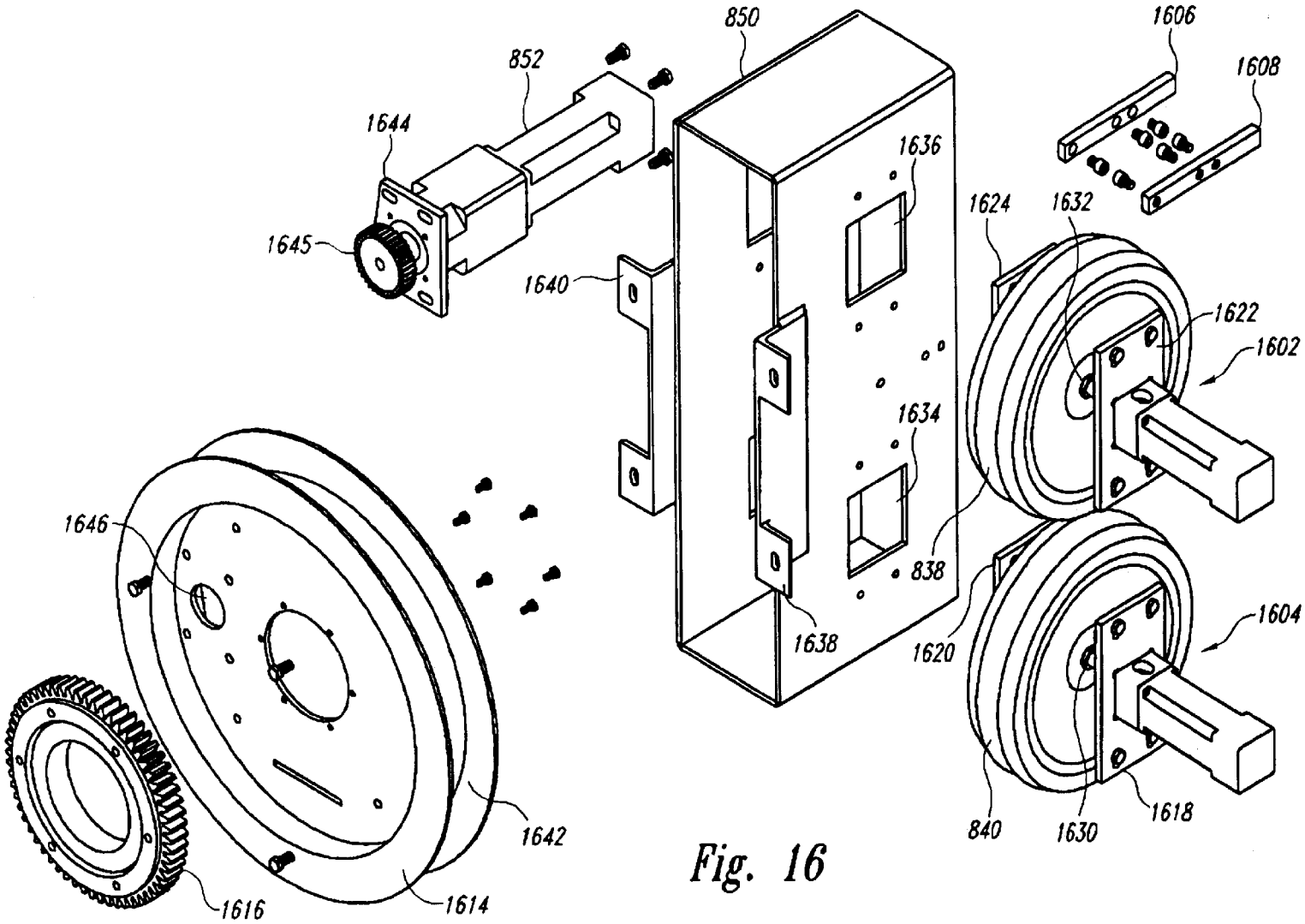
FIG. 16 shows an exploded view of the flywheel housing assembly.

FIG. 16 shows an exploded view of a flywheel housing assembly. The flywheel housing assembly comprises an E-axis flywheel assembly 1602, an F-axis flywheel assembly 1604, two linear guides 1606 and 1608, a flywheel housing 1610, a G-axis electrical servo motor 1612, a cable tray 1614, and a double-ringed geared turntable bearing 1616. The E-axis assembly 1602 and the F-axis assembly 1604 are mounted within the flywheel housing 1610 via mounting plates 1618, 1620, 1622, and 1624. The flywheels 1626 and 1628 reside within the flywheel housing enclosure 1610 and the mounting plates 1618, 1620, 1622, and 1624 are bolted to the external surface of the flywheel housing, and are adjustable in the vertical direction to compensate for wear. This adjustment is accomplished by the use of slotted holes in the mounting plates 1618, 1620, 1622, and 1624 that match drilled and tapped holes in the flywheel housing 1610, the length of the slots defining the range of motion available for adjustment. The flywheel axles 1630 and 1632 pass through the servo motor side mounting plates 1618 and 1622 and through square apertures 1634 and 1636 in the flywheel housing. The lateral guides 1606 and 1608 are horizontally affixed to the inner surface of the flywheel housing between the two flywheels to serve as guides for the baseball gripper component (826 in FIG. 8). The cable tray 1614 is bolted onto two vertical mounting brackets 1638 and 1640 welded to the flywheel housing 1610. Power and communication cables are wrapped within the well 1642 of the cable tray 1614 to facilitate extension and retraction of the power and communications cables during rotation of the flywheel housing about the G-axis. The inner ring of the double-ringed geared turntable bearing 1616 is bolted to the outer surface of the cable tray 1614, and the outer geared ring of the double-ringed geared turntable bearing 1616 is enmeshed with a gear 1644 directly attached to the power shaft of the electrical servo motor 1612. The fixed gear 1616 thus serves to transduce rotational motion of the electrical servo motor power shaft into rotation of the flywheel housing assembly about the G-axis. The outer-geared ring of the double-ringed geared turntable bearing 1616 is also bolted to the W-axis carriage (812 in FIG. 8). The electrical servo motor 1612 is bolted via a mounting bracket 1644 to the inner surface of the cable tray 1614, with the power shaft of the electrical servo motor 1612 extending through an aperture 1646 in the cable tray 1614.

Figure 17:
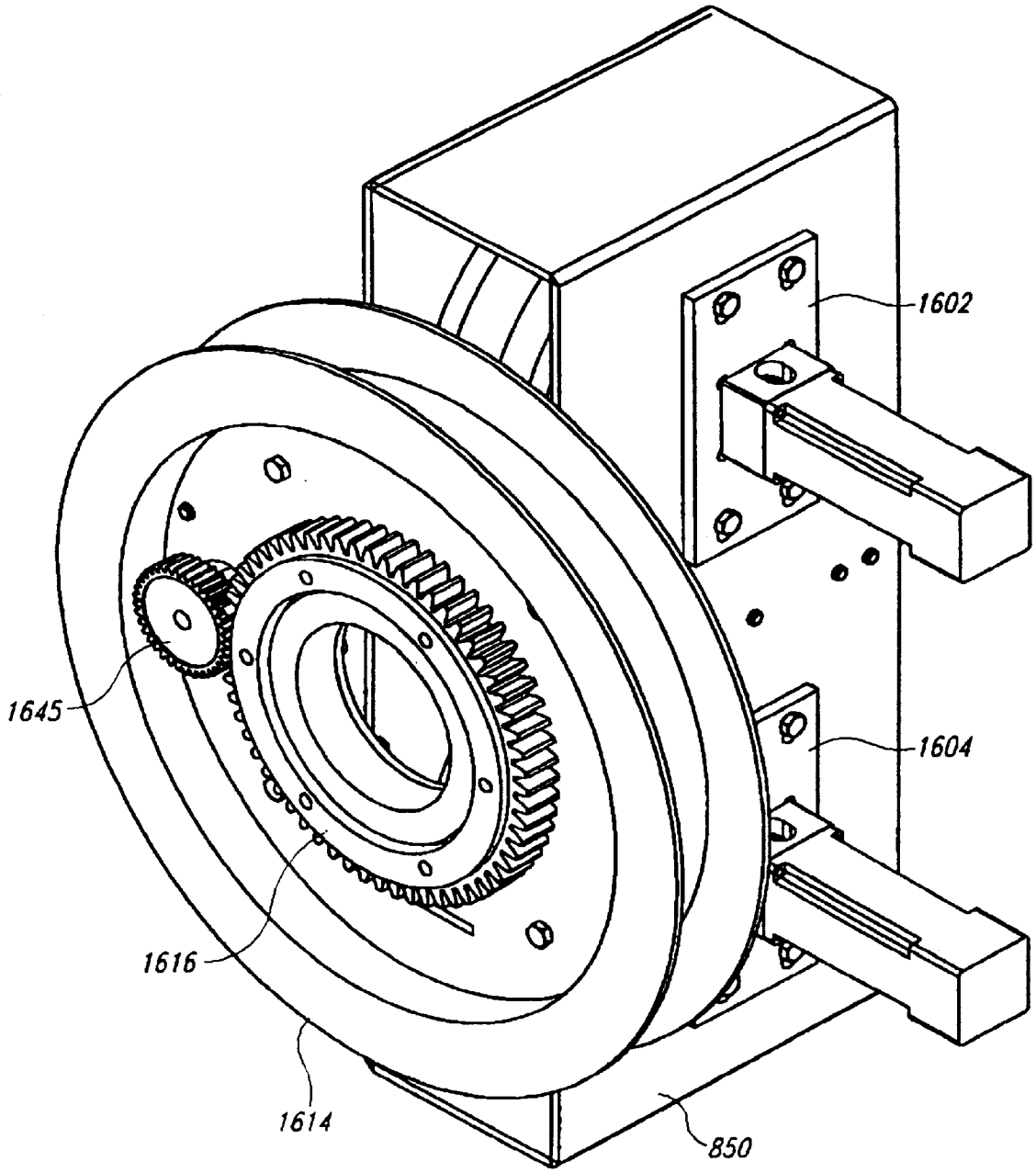
FIG. 17 shows the fully assembled flywheel housing assembly.

FIG. 17 shows the fully assembled flywheel housing assembly. The small gear 1702 affixed to the power shaft of the electrical servo motor that powers rotation about the G-axis (not shown) is enmeshed with the outer geared ring of the double-ringed geared turntable bearing 1704 bolted to the cable tray 1706. The cable tray 1706 is bolted to the flywheel housing 1708 within which the flywheel assemblies 1710 and 1712 are mounted. The turntable bearing is supplied by Kaydon Bearing Corp. of Muskegon, Mich. as part number MTE-145.

Figure 18:
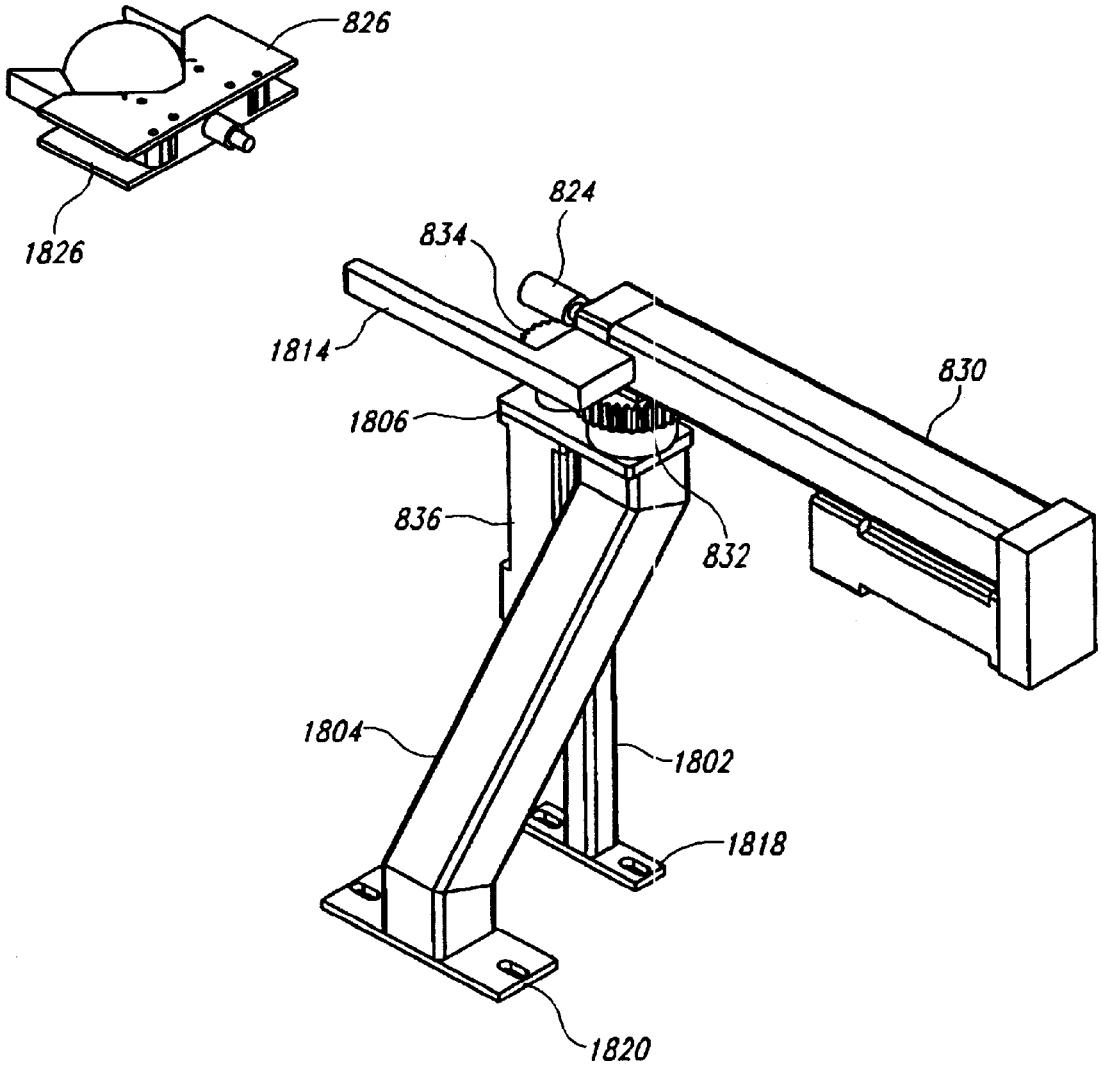
FIG. 18 illustrates the H and J-axes assembly.
Figure 19:
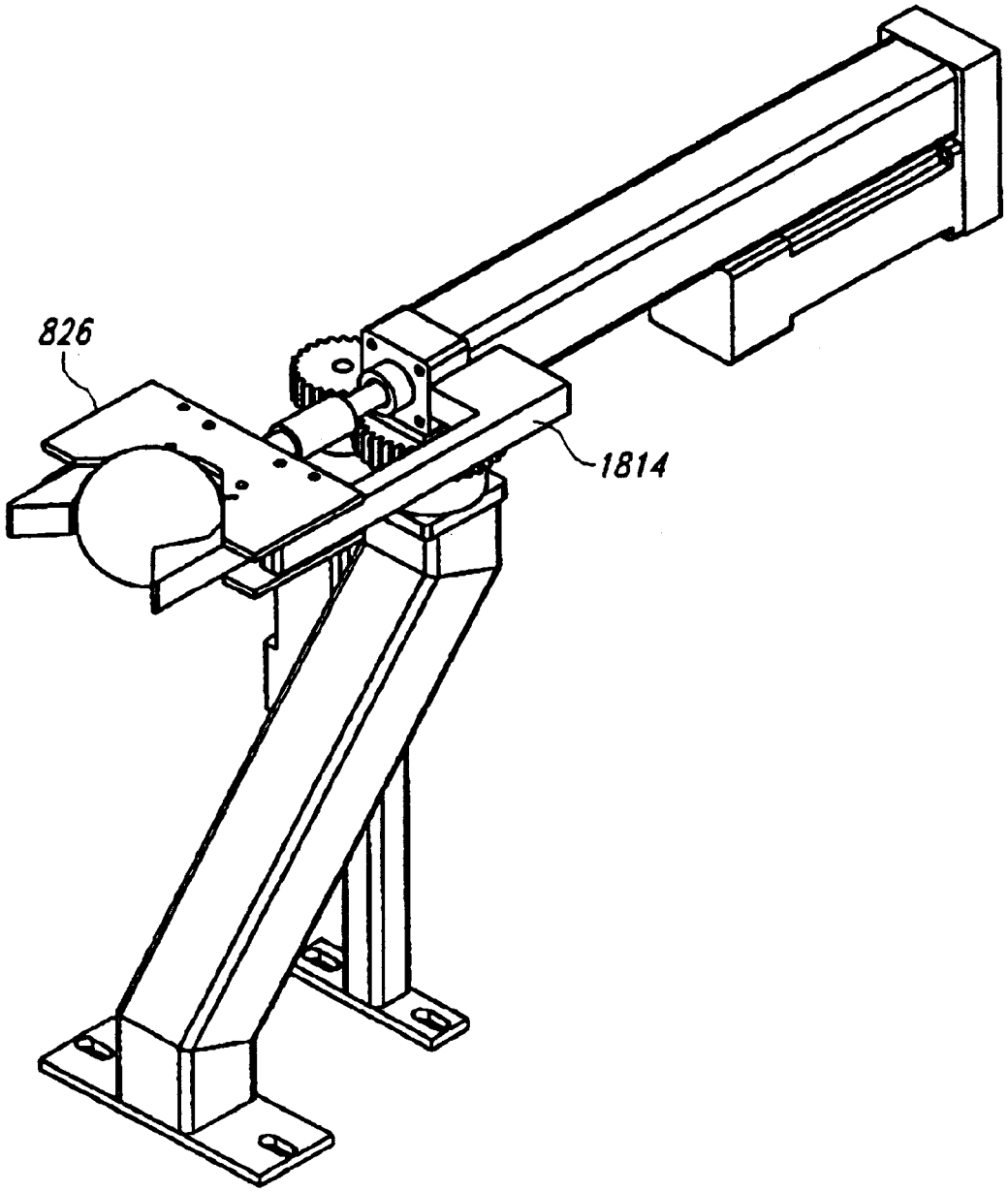
FIG. 19 shows the fully assembled H and J-axes assembly in a retracted position.
Figure 20:
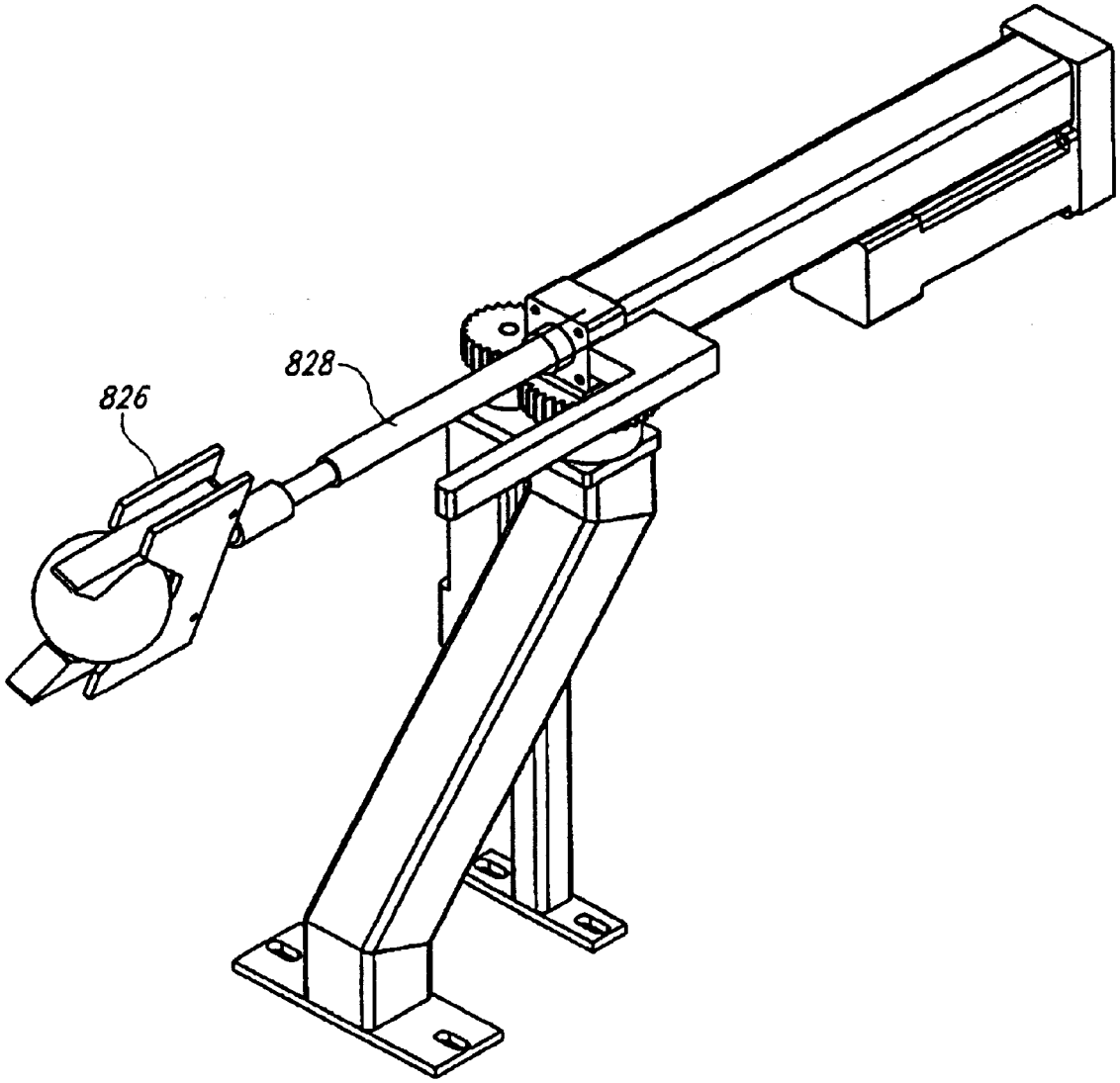
FIG. 20 shows the fully assembled H and J-axes assembly with extension of the extensible arm of the electrical cylinder.

FIGS. 18, 19, and 20 illustrate the H and J-axes assembly. The H and J-axes assembly comprises a vertical support 1802, an angled support 1804, a J-axis base plate 1806, a J-axis electrical servo motor 1808 and J-axis rotational power transduction gear 1810, an H-axis electrical cylinder 1812, a stationary guide 1814, and a baseball gripper assembly 1816. The vertical support member 1802 is a machined length of one-inch square steel tubing welded to a horizontal bracket 1818 and to the angled support 1804. The angled support member 1804 comprises three machined lengths of two-inch square steel tubing welded together, as indicated in FIG. 18, and welded to a bracket plate 1820 and to the J-axis base plate 1806. The J-axis electrical servo motor 1808 is bolted to the bottom side of the J-axis base plate 1806 with the power shaft of the electrical servo motor 1808 extending through an aperture in the J-axis base plate 1806 (not shown) to attach to a power shaft gear 1822. The power shaft gear 1822 enmeshes with the J-axis rotational power transduction gear 1810 mounted on a shaft extending upward from the J-axis base plate 1806 and bolted to the H-axis electric cylinder 1812. The gripper assembly 1816 is affixed to the extensible arm of the electric cylinder 1812 via a quick disconnect coupler 1824. The baseball gripper assembly 1816 rides along the stationary guide 1814 as the baseball gripper assembly 1816 is translated horizontally by the extensible electric cylinder arm. The stationary guide 1814 fits into a slot 1826 on the right-hand side of the baseball gripper assembly 1816.

FIG. 19 shows the fully assembled H and J-axes assembly in a retracted position. FIG. 20 shows the fully assembled H and J-axes assembly with full extension of the extensible arm of the electrical cylinder. As discussed above, the baseball gripper assembly 1902 rides along the stationary guide 1904 when the extensible arm of the electric cylinder is retracted. In FIG. 20, when the extensible arm of the electric cylinder 2002 is extended, the baseball gripper assembly 2004 is free to rotate about the H-axis in order to follow rotation of the flywheel housing assembly (850 in FIG. 8) about the G-axis. When extended inside the flywheel housing (1610 in FIG. 16), the baseball gripper assembly 2004 tracks along two fixed guides (1606 and 1608 in FIG. 16).

Figure 21:
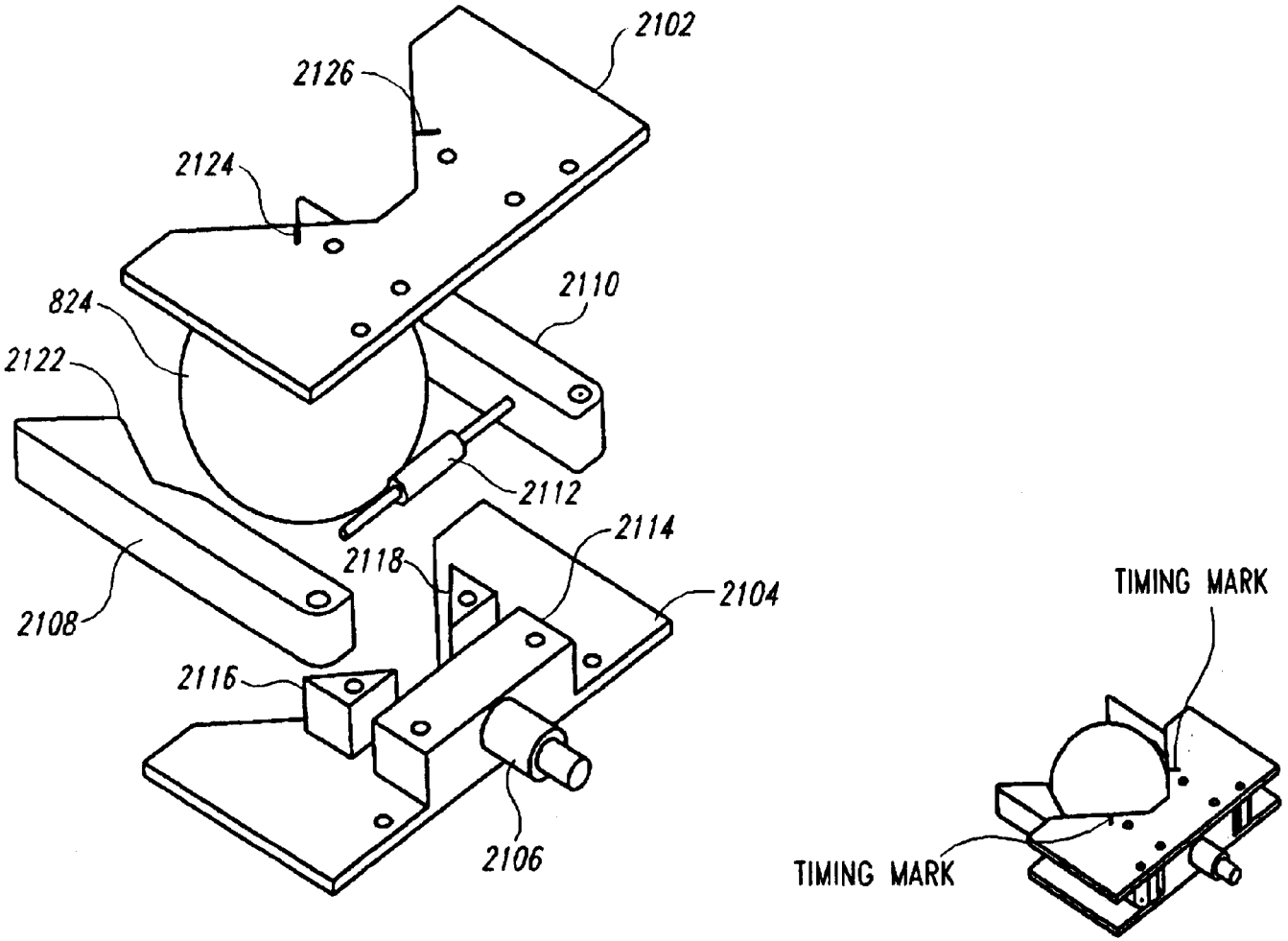
FIG. 21 shows an exploded view of the baseball gripper assembly.

FIG. 21 shows an exploded view of the baseball gripper assembly. The baseball gripper assembly comprises a top plate 2102, a bottom plate 2104, a male portion of the quick disconnect coupler 2106, right-hand and left-hand gripper fingers 2108 and 2110, respectively, a gripper spring 2112, a rectangular spacing member 2114, and two triangular spacing members 2116 and 2118, respectively. The baseball 2120 is pushed between the gripper fingers 2108 and 2110 which rotate outward in a plane parallel to the top and bottom plates 2102 and 2104, respectively, via a lever action, and then close back onto the baseball via tension in the gripper spring 2112 as the point of contact of the baseball 2120 with the gripper fingers 2108 and 2110 moves past the gripper finger apexes 2122 (second finger gripper apex obscured by the top plate 2102). Timing marks 2124 and 2126 are etched into the top plate 2102 in order to facilitate seam orientation of the baseball 2120.

Figure 22:
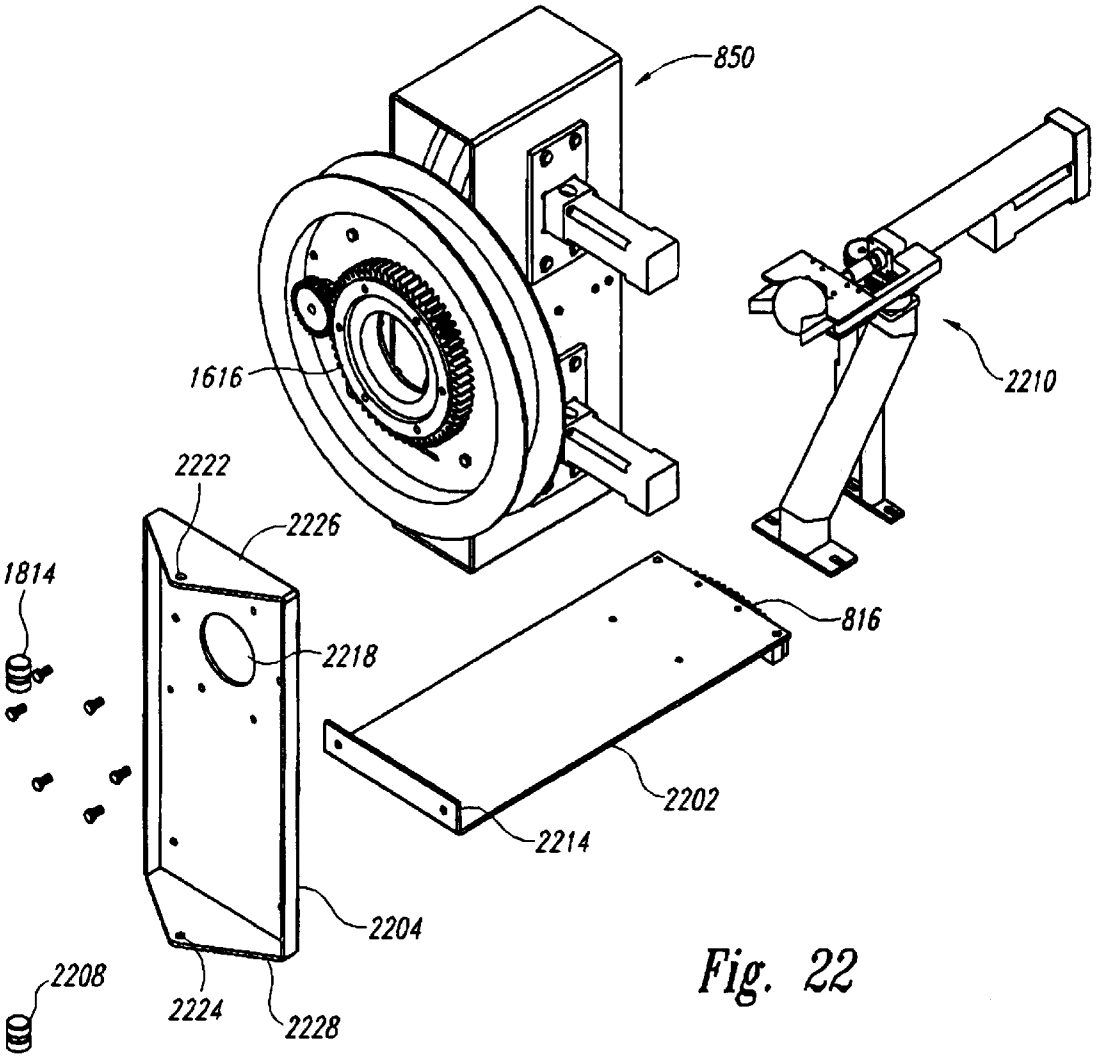
FIG. 22 shows an exploded view of the W-axis carriage as seen from a vantage point near the vertical projection screen looking toward the H and J-axes assembly.
Figure 23:
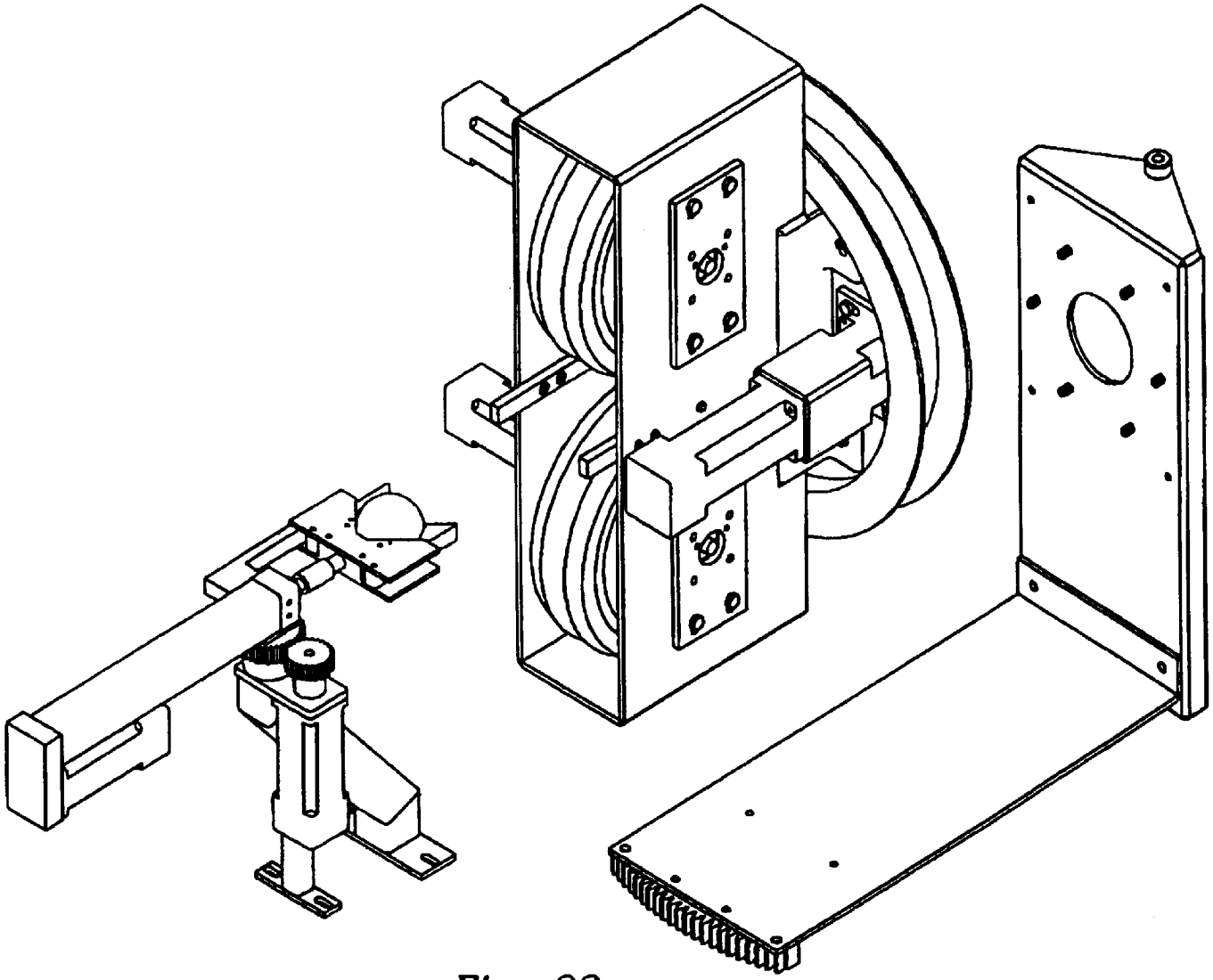
FIG. 23 shows a partially exploded illustration of the W-axis carriage seen from an observation point behind the H and J-axes assembly looking forward towards the vertical projection screen.
Figure 24:
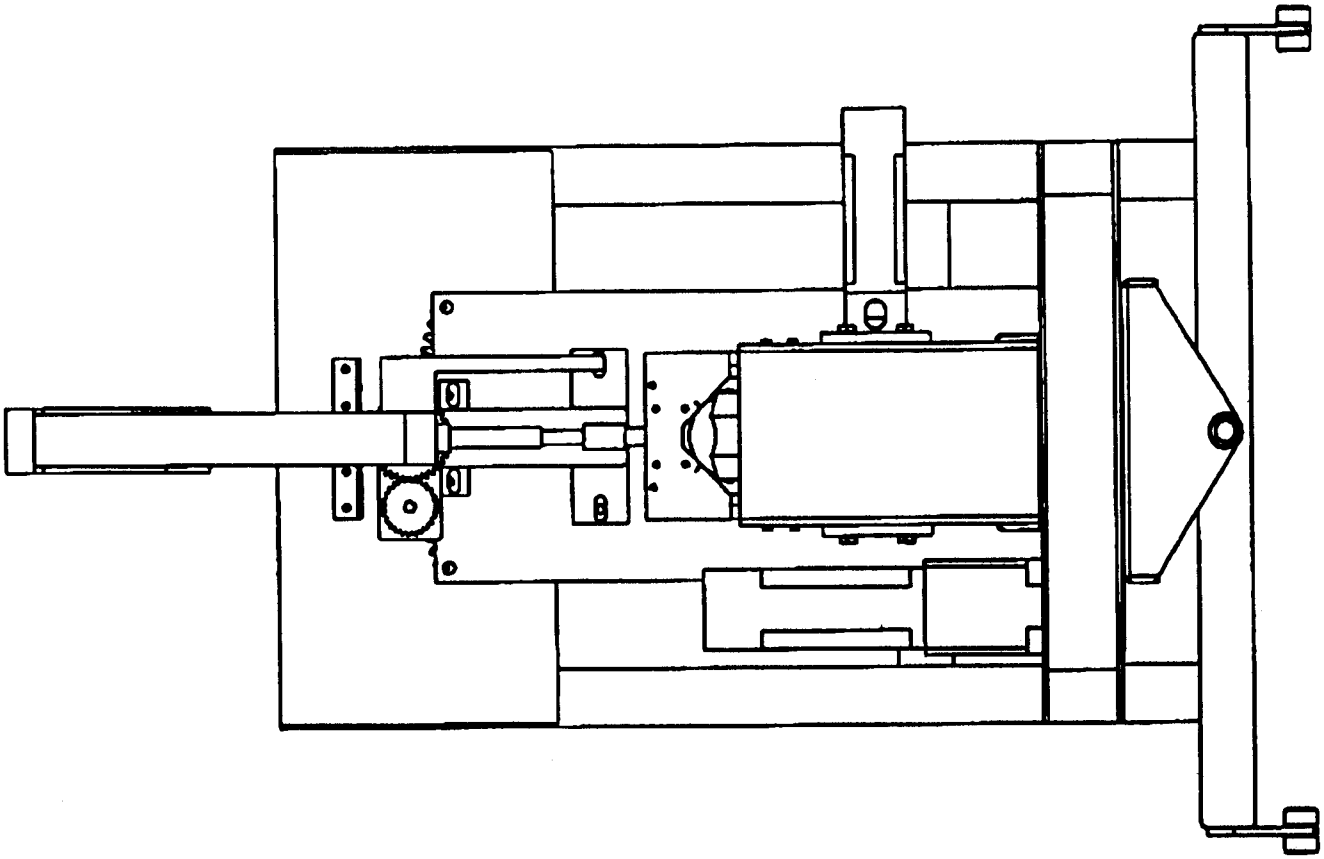
FIG. 24 is a horizontal plane view of the Y-axis carriage and the W-axis carriage looking down the W-axis.
Figure 25:
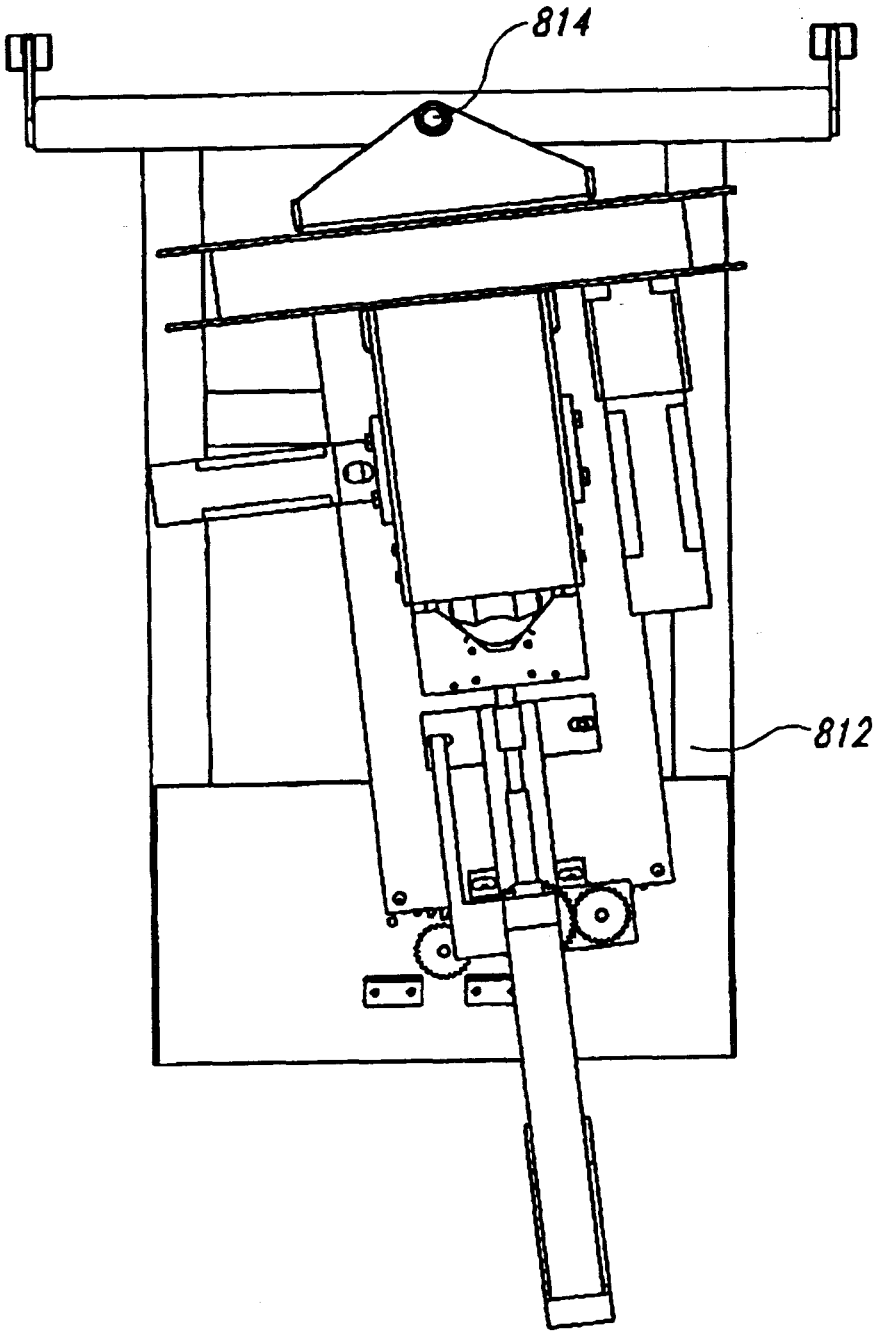
FIG. 25 is a horizontal plane view of the Y-axis carriage and the W-axis carriage looking down the W-axis with the W-axis carriage rotated with respect to the W-axis.

FIGS. 22–24 illustrate the W-axis carriage. FIG. 22 shows an exploded view of the W-axis carriage as seen from a vantage point near the vertical projection screen looking toward the H and J-axes assembly. The W-axis carriage comprises a W-axis base plate 2202, a W-axis vertical trunnion plate 2204, two W-axis rotation pins 2206 and 2208, the H and J-axes assembly 2110, and the flywheel housing assembly 2112. The W-axis base plate 2202 comprises a flat base plate with a vertical facing 2214 formed by bending a short section of the flat base plate upward at a 90° angle from the W-axis base plate 2202. A W-axis fixed sector gear 2216 is bolted to the bottom side of the W-axis base plate 2202. The vertical trunnion plate 2204 is bolted to the vertical facing 2214 of the W-axis base plate 2202. The flywheel housing 2212 is bolted to the W-axis vertical trunnion plate 2204 and to the outer geared ring of the double-ringed geared turntable bearing 2220. The baseball projected from the flywheel housing 2212 passes through an aperture 2218 in the vertical trunnion plate 2204. The W-axis carriage is affixed to the Y-axis carriage via the rotation pins 2206 and 2208 slotted through apertures 2222 and 2224 near the apex of the trunnions 2226 and 2228 that extend horizontally from the vertical trunnion plate 2204. FIG. 23 shows a partially exploded illustration of the W-axis carriage seen from an observation point behind the H and J-axes assembly looking forward towards the vertical projection screen. FIG. 24 is a horizontal plane view looking down the W-axis. FIG. 25 is also a horizontal plane view looking down the W-axis. In FIG. 25, the W-axis carriage 2502 has been rotated to the right. Thus, rotation of the W-axis carriage about the W-axis rotation pins 2504 (lower rotation pin not shown) is illustrated in FIGS. 24 and 25.

Figure 26:
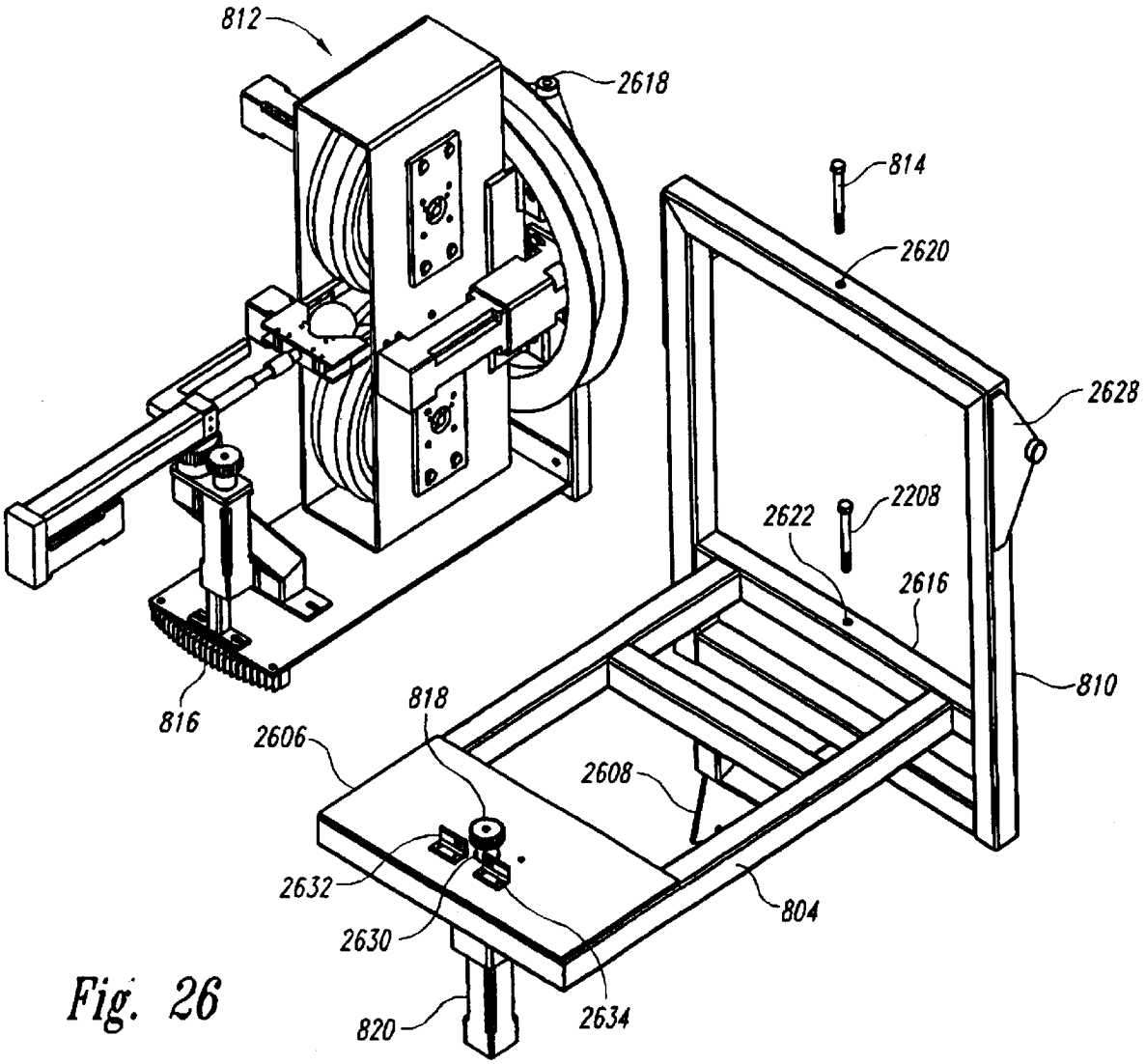
FIG. 26 illustrates the Y-axis carriage.

FIG. 26 illustrates the Y-axis carriage. The Y-axis carriage comprises a vertical frame 2602, a horizontal frame 2604, a base plate 2606, the Y-axis carriage fixed gear extension 2608, the W-axis carriage 2610, the W-axis electrical servo motor 2612, and the W-axis rotation pins 2614 and 2615. The Y-axis vertical frame 2602 comprises a rectangular frame welded together from four machined lengths of two-inch square steel tubing as indicated in FIG. 26, with a horizontal cross member 2616. The Y-axis carriage horizontal frame 2604 is welded to horizontal cross frame 2616. The W-axis trunnion flanges 2618 (lower trunnion flange not shown) fit over apertures 2620 and 2622 in the Y-axis vertical frame 2602. The W-axis carriage is rotatably fixed to the Y-axis carriage by the W-axis rotation pins 2614 and 2615. The W-axis carriage is rotated by transduction of rotation of the W-axis power shaft gear 2624 via the W-axis fixed sector gear 2626. In an enhanced embodiment, two ball transfers may apply a constraint, from either side of the W-axis carriage base plate (2202 in FIG. 22), to prevent the W-axis carriage base plate from vertically separating from the Y-axis carriage base plate 2606. A lower ball transfer is attached to the Y-axis base plate 2606 and an upper ball transfer is mounted to a ball transfer support member (not shown) attached to the Y-axis carriage. The two ball transfers ensure that the W-axis fixed sector gear 2626 remains enmeshed with the W-axis power shaft gear 2624. The Y-axis carriage is rotatably joined to the Z-axis carriage via a right-hand trunnion 2628 and a left-hand trunnion (obscured in FIG. 26). The Y-axis carriage is rotated about the Y-axis via transfer of rotational motion from the Y-axis electrical servo motor (not shown in FIG. 26) to the Y-axis fixed sector gear (also not shown in FIG. 26) bolted to the Y-axis fixed gear extension 2608. The Y-axis horizontal frame comprises four machined lengths of two-inch square tubing welded together as indicated in FIG. 26, to which the Y-axis carriage base plate 2606 is welded. The W-axis electrical servo motor 2612 is bolted to the Y-axis base plate 2606 with the W-axis electrical servo motor power shaft extending through an aperture 2630 in the Y-axis base plate 2606. Two angle brackets 2632 and 2634 are bolted to the Y-axis carriage base plate 2606 to carry electrical limit switches that prevent excessive angular excursion and overtravel of the W-axis assembly to exceed its limits. An identical set of two switches may be placed about the Y-axis fixed sector gear, shown in FIG. 27, to limit travel of the Y-axis carriage about the Y axis. These switches are commercially-available as Omron Corp., part number Z15GQ22-B7-K. These switches, one each for the left and right end of the fixed sector gear, when activated, stop the respective drive axis motors for W or Y-axes. If for any reason the machine is commanded to exceed the software limits set in its operating parameters, the two limit switches on the Y carriage and the two limit switches on the W carriage will provide a redundant safe stop with a separate power supply. The limit switches described are capable of bringing either carriage assembly to a dead stop within a few hundredths of a second. This greatly decreases the otherwise low probability of throwing a wild pitch or hitting a batter. As an alternate to mechanical limit switches, electrical proximity sensors can be used, such as part number 5B275 from New Line Corp.

Figure 27:
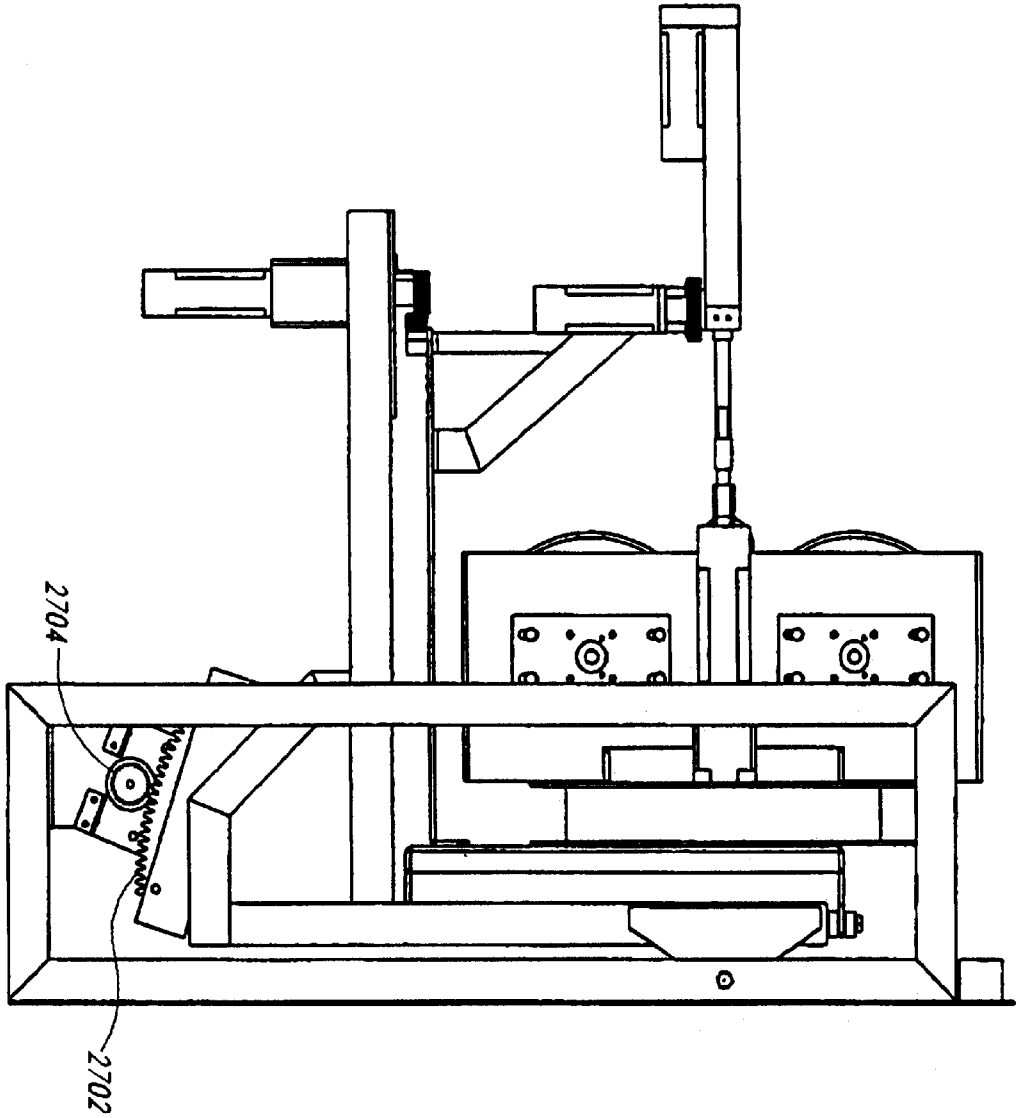
FIG. 27 shows the Y-axis carriage in a horizontal position.
Figure 28:
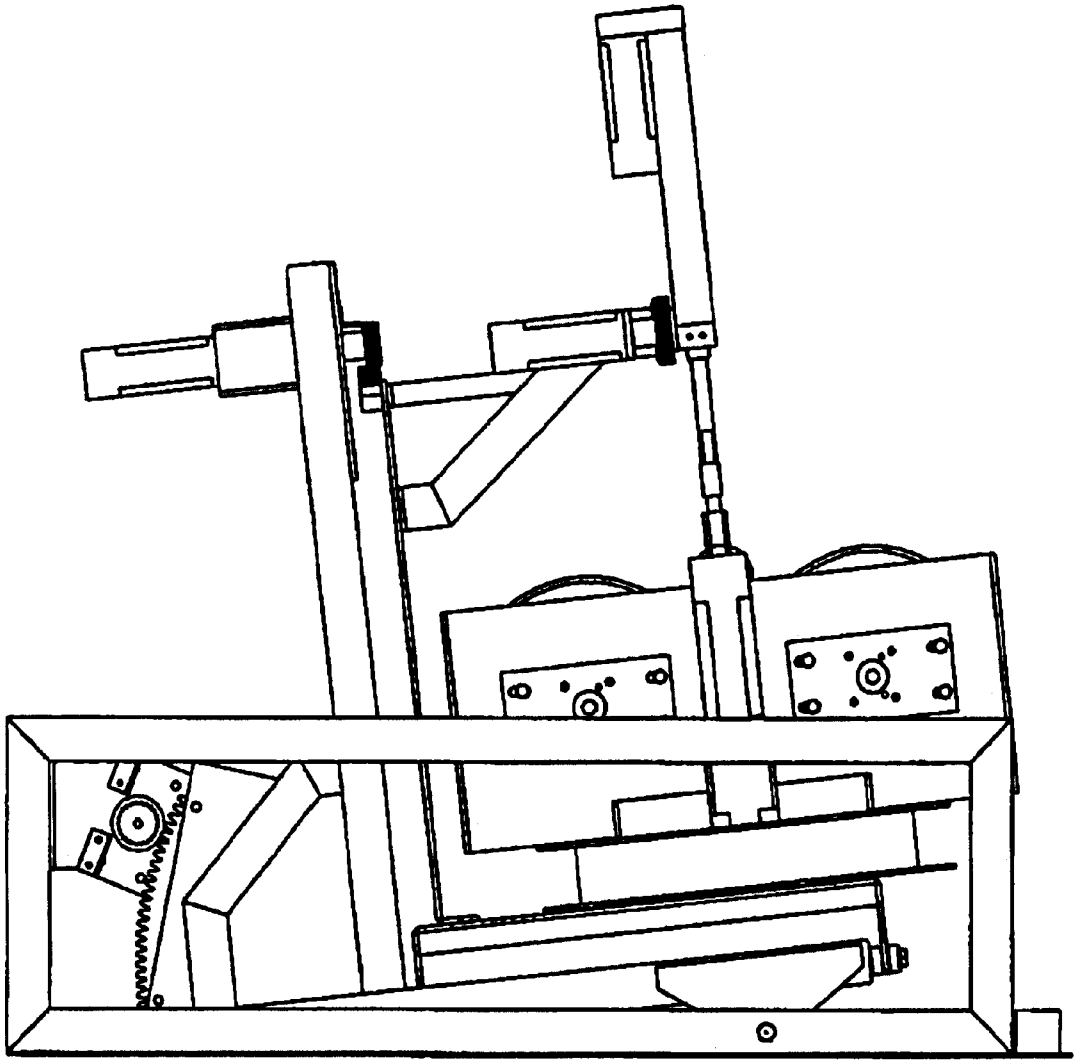
FIG. 28 illustrates the Y-axis carriage rotated downward about the Y-axis.

FIGS. 27 and 28 illustrate rotation of the Y-axis carriage about the Y-axis. FIG. 27 shows the Y-axis carriage in a horizontal position, and FIG. 28 illustrates the Y-axis carriage rotated downward about the Y-axis. The Y-axis fixed sector gear 2702 enmeshes with a gear 2704 directly attached to the power shaft of the Y-axis electrical servo motor (not shown). Rotation of the Y-axis electrical servo motor is transduced via the Y-axis fixed sector gear 2702 to control rotation of the Y-axis carriage about the Y-axis.

Figure 29:
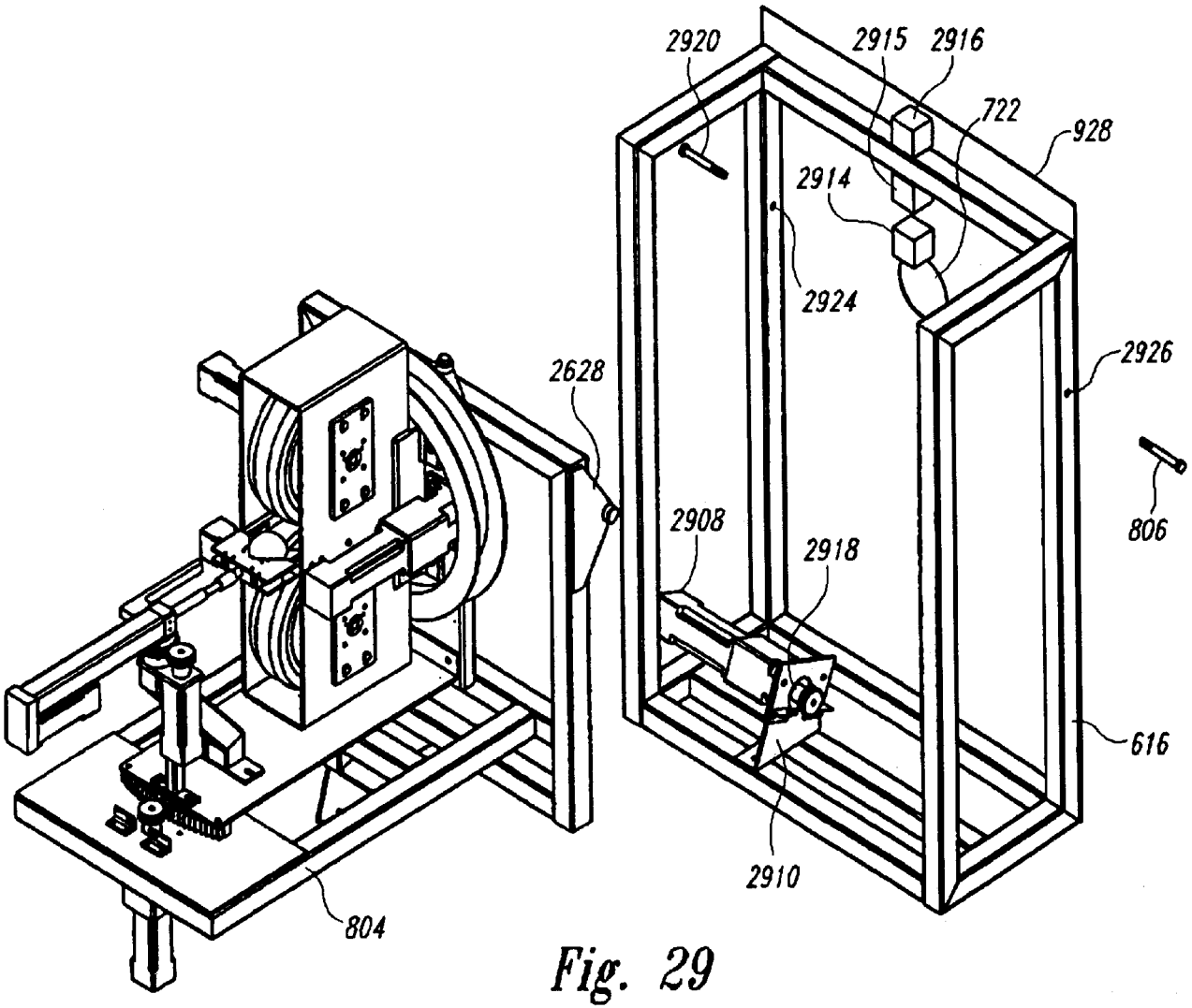
FIG. 29 illustrates the Z-axis carriage.

FIG. 29 illustrates the Z-axis carriage. The Z-axis carriage comprises the Y-axis carriage 2902, the Z-axis frame 2904, the Z-axis faceplate 2906, the Y-axis electrical servo motor 2908, and the Y-axis electrical servo motor mount 2910. The Z-axis frame 2904 comprises twelve machined lengths of two-inch square steel tubing welded together to form the cage-like structure shown in FIG. 29. The Z-axis faceplate 2906 is bonded to the Z-axis frame as indicated in FIG. 29. The Z-axis faceplate 2906 has a reflective forward surface of the same coloring and reflectivity as the flexible screens of the vertical projection screens. The faceplate 2906 includes an aperture 2912 through which a baseball is projected, as well as, in certain embodiments, three lights 2914–2916 that serve as warning lights to alert a batter that a baseball is about to be projected. The Y-axis electrical servo motor mount 2910 comprises an angle bracket with an aperture 2918 through which the power shaft of the Y-axis electrical servo motor 2908 extends. The Y-axis electrical servo motor 2908 is bolted to the Y-axis electrical servo motor mount 2910 which is, in turn, bolted to the Z-axis frame 2904 as indicated in FIG. 29. The Y-axis carriage is rotatably mounted to the Z-axis frame via the Y-axis rotation pins 2920 and 2922 that extend through apertures in the Z-axis frame 2924 and 2926, respectively, and the Y-axis carriage trunnions 2928 (right-handed trunnion obscured in FIG. 29).

Figure 30:
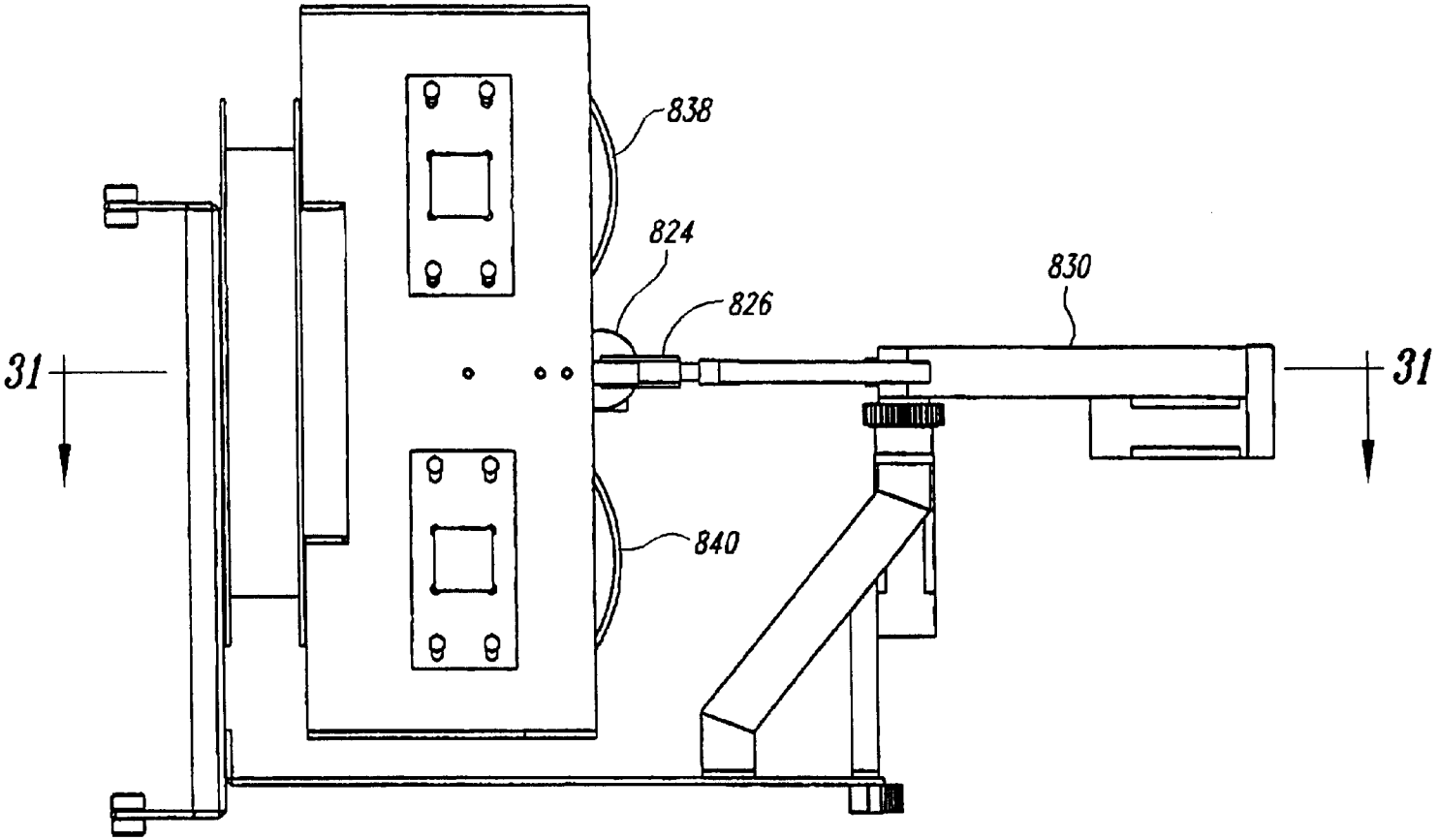
FIG. 30 is a sectional view of the Y-axis carriage.
Figure 31:
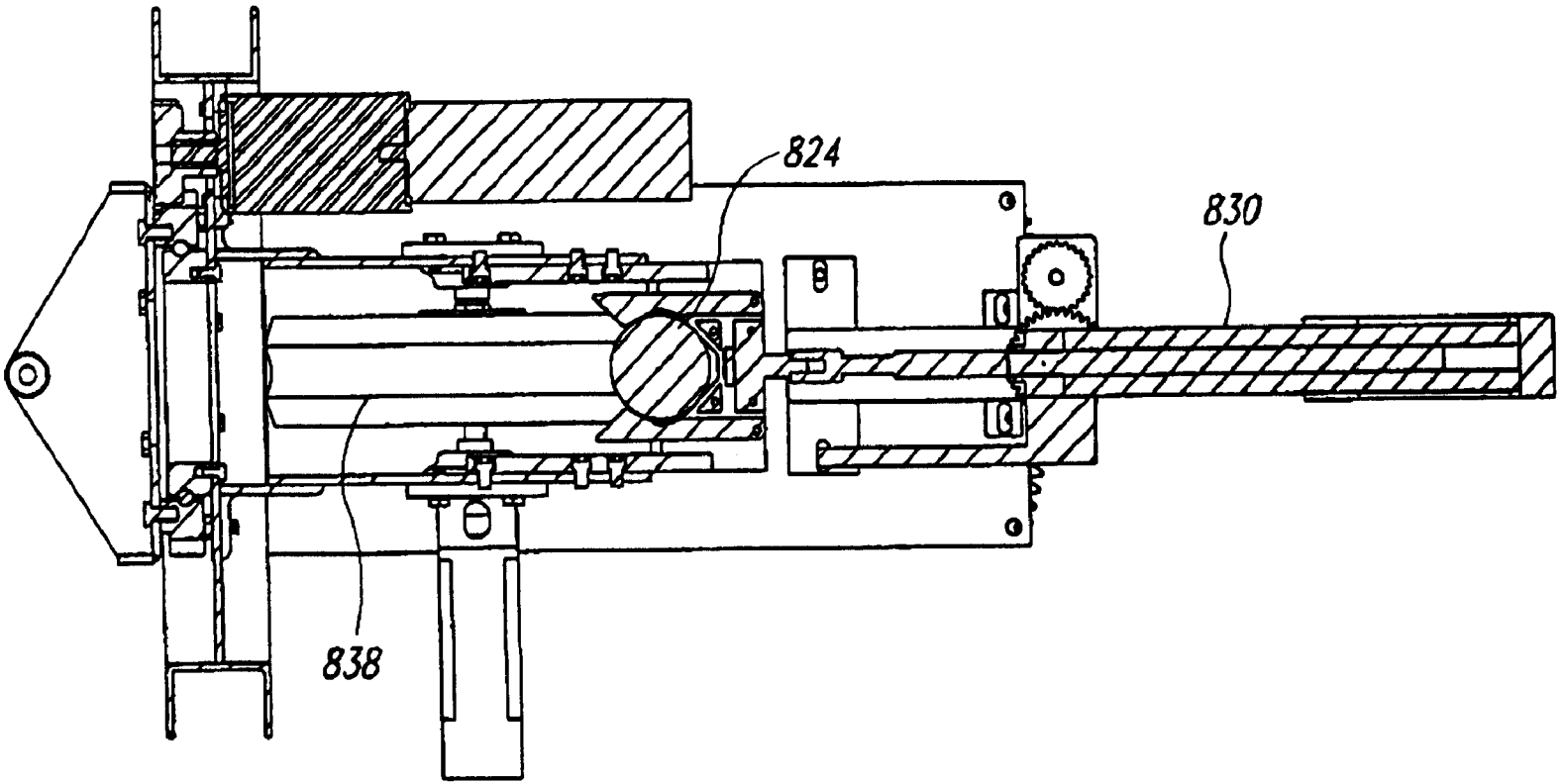
FIG. 31 shows a cross section of the W-axis carriage looking down the W-axis from above the BPM.

FIGS. 30 and 31 illustrate extension of the baseball into the counter-rotating flywheels for projection by the BPM. In FIG. 30, a sectional view of the Y-axis carriage is shown. The baseball 3002, gripped by the baseball gripper component 3004, is partially extended by the H-axis electrical cylinder 3006 towards the counter-rotating flywheels 3008 and 3010. FIG. 31 shows a cross section of the W-axis carriage looking down the W-axis from above the BPM. The baseball 3102 is shown fully extended by the H-axis electrical cylinder 3104 into the counter-rotating flywheels (lower flywheel not shown).

Figure 32:
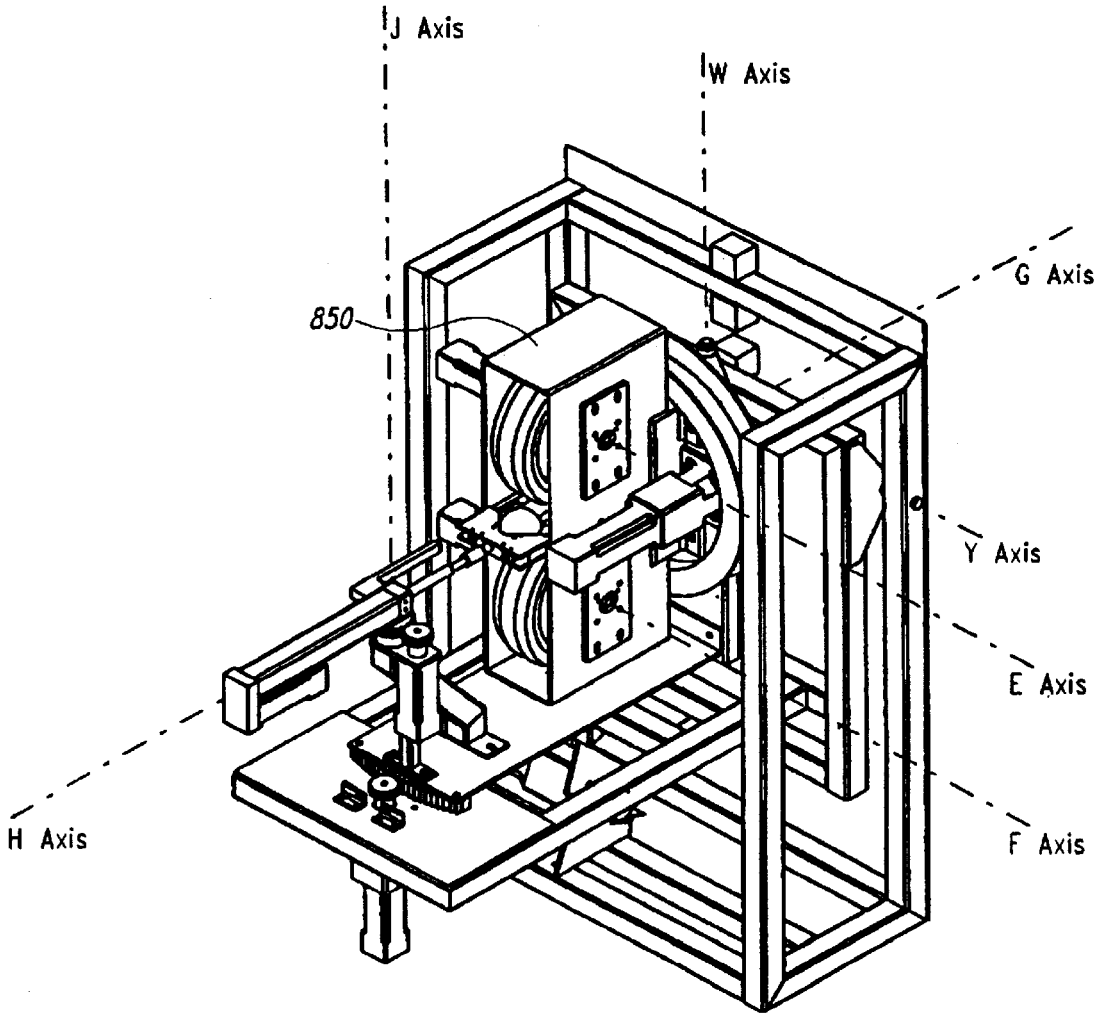
FIGS. 32 and 33 illustrate rotation of the flywheel housing about the G-axis.
Figure 33:
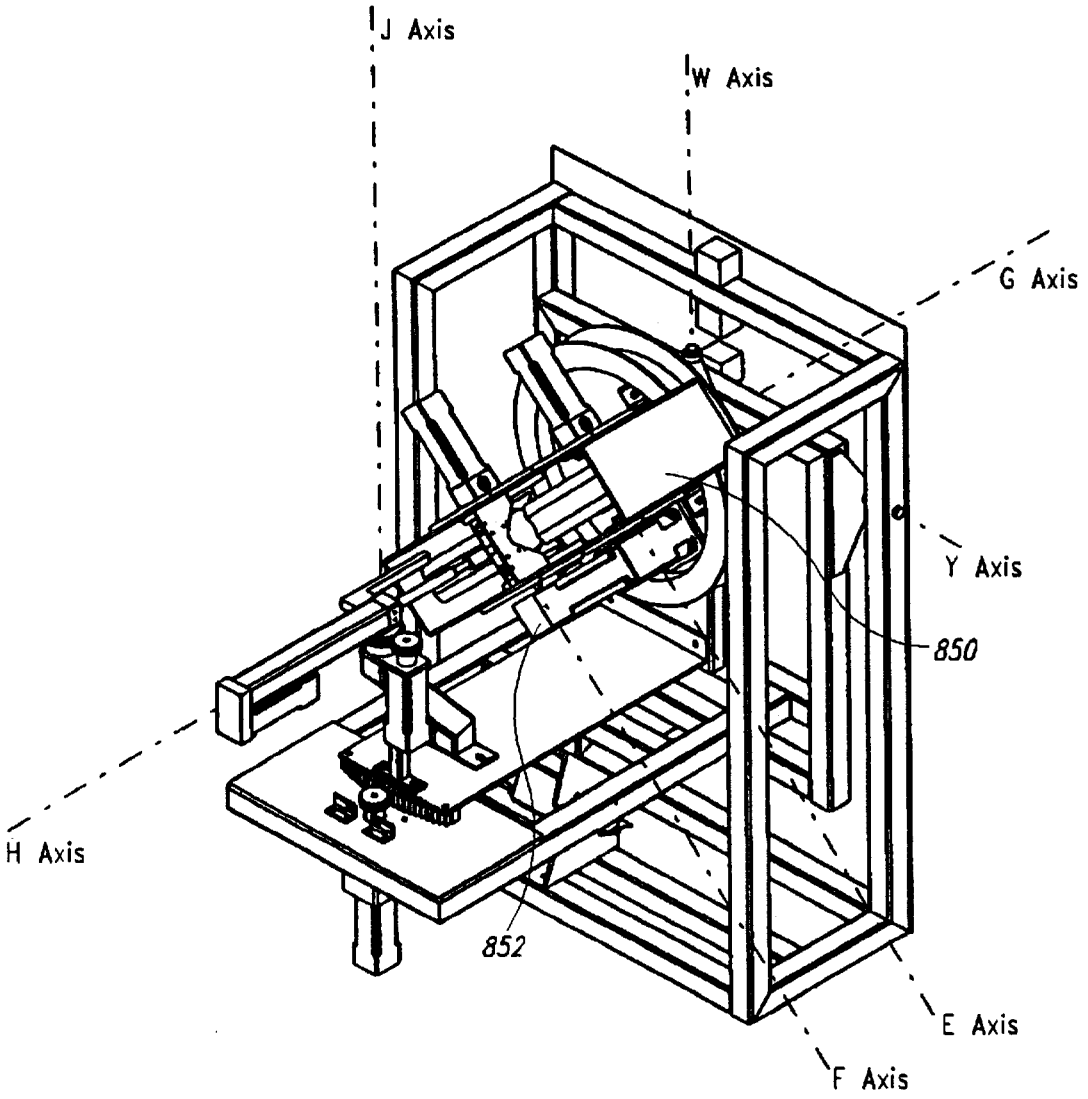

FIGS. 32 and 33 illustrate rotation of the flywheel housing about the G-axis. In FIG. 32, the flywheel housing 3302 is vertically positioned with respect to the G-axis. In FIG. 33, the flywheel housing 3302 has been rotated in a counter-clockwise direction with respect to the G-axis via rotational motion generated by the G-axis electrical servo motor 3304.

Figure 34:
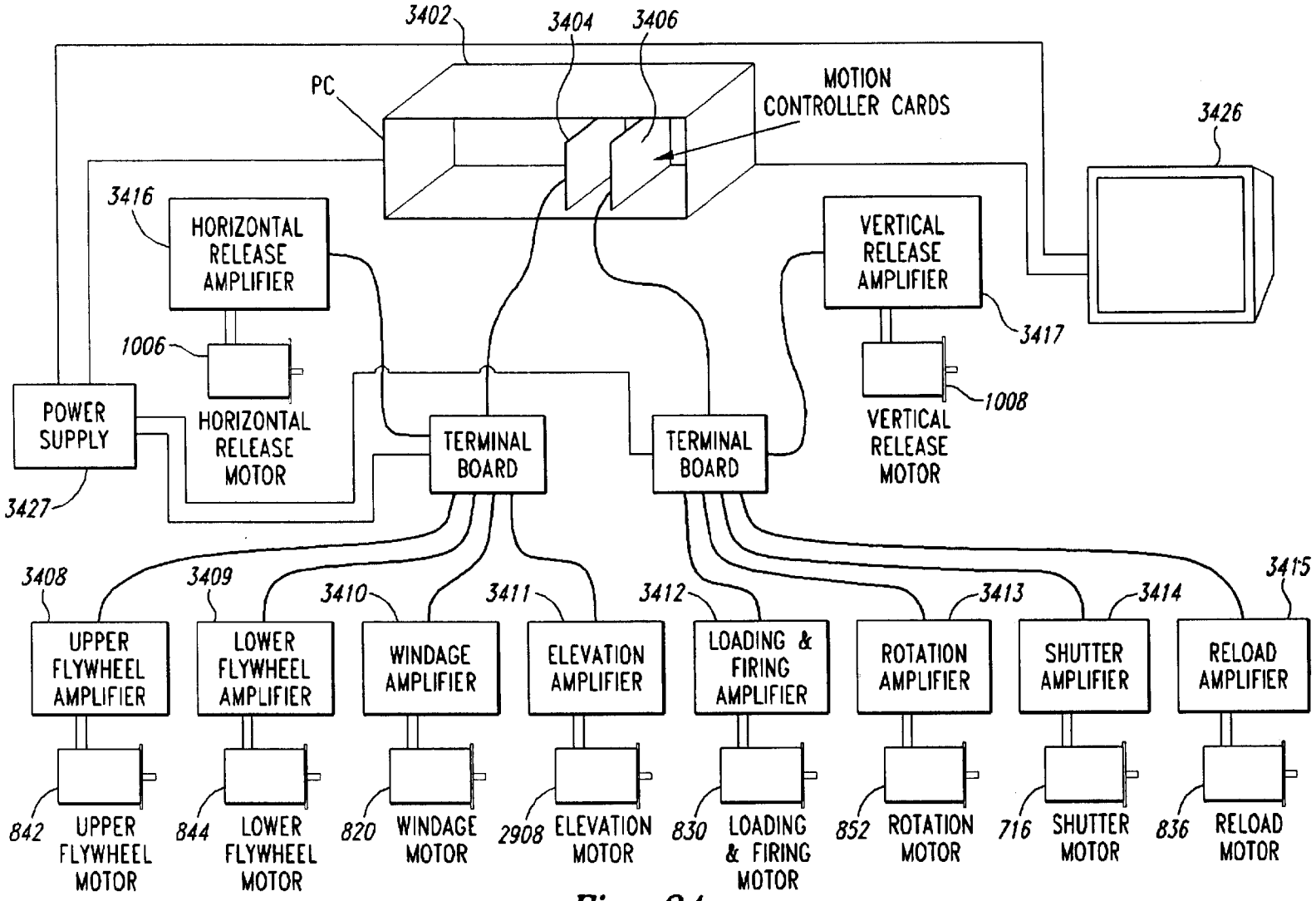
FIG. 34 illustrates the electrical and computer control of the BPM.

FIG. 34 illustrates the electrical and computer control of the BPM. The BPM is controlled by software programs running on a personal computer ("PC") 3402. The PC 3402 includes motion control cards 3404 and 3406 that include logic for translating software-specified parameters into electrical servo motor rotation. The motion control cards produce control signals that are amplified by servo amplifiers 3408–3417 that amplify the signals from the motion controller cards 3404 and 3406 in order to control the various electrical servo motors 3418–3425. Voltage signals sent from the servo amplifiers 3408–3417 direct the electrical servo motors 3418–3425 to accelerate and rotate at particular rotational speeds for particular lengths of time. Software routines running on the PC 3402 translate high-level specifications, such as the velocity at which the baseball should be initially projected from the BPM, into rotations for the various electrical servo motors. A graphical user interface ("GUI") is displayed by the software programs running on the PC 3402 on a visual display device 3426. The PC, visual display device, and servo amplifiers receive electrical power from a power supply 3427.

In Table 2, below, are shown intermediate values used in the translation of the velocity of projection of a baseball into E and F flywheel rotation speeds.

TABLE 2

| SPEED (mph) | SPIN (rpm) | E rad/s | E rpm | E cnt/S | F rad/s | F rpm | F cnt/S |
|---|---|---|---|---|---|---|---|
| 100 | 1800 | 264.0 | 2523 | 172253 | 312 | 2979 | 203386 |
| 95 | 1800 | 248.5 | 2374 | 162084 | 296 | 2830 | 193217 |
| 90 | 1800 | 232.9 | 2225 | 151915 | 281 | 2681 | 183047 |
| 85 | 1800 | 217.3 | 2076 | 141745 | 265 | 2532 | 172878 |
| 80 | 1800 | 201.7 | 1927 | 131576 | 249 | 2383 | 162709 |
| 75 | 1800 | 186.1 | 1778 | 121407 | 234 | 2234 | 152539 |
| 70 | 1800 | 170.5 | 1629 | 111237 | 218 | 2085 | 142370 |
| 100 | 1200 | 280.0 | 2675 | 182631 | 312 | 2979 | 203386 |
| 95 | 1200 | 264.4 | 2526 | 172461 | 296 | 2830 | 193217 |
| 90 | 1200 | 248.8 | 2377 | 162292 | 281 | 2681 | 183047 |
| 85 | 1200 | 233.2 | 2228 | 152123 | 265 | 2532 | 172878 |
| 80 | 1200 | 217.6 | 2079 | 141954 | 239 | 2383 | 162709 |
| 75 | 1200 | 202.0 | 1930 | 131784 | 234 | 2234 | 152539 |
| 70 | 1200 | 186.4 | 1781 | 121615 | 218 | 2085 | 142370 |

The desired velocity of the baseball is shown in the first column in miles per hour, the desired rotational spin of the baseball is shown in the second column in rpm, and rotational speeds of the E and F flywheels in radians per second, revolutions per minute, and counts per second are shown in columns 3–8.

Table 3, shown below, list the fields in a database record necessary to describe a particular pitch:

TABLE 3

| Field Name | Field Type | Field Description |
|---|---|---|
| Pitch | varchar (128) | name of path |
| Velocity | float | velocity of baseball (translational) |

TABLE 3-continued

| Field Name | Field Type | Field Description |
|---|---|---|
| major spin | float | overspin or underspin in # revolutions |
| minor spin | float | sidespin in # revolotions |
| target_x | float | horizontal coordinate of target |
| target_y | float | vertical coordinate of target |
| Image | varchar (255) | path name of video file for pitch |
| Pitcher | float | name of pitcher in image |
| release time | float | time from start of image to release of ball |
| release_x | float | point of release on X-axis |
| release-z | float | point of release on Z-axis |
| e_spin | float | counts/seconds for upper flywheel |
| f_spin | integer | counts/second for lower flywheel |
| w_angle | integer | + or − angle from 0° |
| y-angle | float | + or − angle from 0° |
| g-angle | float | + or − angle from 0° |
| h-velocity | float | velocity of extensible arm of electrical cylinder |

For each field in the data record, Table 3 lists the name of the field, in the first column, the data type of data stored in the field, in the second column, and a concise description of the contents of the field, in the third column. There are a variety of different ways in which to store information related to pitches. Data fields listed in Table 3 represent one of many possible data schemas that represents one particular approach to storing pitch data. In the data schema represented by Table 3, various high-level parameters related to a particular pitch are described, including the initial velocity at which the baseball is projected from the BPM, as well as the rotation rate of the baseball in the plane of the flywheels, or major spin, and the rotation rate imparted to the baseball by movement of the G-axis, or minor spin. Additional high-level parameters include coordinates of the target point within a target area above home plate and coordinates of the release point of the baseball with respect to the X and Z-axes of the BPM. Additionally, the name of the pitch and name of the baseball pitcher whose image is projected on the vertical projection screen are stored in character-string data fields, along with the path name of the video file to be projected for the pitch onto the vertical projection screen. Finally, the data record described by Table 3 includes angle settings for the W and Y-axes, which are stored along with an initial angle setting for the G-axis and rotation rates for the upper and lower flywheels. In order to facilitate calculation of rates and initiation times for motor control, an additional group of auxiliary database tables may be employed to translate W and Y-axes angles into electrical servo motor control parameters, to translate the major spin rotation rate into a differential rotation rate to be added to either the upper or lower flywheel, depending on whether an over spin or under spin is desired, and a rotation rate for the G-axis in the case of an indicated minor spin. Auxiliary database tables can also be used to store any additional data or parameters required in order to control the electrical servo motors within the BPM prior to, and during, the release of the baseball. In one embodiment, detailed electrical servo motor control parameters are stored for each different pitch, so that little or no calculation is required in order to direct the electrical servo motors to execute the pitch. In an alternate embodiment, the electrical servo motor control parameters are analytically calculated from the data stored in a data record, such as the data record described in Table 3. Various hybrid approaches are also possible.

FIGS. 35–39 describe the programs that control the BPM. These programs are executed on the PC (3402 in FIG. 34)

to provide a graphical user interface ("GUI") to the coach or trainer operating the BPM as well as to direct operation of the various electrical servo motors within the BPM in a coordinated manner to execute a particular pitch selected by the coach or trainer.

Figure 35:
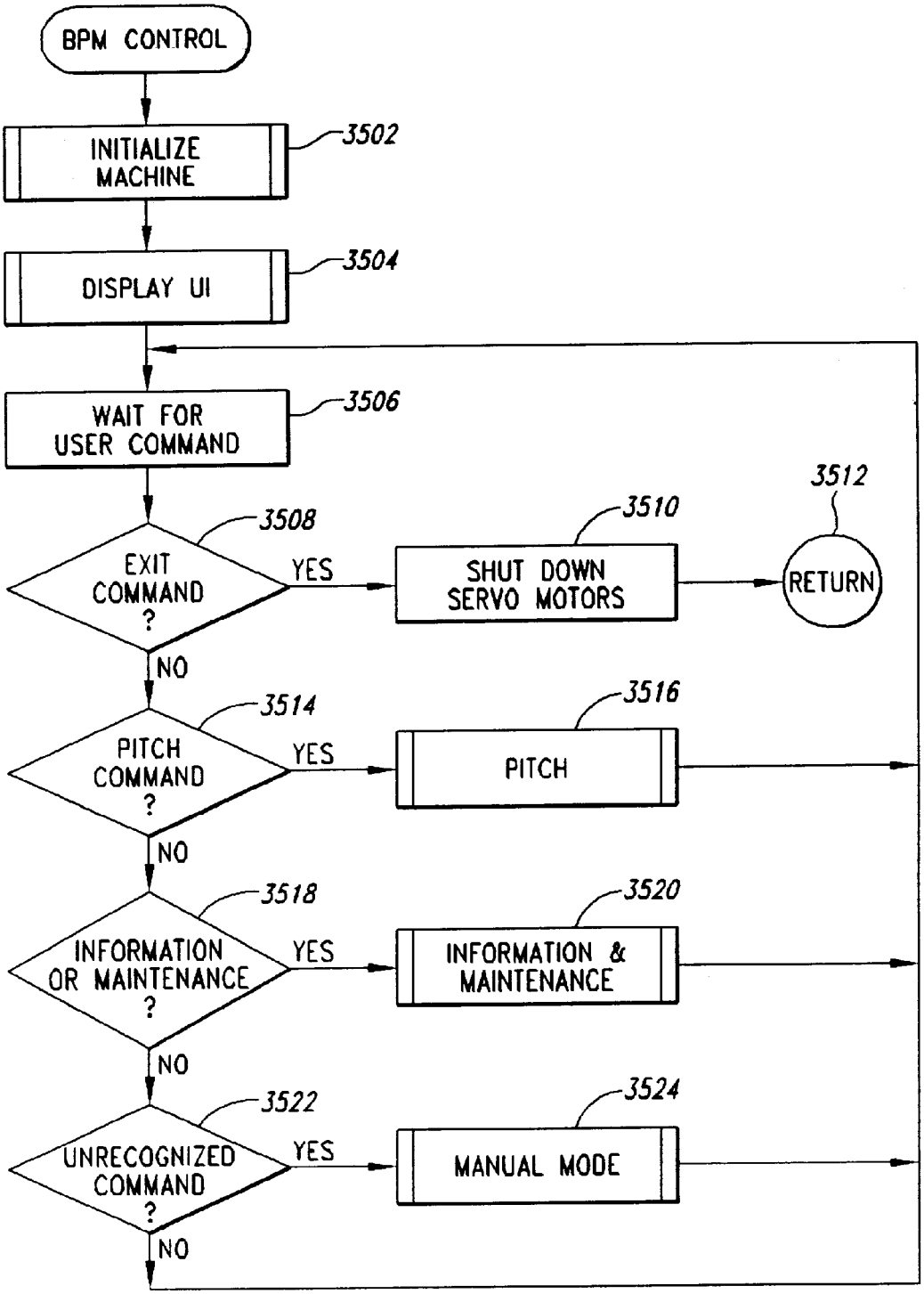
FIG. 35 is a flow control diagram illustrating the top level BPM control program.

FIG. 35 is a flow control diagram illustrating the top level BPM control program. In step 3502, the BPM is initialized upon start-up of the system. BPM initialization includes driving the shutter via the I-axis to a position from which the shutter can be predictably driven past the Z-axis carriage faceplate as the baseball is released. Additionally, the electrical servo motors controlling the other axes may be driven to initial positions, and the flywheels may be spun up to an initial velocity. In step 3504, a user interface is displayed on a display monitor to the coach or trainer that is operating the BPM. This display allows the coach or trainer to select any of a number of commands in order to operate the BPM. In step 3506, the BPM control program waits for the coach or trainer to interact with the GUI displayed in step 3504 in order to select a next command for execution. If the coach or trainer indicates that the BPM should be shut down, as detected by the BPM control program in step 3508, the program shuts down all the electrical servo motors in step 3510 and returns to step 3512. If, on the other hand, the coach or trainer selects a pitch command, as detected by the BPM control program in step 3514, the BPM control program calls the routine "pitch," in step 3516, to pitch a baseball. The routine "pitch" will be described in further detail, below. The coach or trainer may select any of a number of different informational or maintenance commands, as detected by the BPM control program in step 3518, which are then executed by the BPM control program by calling an informational and maintenance command routine in step 3520. These informational and maintenance commands are beyond the scope of the current application. They involve data collection for statistical analysis, testing and calibration routines, and a variety of additional functions that enhance the capabilities of the BPM. These informational and maintenance routines will be the subject of a subsequent patent application. Finally, if the coach or trainer desires to operate the BPM in a manual mode, as detected by the BPM control program in step 3522, the BPM control program calls a routine "manual mode" in step 3524 in order to allow the coach or trainer to manually select all the various electrical servo motor settings and initiate projection of a baseball. Additionally, the selected settings in manual mode may be saved in a data record so that they may be subsequently reproduced. The manual mode routine will not be described in further detail.

Figure 36:
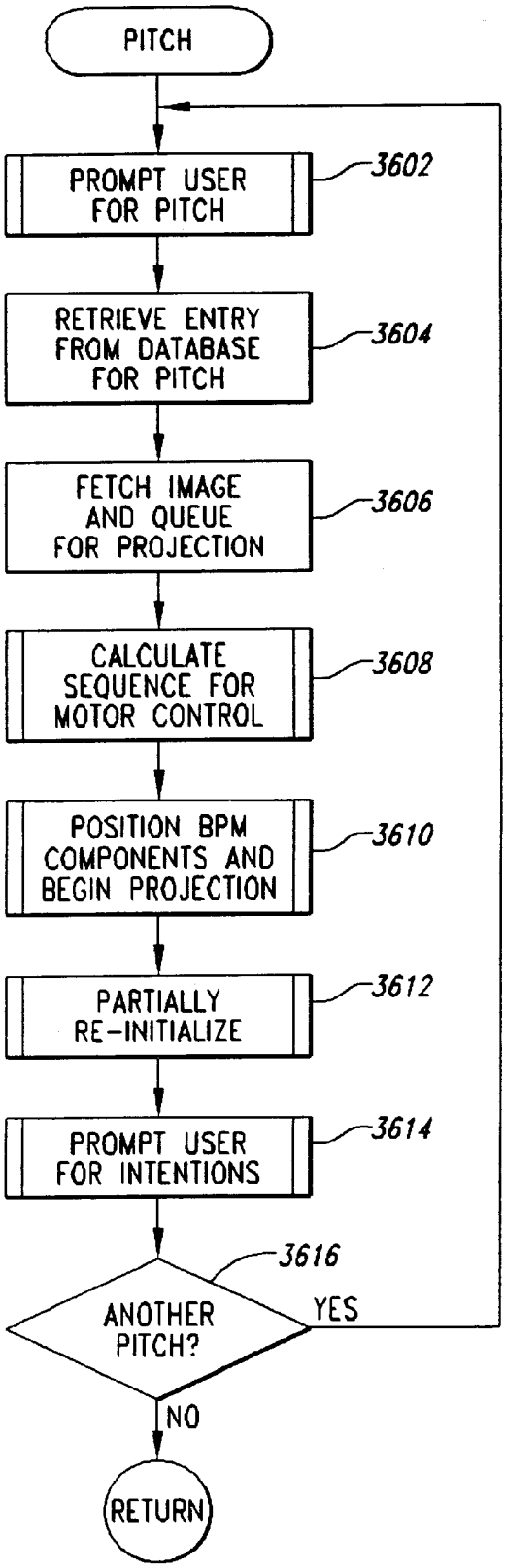
FIG. 36 is flow control diagram for the routine "pitch."

FIG. 36 is flow control diagram for the routine "pitch." In step 3602, the routine "pitch" prompts the coach or trainer to select a particular pitch. Any number of different GUI's may be employed for this prompting. For example, the coach or trainer may be provided a list of well-known pitches, such as the fastball, slider, curve ball, or other pitches, and then may be provided an auxiliary menu to select an initial velocity and a point to which the baseball is to be projected. In step 3604, the routine "pitch" retrieves an appropriate entry from a pitch database, such as the data record illustrated in Table 3, above, in order to prepare to drive the electrical servo motors and display the image of the pitcher on the vertical projection screen. In step 3606, the routine "pitch" locates the video image file indicated in the database record retrieved in step 3604 and queues the video image file for projection. In step 3608, the routine "pitch" calls a calculation routine to calculate a time sequence for electrical servo motor control. In step 3610, the routine "pitch" calls a projection routine to execute the timed sequence developed in step 3608. In step 3612, the routine "pitch" calls a clean-up routine to partially re-initialize the BPM for subsequent pitches. Re-initialization may include returning the shutter via control of the I-axis to a position from which the shutter is ready to be subsequently actuated, and may involve retracting the gripper assembly along the H-axis to allow for subsequent loading of a baseball. In step 3614, the routine "pitch" prompts the coach or trainer for a subsequent pitch command. If the coach or trainer desires the BPM to project another baseball, detected by the routine "pitch" in step 3616, control returns to step 3602. Otherwise, the routine "pitch" returns.

Figure 37:
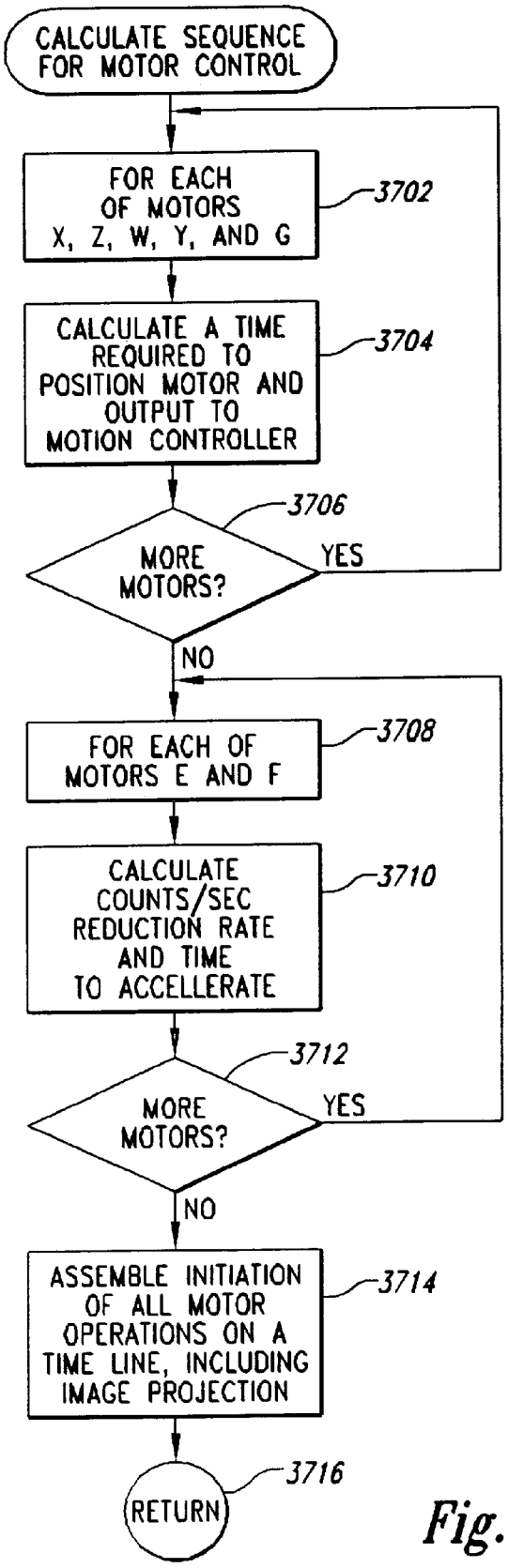
FIG. 37 is a flow control diagram of the calculation routine called by the routine "pitch."
Figure 38:
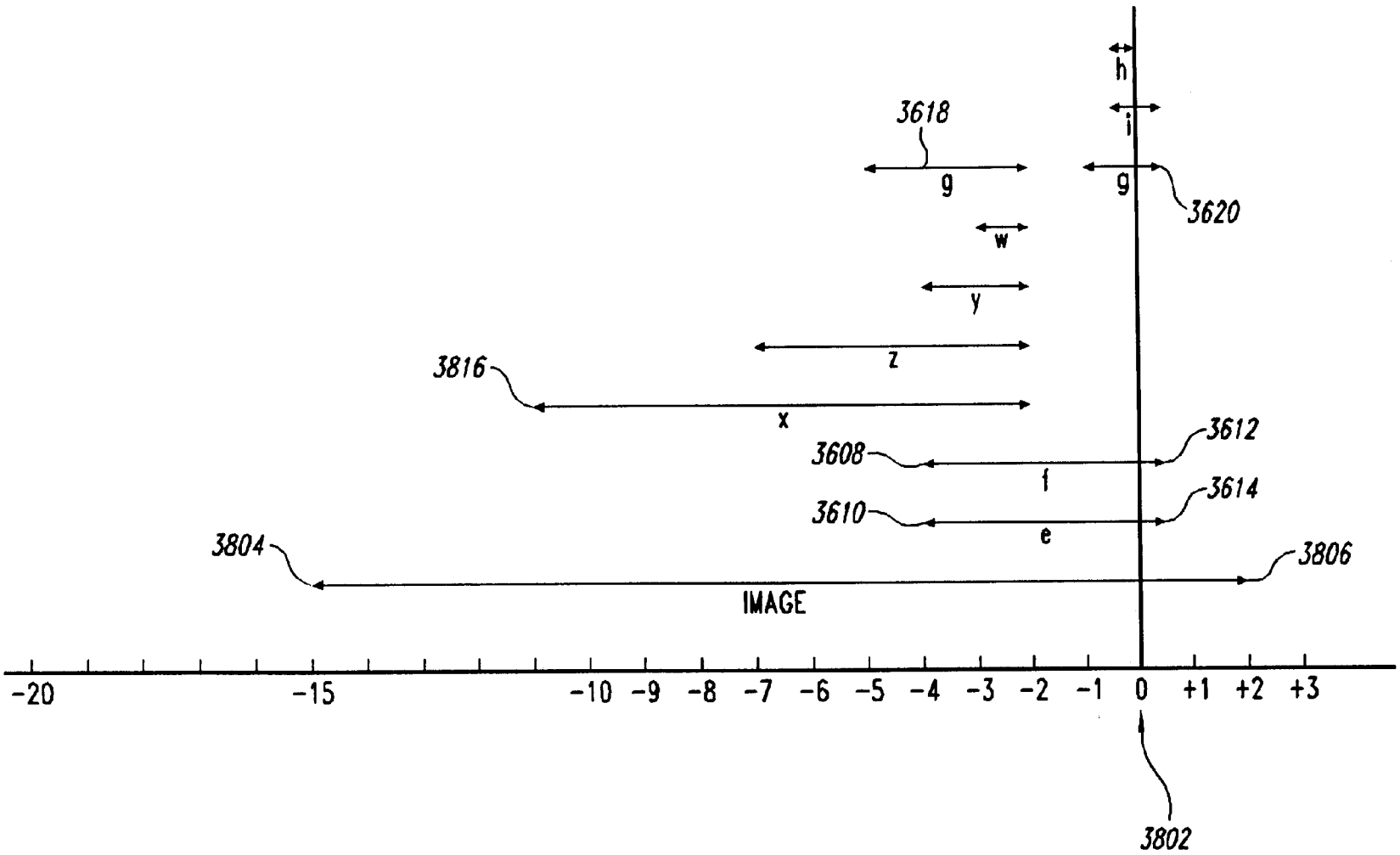
FIG. 38 illustrates an electrical servo motor operation timeline.

In FIG. 37, the calculation routine called by the routine "pitch" in step 3608 is illustrated via a control flow diagram. Steps 3702, 3704, and 3706 comprise a loop in which the calculation routine calculates timed outputs to the motion controller cards (3406 and 3408 in FIG. 34) in order to drive each of the electrical servo motors as indicated by the various fields in the database record retrieved by the routine "pitch" in step 3604. For example, if the retrieved database record indicates that the X-axis location of the release point should be 90 cm from the left-hand side of the vertical projection screen, then the calculation routine will calculate a distance between the current position of the release point and the desired position of the release point along the X-axis and calculate a motor speed and total time of motor operation in order to drive the X-axis frame along the X-axis to the desired release point location. Steps 3708, 3710, and 3712 comprise a loop in which the rotational speeds of the upper and lower flywheels are determined either directly from the database record retrieved by the routine "pitch" in step 3604, above, or, in alternate embodiments, by an analytical or semi-empirical calculation depending on the indicated initial velocity and major spin for projection of the baseball. In step 3714, the calculation routine assembles the determined times for operation of the electrical servo motors onto a timeline. FIG. 38 illustrates such a timeline, and will be described below. Finally, the calculations routine returns in step 3716.

FIG. 38 illustrates an electrical servo motor operation timeline. This is a graphical representation of the timeline for illustrative purposes. In preferred embodiments of the BPM, the timeline is stored in the memory of the PC (3402 in FIG. 34) as a list of electrical servo motor control operations stored in an ascending time sequence. In FIG. 38, the baseball is projected by the BPM at time zero 3802. Motor control operations that occur prior to release of the baseball are shown in FIG. 38 at negative times, to the left of time 0, to be executed prior to the time of release of the baseball 3802, and motor operations that occur following the release of the baseball are shown to the right of time zero 3802. In this example, projection of the image of the baseball pitcher is started 15 seconds prior to projection of the baseball 3804 and continues until 2 seconds following the release of the baseball 3806. The upper and lower flywheels are incrementally spun up or spun down to a desired velocity at 4 seconds prior to release of the baseball 3608 and 3610. Just after release of the baseball, the incremental increase or decrease in the rotation rates of the upper and lower flywheels is ended 3612 and 3614, allowing the upper and lower flywheels to return to an idle rotation rate or to remain at the same rotation rate in preparation for a subsequent pitch. Similarly, times for operation of the other BPM electrical servo motors are shown by additional horizontal line segments, such as line segment 3616 illustrating control of the X-axis electrical servo motor to position the X-axis frame along the X-axis. Note that, when a side spin is indicated for a pitch, the G-axis electrical servo motor may be first controlled to a particular initial position 3618 and then, subsequently, just before release of the baseball, operated to rotate about the G-axis in the direction of the desired side spin 3620.

Figure 39:
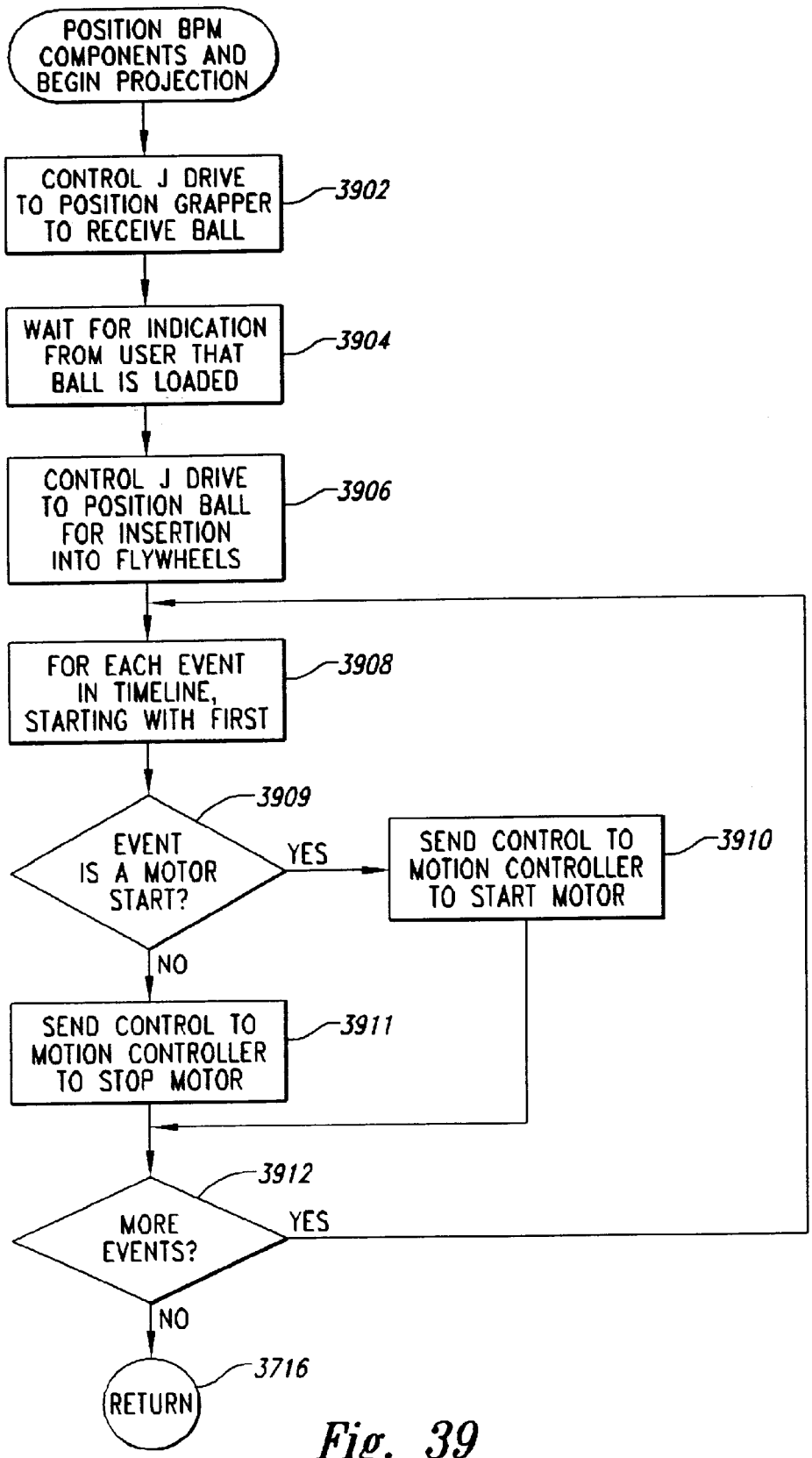
FIG. 39 is a flow control diagram of the projection routine called by the routine "pitch."

FIG. 39 is a flow control diagram of the projection routine called by the routine "pitch" in step 3610. In step 3902, the projection routine transmits inputs to the motion control cards (3406 and 3408 in FIG. 34) in order to drive the J-axis electrical servo motor to rotate the H-axis assembly to a position in which a baseball can be loaded into the gripper component. In step 3904, the projection routine waits for an indication that the ball has been loaded. This indication may be input by a coach or trainer to the GUI, or, in alternate embodiments, the gripper mechanism may contain electrical/mechanical sensors for detecting the presence of the baseball within the gripper assembly. In step 3906, the projection routine controls the J-axis electrical servo motor to reposition the H-axis assembly coincident with the G-axis in preparation for projection of the baseball. Note that, in certain embodiments of the BPM, baseballs may be automatically loaded from a mechanical magazine. In this case, additional control steps may be undertaken to control positioning of the magazine and extension of the gripper assembly via the H-axis to mechanically extract a baseball from the magazine. Steps 3908–3912 comprise a loop in which the projection routine selects, in order, each event from the timeline prepared by the calculation routine in step 3714 of FIG. 37, and executes each selected event. For each selected event, the projection routine determines, in step 3909 whether the event is a motor start or incremental motor control command. If so, then in step 3910, the projection routine sends appropriate control input to the motion controller card (3406 or 3408 in FIG. 34) to control the electrical servo motor as indicated in the timeline event. Otherwise, in step 3911, the projection routine sends appropriate control input to the motion control card (3406 or 3408 in FIG. 34) that controls the electrical servo motor indicated in the event to discontinue operation, remain at the same rotation rate, or return to an idle rotation rate, in the case of the upper and lower flywheels. In step 3912, the projection routine determines if there are any additional events listed in the timeline. If so, as detected in step 3912, control returns to step 3908. Otherwise, the projection routine ends.

In currently-available baseball pitching machines, the seam orientation of a baseball is not controlled prior to, and during, projection of the baseball from the baseball pitching machine. In the BPM of the present invention, by contrast, the seam orientation is controlled, via the gripper component and the orientation marks on the gripper component (2124 and 2126 in FIG. 21), such that the baseball can be repeatedly projected with the same seam orientation. This control of seam orientation exposes and magnifies differences between individual baseballs, due to variation in the materials used in the manufacturing processes as well as differences that result from the manufacturing processes, that result in different trajectories when the baseballs are all projected with the same seam orientation and BPM control parameters. These differences include variation in the weight, circumference, seam height, stitching, and surface texture of the baseball. Using the BPM, it would be possible to test, by repeated projection, each baseball, store various correction factors for each baseball in a database, and to fine tune the components of the BPM according to correction factors retrieved from the database for a baseball about to be projected. However, while possible, such individual treatment of baseballs may be needlessly time consuming.

Figure 40:
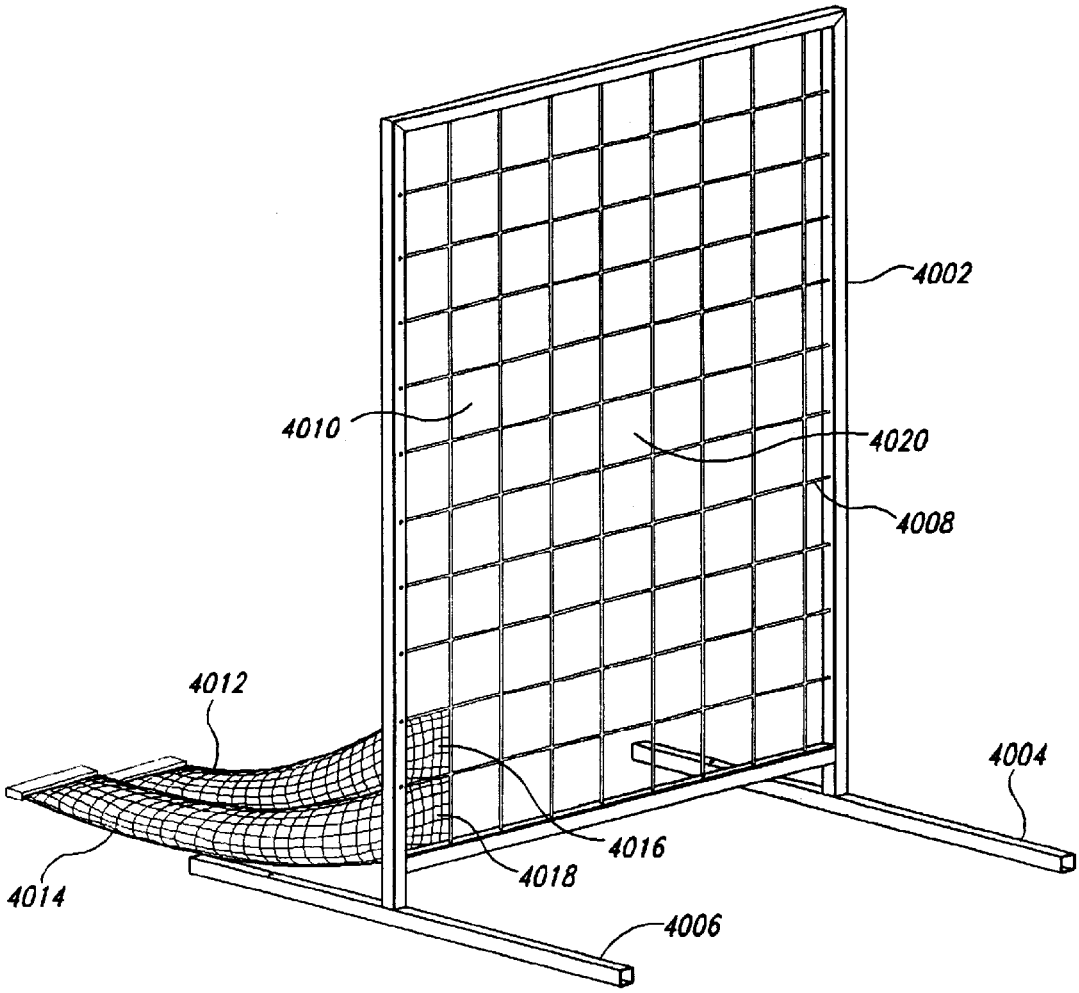
FIG. 40 illustrates a baseball sorting screen.

Instead of individually calibrating baseballs, a baseball sorting method can be applied, using a baseball sorting screen, to group baseballs with similar characteristics together into groups of baseballs that are projected, under identical seam orientation and BPM control parameter settings, to the same location on the baseball sorting screen. FIG. 40 illustrates a baseball sorting screen. The baseball sorting screen comprises a rectangular frame 4002 vertically mounted to two horizontal base members 4004 and 4006. Wires, nylon cord, or other tension-bearing linear materials are laced through the rectangular frame 4002 to form a grid 4008 with rectangular cells, such as cell 4010, somewhat larger in area than the cross-sectional area of a baseball. Sock-like netting is affixed to each cell, such as the sock-like netting 4012 and 4014 affixed to cells 4016 and 4018, respectively. The sock-like netting affixed to the remaining cells of the baseball sorting screen in FIG. 40 is omitted for the sake of visual clarity.

A large group of baseballs is projected, one-at-a-time, under identical seam-orientation and BPM control parameter settings, towards the center cell 4020 of the baseball sorting screen. Baseballs pass through the grid 4008 and are entrapped in the sock-like netting affixed to the cell through which the baseball passes. The baseball are, in this matter, physically separated into smaller groups, each smaller group residing in a particular sock-like net. A set of correction factors are assigned to each smaller group of baseballs and stored in a database. Later, these correction factors can be retrieved and applied to the BPM control parameters for a particular pitch in order to fine tune the BPM control parameters for each different smaller group of baseballs. For example, the smaller group of baseballs collected in sock-like net 4014 would be assigned correction factors that, applied to the BPM control parameter settings used to project the baseballs during the test, would result in the baseballs collected in sock-like net 4014 instead passing through the center cell 4020. Later, during batting practice, the BPM control parameters can be adjusted by applying the correction factors to insure that the smaller group of baseballs collected in sock-like net 4014 during the test will be accurately projected to desired locations within the strike zone.

Although the present invention has been described in terms of a particular embodiment, it is not intended that the invention be limited to this embodiment. Modifications within the spirit of the invention will be apparent to those skilled in the art. For example, many types of component configurations and methods of attaching and mounting components to various assemblies different from those shown in the figures and described in the above text may be employed, like, for example, bolting rather than welding. Many different GUIs may be employed to provide an interface between the BPM and a user. Sequences of pitches may be selected in advance, so that the BPM can automatically pitch an entire sequence of pitches without further user intervention. An almost limitless number of different software implementations can be employed to control the electrical servo motors of the BPM in order to pitch baseballs. Modifications to the BPM may easily provide a tennis-ball-serving machine, a martial arts weapons throwing simulator, a football passing machine, and other types of simulators that use video images to simulate an object projector and modified object projection components to project a physical object in reproducible and meaningful ways. The BPM may be scripted to pitch a standard sequence of pitches for evaluating potential candidate baseball players in a standard fashion. The PC component of the BPM enables collection of detailed information, input by a coach or trainer operating the BPM, with regard to a batter's performance against the BPM. This detailed information may enable development of player profiles, training regimes, and other such evaluation and training methodologies. The BPM may be enhanced to include laser targeting and calibration systems for rapid, automated calibration of the BPM. Different types of materials can be used to fashion the components of the BPM, including different types of circumferential belts bonded to the flywheels of different compressibilities and having different surface characteristics.

The foregoing description, for purposes of explanation, used specific nomenclature to provide a thorough understanding of the invention. However, it will be apparent to one skilled in the art that the specific details are not required in order to practice the invention. The foregoing descriptions of specific embodiments of the present invention are presented for purpose of illustration and description. They are not intended to be exhaustive or to limit the invention to the precise forms disclosed. Obviously many modifications and variations are possible in view of the above teachings. The embodiments are shown and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents:

What is claimed is:

1. An object projection machine, having a front vertical plane, that projects an object to a target position with a specified initial trajectory, a specified initial velocity, and a specified initial rotation rate, the object projection machine comprising:

a main frame;

a flywheel housing dynamically mounted within the main frame, the flywheel housing having a projection axis that passes through the flywheel housing near the center of the flywheel housing and that intersects the front vertical plane of the object projection machine at a release point, the flywheel housing dynamically mounted within the main frame adjacent to the front vertical plane of the object projection machine so that the flywheel housing can be translated horizontally and vertically in order to position the release point at arbitrary positions on the front vertical plane of the object projection machine, so that the flywheel housing can be rotated with respect to two axes of rotation in order to orient the direction of the projection axis, and so that the flywheel housing can be rotated about the projection axis to rotationally orient the flywheel housing with respect to the projection axis;

a number of electrical motors to provide forces to translate and rotate the flywheel housing;

an upper flywheel comprising a disk coplanar with a plane bisecting the upper flywheel and with the projection axis, a central, cylindrical aperture orthogonal to the plane bisecting the upper flywheel, and a cylindrical outer surface bonded to a compressible circumferential belt, the upper flywheel rotatably mounted within the flywheel housing to an upper axle passing through the central, cylindrical aperture, the upper axle located above the projection axis and coupled to an upper-flywheel electrical servo motor that provides a rotational force to spin the upper flywheel about the upper axle, the upper axle perpendicular to, and above, the projection axis;

lower flywheel comprising a disk coplanar with a plane bisecting the upper and lower flywheels and with the projection axis, a central, cylindrical aperture orthogonal to the plane bisecting the upper flywheel, and a cylindrical outer surface bonded to a compressible circumferential belt, the lower flywheel rotatably mounted within the flywheel housing to a lower axle passing through the central, cylindrical aperture, the lower axle located below the projection axis and coupled to a lower-flywheel electrical servo motor that provides a rotational force to spin the lower flywheel about the lower axle, the lower axle perpendicular to, and below, the projection axis;

an object feeder that feeds the object along the projection axis between the upper and lower flywheels so that, when the flywheels are counter rotating in the direction of the projection axis, the object is gripped by the two counter-rotating flywheels and projected along the projection axis through the front vertical plane of the object projection machine with an initial velocity determined by the rate of rotation of the upper and lower flywheels, with an initial rotational spin coplanar with the plane bisecting the upper and lower flywheels determined by the difference in rotation rates between the upper and lower flywheels, and with an initial trajectory coincident with the projection axis.

2. The object projection machine of claim 1 wherein the flywheel housing can be rotated about the projection axis as the object is gripped and projected by the upper and lower counter-rotating flywheels in order to impart a spin to the object in a plane orthogonal to the projection axis.

3. The object projection machine of claim 1 wherein the compressible circumferential belts bonded to the external cylindrical surface of the lower and upper flywheels are urethane belt with a Durometer compressibility of 40 A to 45 A.

4. The object projection machine of claim 3 wherein the external surface of the urethane belt has a circumferential groove to facilitate gripping of a spherical object.

5. The object projection machine of claim 1 wherein the main frame has a front vertical frame with an interior side and an exterior side coplanar with the front vertical plane of the object projection machine and wherein the flywheel housing is rotationally mounted to a W-axis carriage, wherein the W-axis carriage is rotationally mounted to a Y-axis carriage, wherein the Y-axis carriage is rotationally mounted to a Z-axis carriage, wherein the Z-axis carriage is slidably mounted to an X-axis frame, and wherein the X-axis frame is slidably mounted to the interior side of the front vertical frame of the main frame.

6. The object projection machine of claim 5 wherein the flywheel housing further comprises:

a disk-shaped, cylindrical cable tray with a circular aperture perpendicular to the projection axis and through which the projection axis passes;

a double-ringed geared turntable bearing with a circular aperture, a smaller, inner ring of the double-ringed geared turntable bearing fastened to the cable tray such that the circular aperture of the double-ringed geared turntable bearing is aligned with the circular aperture of the cable tray; and an electrical servo motor bolted to the cable tray and having a power shaft with a gear fixed to the distal end of the power shaft, the power shaft perpendicular to the plane of the cable tray and passing through an aperture in the cable tray in order for the gear fixed to the distal end of the power shaft to enmesh with a geared, outer ring of the double-ringed geared turntable bearing such that rotation of the power shaft is transduced by the enmeshed gears into rotation of the flywheel housing about the projection axis.

7. The object projection machine of claim 6 wherein the W-axis carriage comprises:

a W-axis carriage base plate having a top side, a bottom side, a front edge, and a back edge;

a W-axis fixed sector gear mounted to the bottom side of the W-axis carriage base plate along the back edge of the W-axis carriage base plate;

a W-axis carriage front plate having a forward side, a back side, a top, a bottom, and a circular aperture, the bottom back side of the W-axis carriage front plate mounted orthogonally to the front edge of the W-axis carriage base plate, the W-axis carriage front plate having an upper trunnion and a lower trunnion that project forward from the forward side of the W-axis carriage front plate, the upper trunnion parallel to a plane passing through the W-axis carriage base plate, the lower trunnion in a plane passing through the W-axis carriage base plate, both trunnions containing bearings through which pins mounted to the Y-axis carriage pass to rotatably mount the W-axis carriage to the Y-axis carriage, the larger, geared ring of the double-ringed geared turntable bearing fastened to the W-axis carriage front plate so that the circular aperture of the W-axis carriage front plate is aligned with the circular aperture of the cable tray;

a J-axis assembly comprising a vertical support member and an angled support member both having top ends and bottom ends, the bottom ends of both support members orthogonally fastened to the top side of the W-axis carriage base plate;

a J-axis base plate having a top side and a bottom side and fastened to the top end of the vertical and angled support members parallel to the W-axis carriage base plate;

a J-axis electrical servo motor, mounted to the bottom side of the J-axis base plate, having a J-axis power shaft that passes through an aperture in the J-axis base plate and to which a J-axis power shaft gear is affixed; and a J-axis geared shaft rotatably mounted to the J-axis base plate so that the J-axis geared shaft enmeshes with the J-axis power shaft gear to transduce J-axis power shaft rotation into J-axis geared shaft rotation; and the object feeder mounted to the J-axis geared shaft so that the object feeder can be rotated about the J-axis to facilitate loading of the object gripper coupled to the object feeder and feeding of the object in between the upper and lower flywheels.

8. The object projection machine of claim 7 wherein the object feeder comprises:

an electrical cylinder or linear induction motor that extends and retracts an extensible arm; and an object gripper that is rotatably mounted to the end of the extensible arm, the object gripper comprising spring-loaded lever fingers that rotate apart under spring tension as an object is inserted into the object gripper and then rotate back towards the object, after the object has passed apexes of the cam fingers, to release spring tension and firmly grip the object, the object gripper having two guide channels parallel to the projection axis, one guide channel sliding along a stationary guide attached to the electrical cylinder as the extensible arm is extended, and both guide channels sliding along guides mounted to inner surfaces of the flywheel housing so that, as the flywheel housing is rotated about the projection axis, the object gripper is rotated along with the flywheel housing in order to maintain a fixed orientation of the object with respect to the flywheels.

9. The object projection machine of claim 8 wherein the object gripper has inscribed marks indicating positions against which features of the object should lie in order to assure a correct and reproducible orientation of the object with respect to the flywheels.

10. The object projection machine of claim 8 wherein the Y-axis carriage comprises:

a Y-axis carriage front frame having a forward side, a back side, a top, and a bottom, and having two longitudinal members and two transverse members joined together to form a rectangular frame, and having a cross-member mounted to the two longitudinal members;

a Y-axis carriage base frame having a top side, a bottom side, a front edge, and a back edge, and mounted orthogonally to the back side of the Y-axis carriage front frame, the front edge of the Y-axis carriage base frame mounted to the cross member of the Y-axis carriage front frame;

a Y-axis base plate having a top side, a bottom side, a forward edge, and a back edge, and mounted to the top side of the Y-axis carriage base frame with the back edge of the Y-axis base plate collinear with the back edge of the Y-axis base frame;

a W-axis electrical servo motor mounted to the bottom side of the Y-axis base plate and having a power shaft that passes through an aperture in the Y-axis base plate to the distal end of which is mounted a W-axis power-shaft gear, the W-axis power shaft gear enmeshing with the W-axis fixed sector gear in order to transduce rotation of the W-axis power shaft into rotation of the W-axis carriage about a W-axis passing through the trunnion-mounted pins that rotatably mount the W-axis carriage to the Y-axis carriage;

two forward-facing Y-axis carriage trunnions mounted to the longitudinal members of the Y-axis carriage front frame and projecting forward from the Y-carriage front frame, the Y-axis carriage trunnions having bearings through which Y-axis pins are rotationally mounted to the Z-axis carriage; and a downward facing Y-axis fixed sector gear mounted orthogonally to the bottom side of the Y-axis base frame and orthogonally to the Y-axis front frame.

11. The object projection machine of claim 10 wherein the Z-axis carriage comprises:

a rectangular cage having a left front longitudinal member, a right front longitudinal member, a left back longitudinal member, a right back longitudinal member, four lower transverse members that form a lower rectangular base frame to the corners of which the longitudinal members are orthogonally mounted, and three upper transverse members that form a semi-rectangular ceiling frame to the corners of which the longitudinal members are orthogonally mounted, the rectangular cage having a forward face;

a rectangular front face plate with an aperture that is aligned with the aperture of the W-axis carriage front plate, the rectangular front face plate mounted to the forward face of the rectangular cage and having a forward surface and a back surface;

two Y-axis pins mounted to inner sides of the two front longitudinal members upon which the Y-axis carriage is rotatably mounted;

a left longitudinal angle bracket mounted to the left back longitudinal member to present a left longitudinal face in a forward direction and parallel with the front face of the rectangular cage and a right longitudinal angle bracket mounted to the right back longitudinal member to present a right longitudinal face in a forward direction and parallel with the front face of the rectangular cage;

two pairs of rollers rotatably mounted to the left longitudinal face of the left angle bracket and two pairs of rollers rotatably mounted to the right longitudinal face of the right angle bracket; and a Y-axis electrical servo motor mounted to the Z-axis carriage lower rectangular base frame having a power shaft to the distal end of which a Y-axis power shaft gear is mounted, the Y-axis power shaft gear enmeshed with the Y-axis fixed sector gear so that rotation of the Y-axis electrical servo motor is transduced into rotation of the Y-axis carriage about a Y-axis collinear with the Y-axis pins.

12. The object projection machine of claim 11 wherein a green light, a yellow light, and a red light are vertically mounted to the forward surface of the Z-axis carriage rectangular front face plate so that, prior to projection of an object, the red, yellow, and green lights can be illuminated in sequence to warn an observer that an object will be projected following illumination of the green light.

13. The object projection machine of claim 11 wherein the X-axis frame comprises:

a left longitudinal member and a right longitudinal member joined to an upper transverse member and a lower transverse member in order to form a rectangular frame, the longitudinal and transverse members having forward sides and back sides;

four pairs of rollers rotatably mounted to the forward faces of the X-axis frame near the corners of the X-axis frame;

a passive linear drive track attached to the back of a first X-axis frame longitudinal member, two pairs of Z-axis rollers slidably mounted to the passive linear drive track; and a Z-axis electrical servo motor and active linear drive track attached to the back side of a second X-axis frame longitudinal member, two pairs of Z-axis rollers slidably mounted to the active linear drive track, the Z-axis carriage coupled to a lead screw of the active linear drive track so that the Z-axis carriage can be translated vertically along the X-axis frame by power provided by the Z-axis electrical servo motor.

14. The object projection machine of claim 13 wherein a passive linear drive track is horizontally attached near a first edge of the inner side of the front vertical face of the main frame, wherein an X-axis electrical servo motor and an active linear drive track is horizontally attached near a second edge of the inner side of the front vertical face of the main frame, and wherein two pairs of X-axis rollers are slidably mounted to the horizontally attached passive linear drive track and two pairs of X-axis rollers are slidably mounted to the horizontally attached active linear drive track so that the X-axis frame can be translated horizontally across the inner side of the front vertical face of the main frame by power provided by the X-axis electrical servo motor.

15. The object projection machine of claim 1 wherein the object is a baseball.

16. The object projection machine of claim 15 wherein the object projection machine can project the baseball with varying trajectories and velocities that closely match the trajectories of common baseball pitches pitched by particular human baseball pitchers, including fastballs, curveballs, sliders, knuckleballs, and other types of off-speed pitches.

17. The object projection machine of claim 15 wherein the object projection machine can project the baseball to a position within a radius of two inches of a desired position relative to an imaginary batter's box, when positioned 60 feet away.

18. The object projection machine of claim 15 wherein a projection screen having a movable shutter is mounted to a front face of the main frame, wherein a video image of a baseball pitcher is displayed on the projection screen, and wherein, when the image of the baseball pitcher releases a baseball, the object projection screen opens the movable shutter at the release point and projects a baseball through the movable shutter.

19. The object projection machine of claim 1 wherein the number of electrical servo motors that control the position and orientation of the flywheel housing and the two electrical servo motors that drive rotation of the upper and lower flywheels are controlled by a software program running on a computer.

20. The object projection machine of claim 19 wherein the software program presents a graphical user interface to a user to allow the user to specify a baseball pitch.

21. The object projection machine of claim 20 wherein, when the user has specified a baseball pitch, the software program retrieves a number of database records that include parameters for the specified baseball pitch, prepares a sequence of electrical servo motor control events from the parameters that are associated with time values relative to projection of the baseball associated with a particular electrical servo motor, and ordered in time, executes the timed sequence of electrical servo motor control events by, for each electrical servo motor control event in the timed sequence of electrical servo motor control events, issuing a command to a motion control driver corresponding to the electrical servo motor associated with the electrical servo motor control event at the time associated with the electrical servo motor control event, the motion control driver command translated into an output to a servo amplifier that is amplified and transmitted by the servo amplifier to the electrical servo motor associated with the electrical servo motor control event.

* * * * *